US011659971B2

(12) United States Patent
Kim et al.

(10) Patent No.: US 11,659,971 B2
(45) Date of Patent: May 30, 2023

(54) ROBOT CLEANER

(71) Applicant: Samsung Electronics Co., Ltd., Suwon-si (KR)

(72) Inventors: Sinae Kim, Suwon-si (KR); Yongseok Kim, Suwon-si (KR); Minro Yun, Suwon-si (KR); Yeonkyu Jeong, Suwon-si (KR); Shin Kim, Suwon-si (KR); Jaeyoul Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 282 days.

(21) Appl. No.: 16/891,673

(22) Filed: Jun. 3, 2020

(65) Prior Publication Data

US 2020/0383546 A1 Dec. 10, 2020

(30) Foreign Application Priority Data

Jun. 4, 2019 (KR) ..... 10-2019-0066239

(51) Int. Cl.
*A47L 9/28* (2006.01)
*A47L 9/00* (2006.01)

(52) U.S. Cl.
CPC ..... *A47L 9/2836* (2013.01); *A47L 9/009* (2013.01); *A47L 9/2852* (2013.01); *A47L 9/2889* (2013.01); *A47L 2201/04* (2013.01)

(58) Field of Classification Search
CPC .... A47L 2201/04; A47L 9/009; A47L 9/2836; A47L 9/2852; A47L 9/2889
See application file for complete search history.

(56) References Cited

U.S. PATENT DOCUMENTS

| | | | | |
|---|---|---|---|---|
| 7,103,449 | B2 | 9/2006 | Woo et al. | |
| 9,271,621 | B2 * | 3/2016 | Park | G05D 1/0248 |
| 9,283,670 | B2 * | 3/2016 | Sun | G05D 1/024 |
| 2004/0199301 | A1 * | 10/2004 | Woo | G05D 1/0255 701/1 |

(Continued)

FOREIGN PATENT DOCUMENTS

| | | | |
|---|---|---|---|
| CN | 1517188 | A | 8/2004 |
| CN | 108209773 | A | 6/2018 |

(Continued)

OTHER PUBLICATIONS

International Search Report and Written Opinion for corresponding PCT/KR2020/007154, dated Sep. 25, 2020.

(Continued)

*Primary Examiner* — Marc Carlson
(74) *Attorney, Agent, or Firm* — Staas & Halsey LLP

(57) ABSTRACT

Disclosed are a robot cleaner. The robot cleaner includes: a cleaner body configured to move in an area and clean the area; and a sensor assembly provided in the cleaner body. The sensor assembly includes: a main sensor configured to be moveable between a sensing position where the main sensor protrudes out of the cleaner body and a settled position where the main sensor is inside the cleaner body; a sensor position changer configured to allow the main sensor to move between the sensing position and the settled position; and a stopper configured to restrict the sensor position changer from allowing the main sensor at the sensing position to move towards the settled position.

20 Claims, 58 Drawing Sheets

(56) References Cited

U.S. PATENT DOCUMENTS

| | | | | |
|---|---|---|---|---|
| 2014/0257564 | A1* | 9/2014 | Sun | G05D 1/024 700/259 |
| 2018/0368645 | A1* | 12/2018 | Ham | A47L 11/4011 |
| 2019/0038107 | A1* | 2/2019 | Jang | A47L 11/4044 |

FOREIGN PATENT DOCUMENTS

| | | | |
|---|---|---|---|
| CN | 208481270 | U | 2/2019 |
| EP | 2 774 523 | A2 | 9/2014 |
| KR | 10-2009-0007914 | A | 1/2009 |
| KR | 10-2013-0023564 | A | 3/2013 |
| KR | 10-1395888 | B1 | 5/2014 |
| KR | 10-1450569 | B1 | 10/2014 |
| KR | 10-2019-0001152 | A | 1/2019 |
| WO | 2018/225172 | A1 | 12/2018 |

OTHER PUBLICATIONS

Partial Supplementary European Search Report dated Jul. 22, 2022 in European Patent Application No. 20818599.1.
Extended European Search Report dated Oct. 27, 2022 in European Patent Application No. 20818599.1 (9 pages).
Chinese Office Action dated Nov. 3, 2022 in Chinese Patent Application No. 202080029017.3 (8 pages; 6 pages English translation).

* cited by examiner

ROBOT CLEANER

CROSS-REFERENCE TO RELATED THE APPLICATION

This application is based on and claims priority under 35 U.S.C. § 119 to Korean Patent Application No. 10-2019-0066239 filed on Jun. 4, 2019 in the Korean Intellectual Property Office, the disclosure of which is incorporated by reference herein in its entirety.

BACKGROUND

Field

The disclosure relates to a robot cleaner.

Description of the Related Art

A robot cleaner automatically moves an area and cleans the area by suctioning foreign substance such as dust from a floor.

The robot cleaner senses a distance to an obstacle, for example, furniture, office supplies, walls, etc. that are installed in the area, and performs mapping the area based on the distance, as the robot cleaner controls driving of wheels to evade the obstacle. In a related art, a sensor that observes a ceiling or floor is used, so that the robot cleaner calculates a distance in which the robot cleaner moves and, based on the moving distance, also calculates the distance to the obstacle. Because the art is an indirect way where the robot cleaner estimates the distance to the obstacle, if the moving distance is not exactly calculated due to a curve of the floor, etc., the distance to the obstacle should also have an error. Specifically, in case of using infrared light or an ultrasonic wave to calculate the distance, a significant error may occur in the distance calculating because the light or wave is scattered from the obstacle. Also, there may be obstacles, for example, a threshold having a protrusion from the floor, a chair or a bed having a space thereunder, and an object spread in both upper and lower directions. However, the robot cleaner cannot completely identify the obstacles.

In order to solve the problem, a method is proposed to sense the obstacle by protruding the sensor out of the robot cleaner. As the robot cleaner with a sensor protruding outwards moves, the sensor may happen to be pushed by the obstacle and be forced to get into the robot cleaner. If the sensor is not at a normal position where the sensor properly performs a sensing operation, a connectivity of data collected by the sensor may be broken and there may be loss of the data.

SUMMARY

According to an embodiment of the disclosure, a robot cleaner includes: a cleaner body configured to move in an area and clean the area; and a sensor unit provided in the cleaner body. The sensor unit includes: a main sensor configured to sense an obstacle in the area; a sensor position changer configured to allow the main sensor to move between a sensing position and a settled position, the main sensor protruding out of the cleaner body at the sensing position and being inside the cleaner body at the settled position; and a stopper configured to restrict the main sensor at the sensing position from moving towards the settled position.

The sensor position changer may include: a motor; and a link unit including: a first link member configured to rotate with a rotation axis of the motor; and a second link member, a first end of the second link member hinged to the first link member and a second end of the second link member hinged to the main sensor.

The stopper may further include a link member receiver configured to receive the first link member with the main sensor being at the sensing position and to restrict the first link member from overly rotating.

The stopper may further include a link member supporter having a flat portion which extends perpendicularly to a direction in which the main sensor moves, the flat portion of the link member supporter supporting the first end of the second link member.

The sensor position changer may include: a motor; a pinion coupled with a rotation axis of the motor; and a rack coupled with the main sensor and geared with the pinion.

The stopper may further include: a locking member; and a driver configured to allow the locking member to move between a lock state and a unlock state, the locking member in the lock state restricting the rack from moving with the main sensor being at the sensing position.

The sensor unit may further include a sensor holder having a space that corresponds to a shape of the main sensor to accommodate the main sensor, and the sensor holder may include: a lower sensor holder holding the main sensor and supported by the sensor position changer; and an upper sensor holder coupled to the lower sensor holder to be movable in a direction where the cleaner body moves within a gap between the lower sensor holder and the upper sensor holder.

The sensor unit may further include a sensor holder having a space to accommodate the main sensor. The sensor holder may be supported by the sensor position changer to be movable in every direction where the cleaner body moves.

The sensor unit may further include a position restoration member configured to restore the sensor holder which is moved by the obstacle to an initial position.

The position restoration member may include: a ring; and a plurality of elastic portions extending from an inner side of the ring inwards in a spiral form.

The sensor unit may further include a position restoration guide configured to guide the upper sensor holder to move in a direction where the cleaner body moves and to restore the upper sensor holder to an initial position.

The position restoration guide may include: a spring provided between the lower sensor holder and the upper sensor holder; a first guide provided with one of the lower sensor holder and the upper sensor holder; and a second guide provided opposite the first guide.

The first guide may include: a guide member having a guide groove that extends perpendicularly to a direction in which the cleaner body moves; and a guide pin supported by one of the lower sensor holder and the upper sensor holder, the guide pin being inserted in the guide groove of the guide member, and the second guide may include: a convex portion protruding from a surface of the upper sensor holder; and a concave portion provided on a surface of the lower sensor holder, a shape of the concave portion corresponding to the convex portion.

The sensor unit may further include: a base supporting the motor; and a sensor movement guide provided between the base and the sensor holder, the sensor movement guide being configured to guide the main sensor to move.

The sensor unit may further include an auxiliary sensor that is provided at a limit position and senses whether the main sensor reaches the sensing position or is away from the sensing position.

The auxiliary sensor may further sense whether the robot cleaner with the main sensor being at the sensing position bumps into the obstacle.

The auxiliary sensor may include a pair of auxiliary sensors provided at the limit position opposite to each other in an angle, each of the pair of auxiliary sensors comprising a first terminal and a second terminal, and the sensor unit may further include a pushing switch provided between the pair of auxiliary sensors, the pushing switch being configured to push the second terminal to contact the first terminal.

The auxiliary sensor may become off as the main sensor is at the settled position, on as the main sensor is at the limit position, and off as the main sensor is at the sensing position.

The sensor unit may further include: a holder cap configured to cover an upper portion of the sensor holder; and a cap supporter having a tension bar that is provided on the upper portion of the sensor holder, the tension bar supporting the holder cap and elastically restore a position of the holder cap.

According to an embodiment of the disclosure, a robot cleaner include: a cleaner body configured to move in an area and clean the area; and a sensor unit provided in the cleaner body. The sensor unit includes: a main sensor configured to sense an obstacle in the area; a sensor position changer configured to allow the main sensor to move between a sensing position and a settled position, the main sensor protruding from the cleaner body at the sensing position and being inside the cleaner body at the settled position; and an auxiliary sensor provided at a limit position, the limit position being near the sensing position, the auxiliary sensor sensing whether the main sensor reaches the sensing position.

BRIEF DESCRIPTION OF THE DRAWINGS

The above and/or other aspects will become apparent and more readily appreciated from the following description of exemplary embodiments, taken in conjunction with the accompanying drawings, in which.

DETAILED DESCRIPTION OF EXEMPLARY EMBODIMENTS

Figure 1:
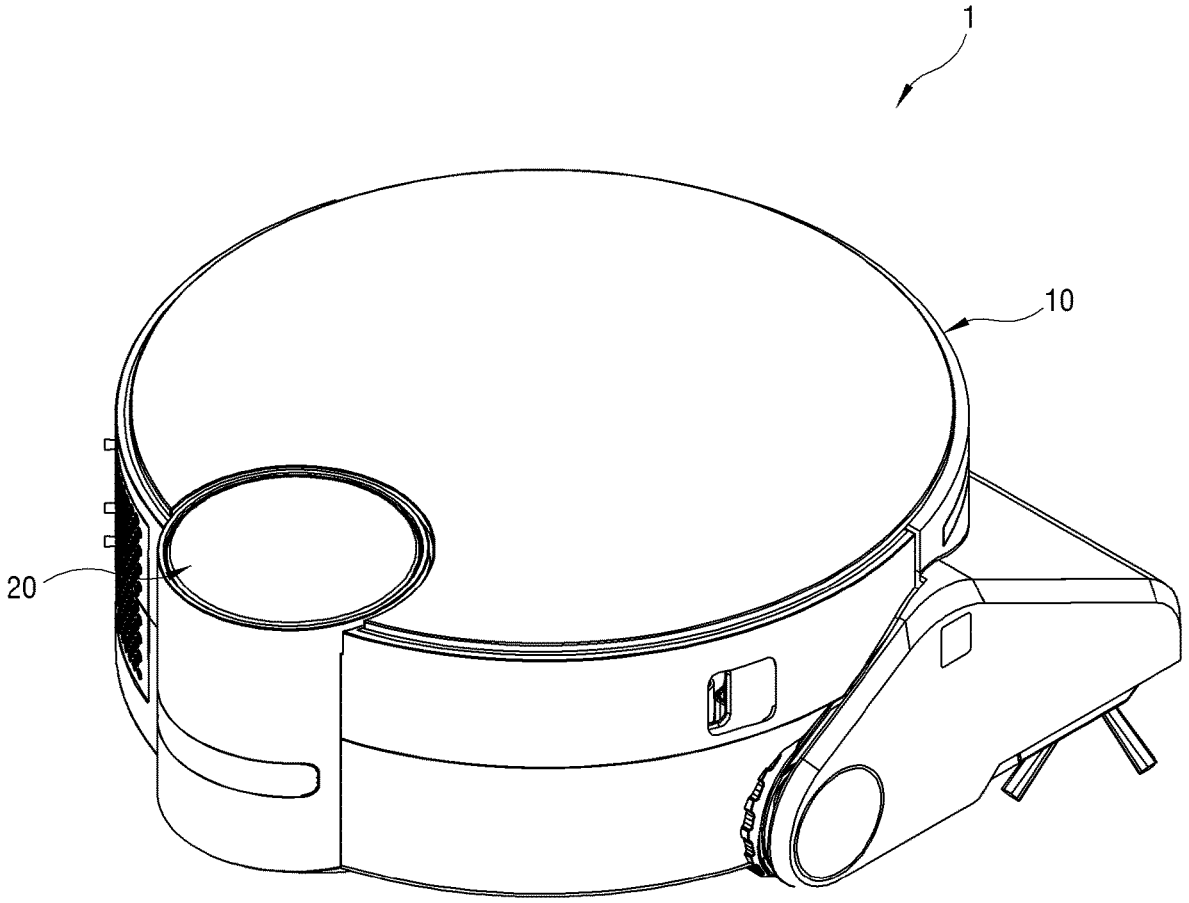
FIG. 1 is a perspective view of a robot cleaner according to an embodiment.

Below, various embodiments of the disclosure are described with reference to the accompanying drawings. However, these do not intent to limit the disclosure to a specific embodiment form, and it should be understood to include various modifications, equivalents and/or alternatives to the embodiments of the disclosure. Regarding the description of the drawings, like numerals refer to like elements.

In the disclosure, terms "have," "may have," "include," "may include," etc. indicate the presence of corresponding features (e.g. a numeral value, a function, an operation, or an element such as a part, etc.), and do not exclude the presence of additional features.

In the disclosure, terms "A or B", "at least one of A or/and B", "one or more of A or/and B" or the like may include all possible combinations of elements enumerated together. For example, "A or B", "at least one of A and B", or "at least one of A or B" may refer to all of the cases of (1) including at least one A, (2) including at least one B, or (3) including all of at least one A and at least one B.

In the disclosure, the terms "a first", "a second", "the first", "the second", or etc. may use various elements regardless of order and/or importance, and are just used to distinguish an element from another without limiting the elements. For example, a first user device and a second user device may refer to user devices different from each other regardless of the order or importance of the devices. For instance, a first element may be named a second element without departing from the scope of the present disclosure. Likewise, a second element may also be named a first element.

In the disclosure, terms "module", "unit", "part", etc. are used to denote an element that performs at least one function or operation, and such an element may be achieved by hardware, software or a combination of hardware and software. Further, a plurality of "modules", "units", "parts", etc. may be integrated into at least one module or chip as at least one processor except a case where it needs to be used as each individual specific hardware.

When it is mentioned that a certain element (e.g. a first element) is "(operatively or communicatively) coupled with/to" or "connected to" a different element (e.g. a second element), it will be understood that the certain element may be coupled to the different element directly or through another element (e.g. a third element). On the other hand, when it is mentioned that a certain element (e.g. a first element) is "directly coupled to" or "directly connected to" a different element (e.g. a second element), it will be understood that another elements (e.g. a third element) is not present between the certain element and the different element.

The terms used in the disclosure are used to just describe a specific embodiment, and may not intend to limit the scope of another embodiment. Unless otherwise specified clearly in the context, a singular form may include a plural form. The terms used herein including the technological or scientific terms may have the same meanings as those generally understood by a person having ordinary skill in the art. The terms defined in a general dictionary may be construed as having the same or similar meanings as the contextual meanings of the related art, and are not construed as having ideal or excessively formal meanings unless defined clearly in the disclosure. As necessary, even the terms defined in the disclosure may not be construed as excluding embodiments of the disclosure.

An aspect of the disclosure is to provide a robot cleaner, which maintains a connectivity of data collected by a sensor and prevents loss of the data.

Also, an aspect of the disclosure is to provide a robot cleaner, which identifies whether a main sensor reaches a sensing position or is away from a sensing position.

Also, an aspect of the disclosure is to provide a robot cleaner, which senses that a sensor unit bumps into an obstacle and clearly identifies circumstances of the obstacle.

Also, an aspect of the disclosure is to provide a robot cleaner, which allows a sensor unit to restore from being moved by an obstacle.

Also, an aspect of the disclosure is to provide a robot cleaner, which prevents a user's finger from being caught by a holder cap when a sensor unit bumps into an obstacle.

Figure 2:
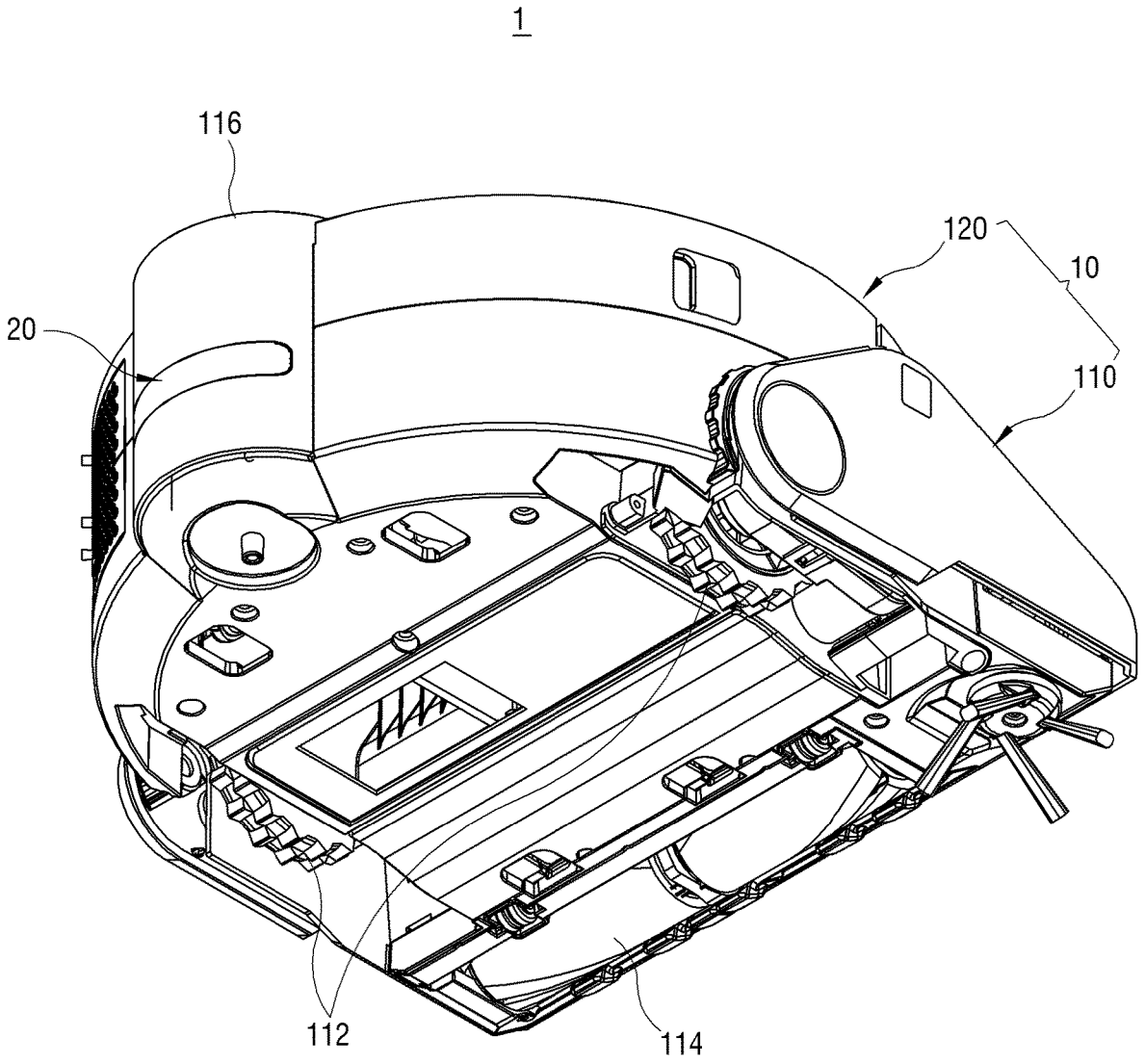
FIG. 2 is a perspective bottom view of the robot cleaner.
Figure 3:
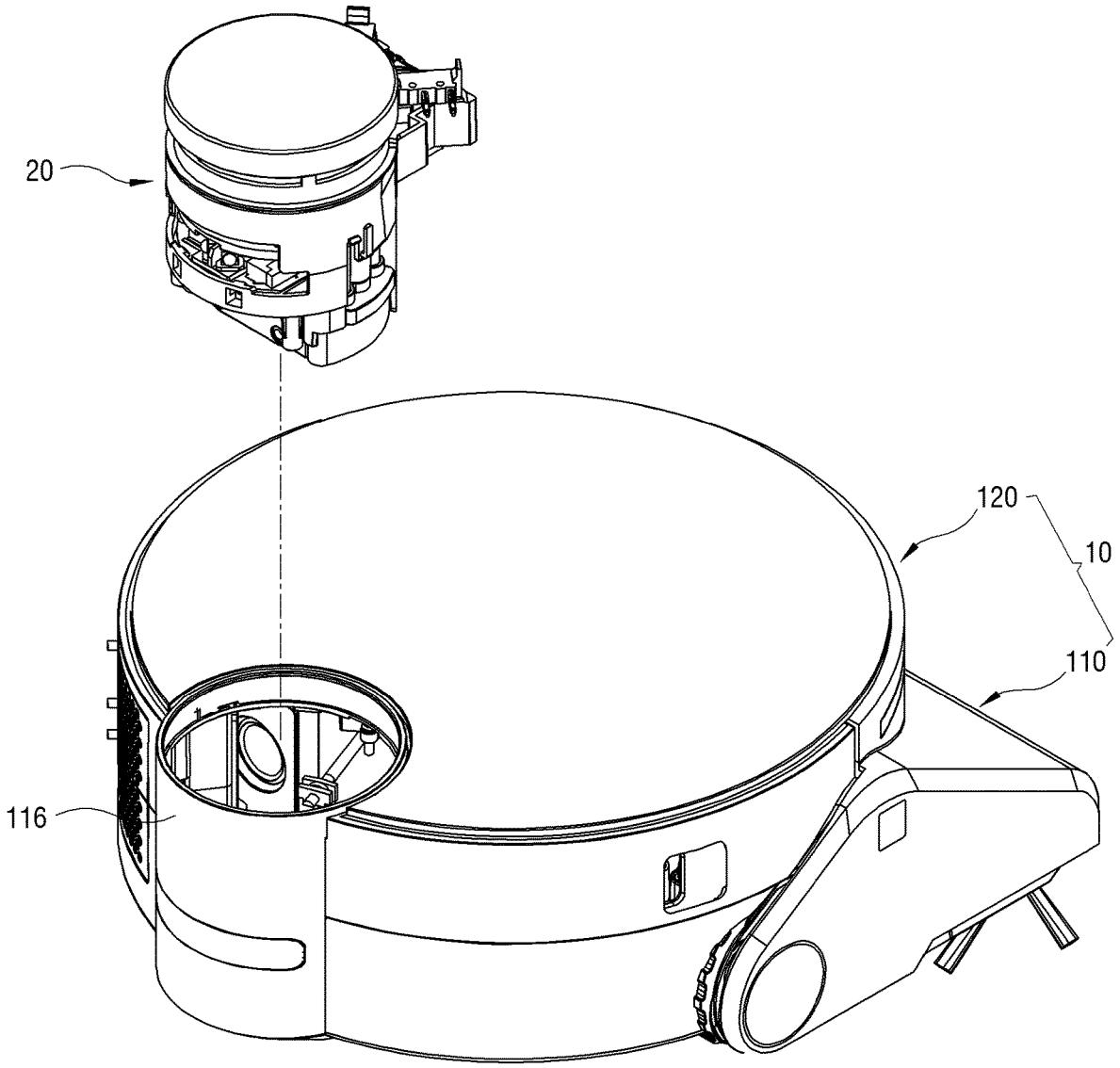
FIG. 3 is an exploded view of the robot cleaner.
Figure 4:
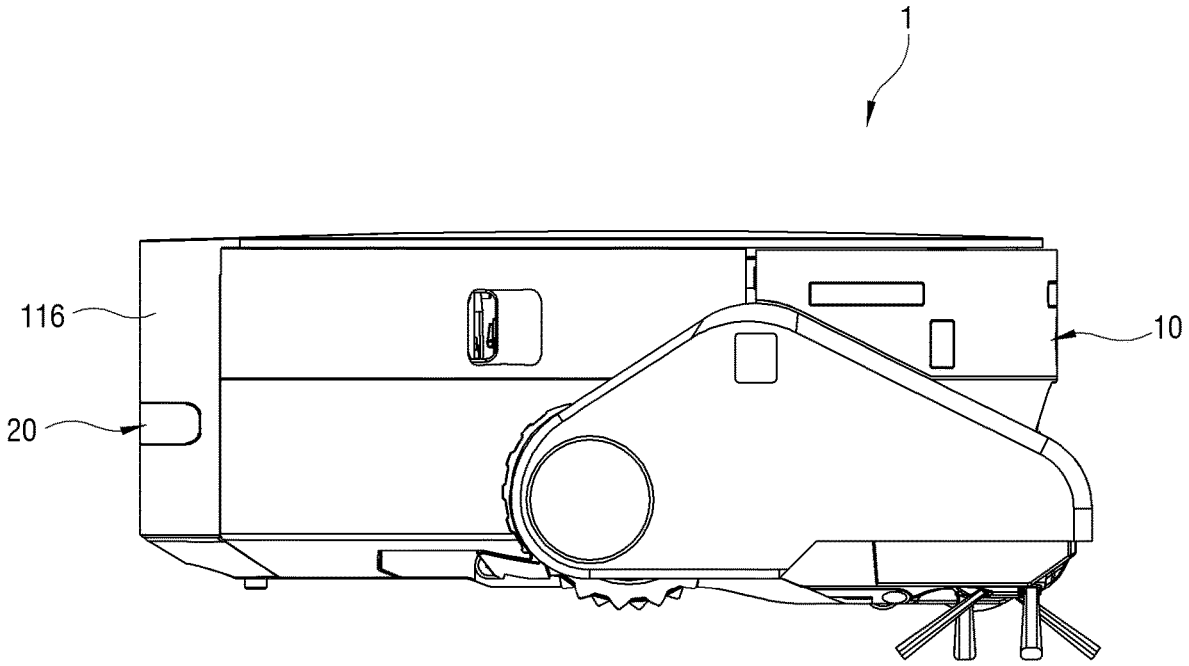
FIG. 4 is a perspective view of the robot cleaner before a sensor unit ascends.
Figure 5:
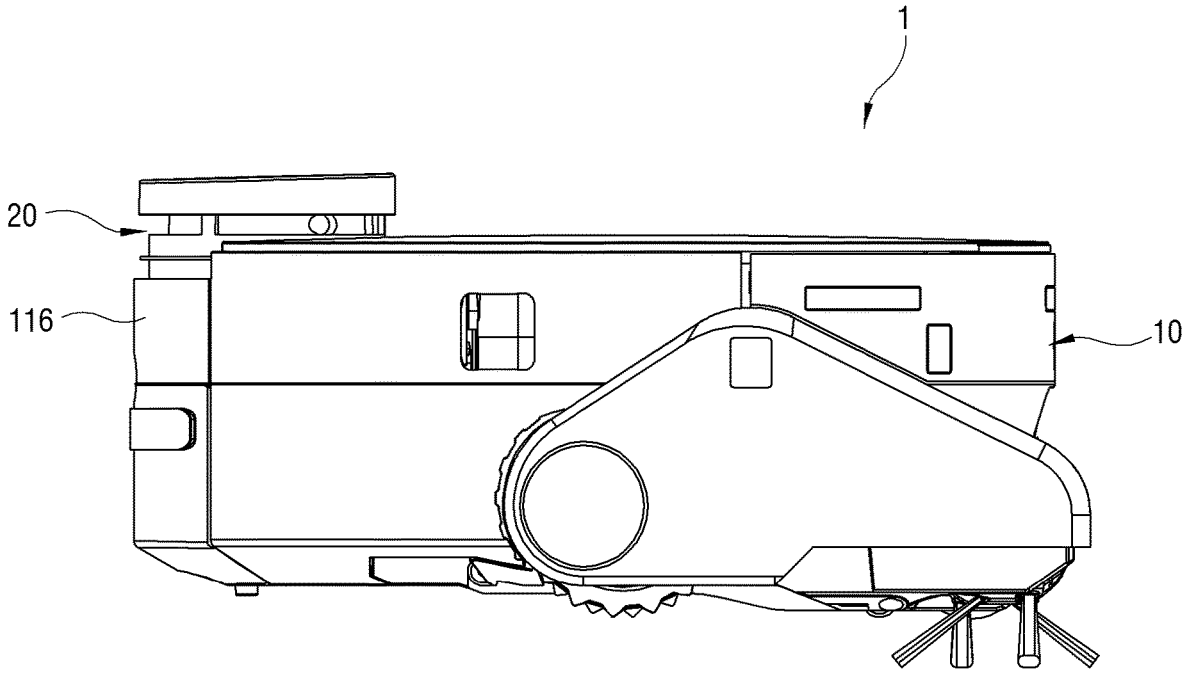
FIG. 5 is a perspective view of the robot cleaner after the sensor unit ascends.

FIG. 1 is a perspective view of a robot cleaner according to an embodiment. FIG. 2 is a perspective bottom view of the robot cleaner. FIG. 3 is an exploded view of the robot cleaner. FIG. 4 is a perspective view of the robot cleaner before a sensor unit ascends. FIG. 5 is a perspective view of the robot cleaner after the sensor unit ascends.

Referring to FIG. 1, the robot cleaner 1 according to an embodiment includes a cleaner body 10 which moves in an area and cleans the area, and a sensor unit 20.

Referring to FIGS. 2 and 3, the cleaner body 10 includes a dust suction body 110 which generates suction power and suctions dust in the area, and an upper cover 120 which covers an upper portion of the dust suction body 110.

The dust suction body 110 includes wheels 112 to move in the area, a dust collector 114 to collect the dust from the area, and a sensor housing 116 to accommodate the sensor unit 20. The dust suction body 110 may further include a motor which generates the suction power to suction the dust in the area.

The wheels 112 include a pair of wheels with a plurality of sawtooth in order not to slip on the area. The wheels 112 may further include at least one auxiliary wheel for stable movement of the cleaner body 10.

The dust collector 114 picks up by the suction power the dust in the area into the cleaner body 10. The dust collector 114 may include a filter to filter the suctioned dust.

The sensor unit 20 is provided in the sensor housing 116 of the cleaner body 10. The sensor unit 20 senses a position of the obstacle or a distance to the obstacle, and whether a position of the sensor unit 20 changes.

Referring to FIG. 4, the sensor unit 20 is at a settled position where the sensor unit 20 is settled inside the sensor housing 116. In this state, the robot cleaner 1 may be in a standby state for charging in a charging station.

Referring to FIG. 5, the sensor unit 20 is changed to a sensing position where the sensor unit 20 protrudes upwards out of the sensor housing 116. In this state, the robot cleaner 1 may be in a moving state for cleaning, as the sensor unit 20 performs a sensing operation for the obstacle. As to a configuration of the sensor unit 20, although the position of the sensor unit 20 may be changed in a different way, for example, horizontally or rotatably, a case of change in an ascending and descending way will only be described later.

Figure 6:
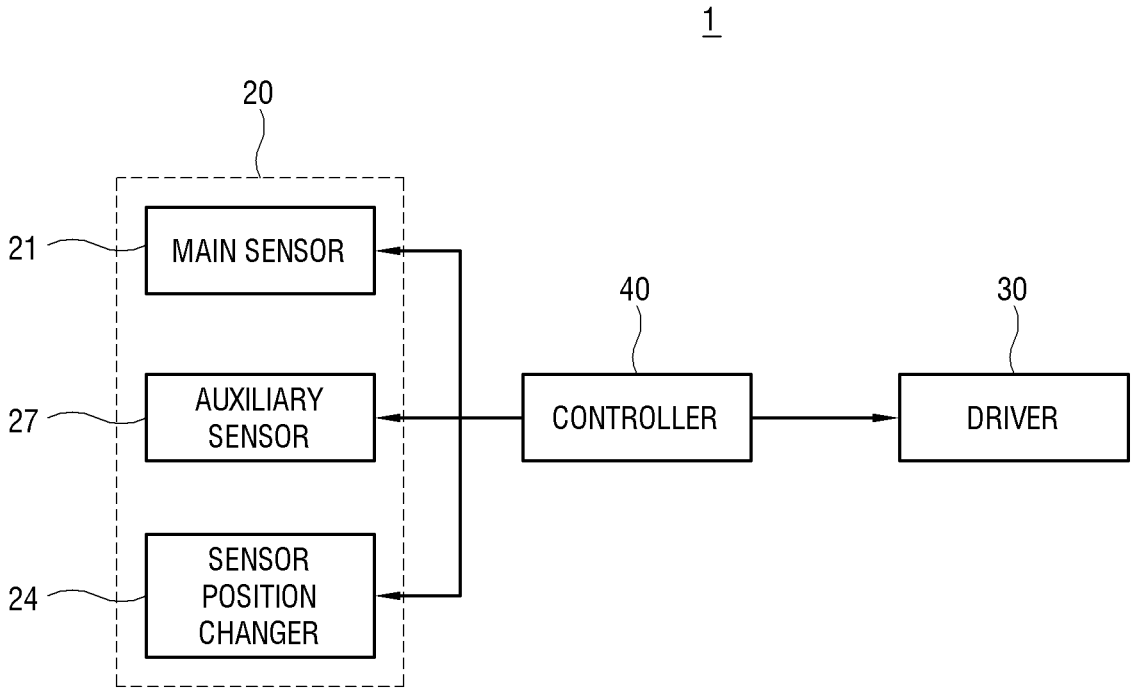
FIG. 6 is a block diagram illustrating a configuration of the robot cleaner.

FIG. 6 is a block diagram illustrating a configuration of the robot cleaner. Referring to FIG. 6, the robot cleaner 1 includes the sensor unit 20, a driver 30 and a controller 40. The sensor unit 20 includes a main sensor 21, a sensor position changer 24 and an auxiliary sensor 27.

The main sensor 21 emits an infrared light, laser light or ultrasonic wave to the area and senses the position of the obstacle or the distance to the obstacle using the infrared light, etc., which is reflected from the obstacle. The main sensor 21 may include a light source to emit the light and a light receiver to receive the light reflected from the obstacle. The light source may include a light emitting device, for example, a light emitting diode to emit an infrared, visible or laser light. The light receiver may include a plurality of pixels arranged in a matrix which is embodied as cadmium sulfite cells, a photo diode, a photo transistor, etc.

The sensor position changer 24 is under the control of the controller 40 to allow the main sensor 21 to change from the settled position to the sensing position or vice versa. The auxiliary sensor 27 senses whether the main sensor 21, of which the position is changed by the sensor position changer 24, reaches the sensing position or is away from the sensing position. The auxiliary sensor 27 is provided at a limit position through which the main sensor 21 is changed from the sensing position to the sensing position. The auxiliary sensor 27 senses whether the main sensor 21 passes through the limit position while the main sensor 21 ascends or descends. The limit position will be described in more detail later. Also, the auxiliary sensor 27 may further sense whether the sensor unit 20 bumps into the obstacle.

The driver 30 is under the control of the controller 40 to drive the pair of wheels 112 (shown in FIG. 2) of the cleaner body 10 to move forward, backward or turn around. The driver 30 may drive the wheels 112 based on information which is received from the sensor unit 20 and represents circumstances regarding the obstacle.

The controller 40 generally controls elements of the robot cleaner 1. The controller 40 controls, for example, the main sensor 21, the sensor position changer 24 and the driver 30.

The controller 40 controls the sensor position changer 24 so that the sensor unit 20 as illustrated in FIG. 5 ascends to the sensing position when the robot cleaner 1 shifts from the standby state for charging to the moving state for cleaning. Meanwhile, the controller 40 controls the sensor position changer 24 so that the sensor unit 20 as illustrated in FIG. 4 descends to the settled position when the robot cleaner 1 shifts to the standby state for charging after cleaning.

The controller 40 performs a control operation to provide a visual and/or audible notification to a user if the auxiliary sensor 27 senses that the main sensor 21 passes through the limit position as the main sensor 21 at the sensing position is pushed by the obstacle. The controller 40 controls the driver 30 based on the circumstances information regarding the obstacle which is sensed by the main sensor 21 and the auxiliary sensor 27.

The controller 40 executes a control program (or instructions) which allows the controller 40 to perform control operations. The controller 40 includes a processor which loads at least a part of the control program stored in a non-volatile memory to a volatile memory and executes the loaded control program. The processor may be, for example, a central processing unit (CPU), an application processor (AP), a microprocessor, etc. The processor may be a system-on-chip (SoC) which is mounted on a printed circuit board (PCB) provided in the robot cleaner 1.

The sensor unit 20 may include the sensor position changer 24, 64 to change the position of the main sensor. The sensor unit 20 may include a stopper 248, 642 which restricts the main sensor 21 at the sensing position from descending by the obstacle other than sensor position changer 24, 64.

The sensor unit 20 may include the auxiliary sensor 27, 67 to sense whether the main sensor 21 passes the limit position or whether the sensor unit 20 bumps into the obstacle with the main sensor 21 being at the sensing position.

The sensor unit 20 may include a position restoration guide 28 and/or a position restoration member 68 to allow a sensor holder 22, 62 holding the main sensor 21 at the sensing position to move horizontally and restore from bumping into the obstacle.

The sensor unit 20 may include a tension bar 2249 coupling the sensor holder 22, 62 with a holder cap 23, 63 to prevent a user's finger from being caught by the holder cap 23, 63 being lowered.

Figure 7:
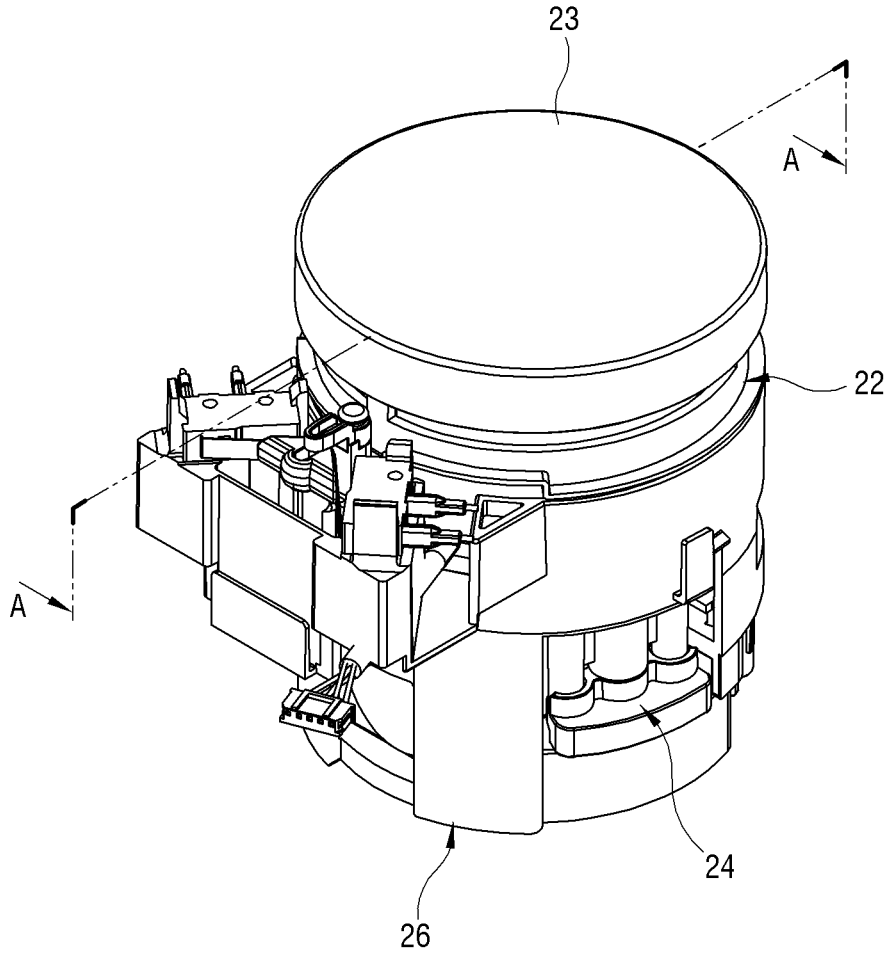
FIG. 7 is a perspective view of the sensor unit according to an embodiment.
Figure 8:
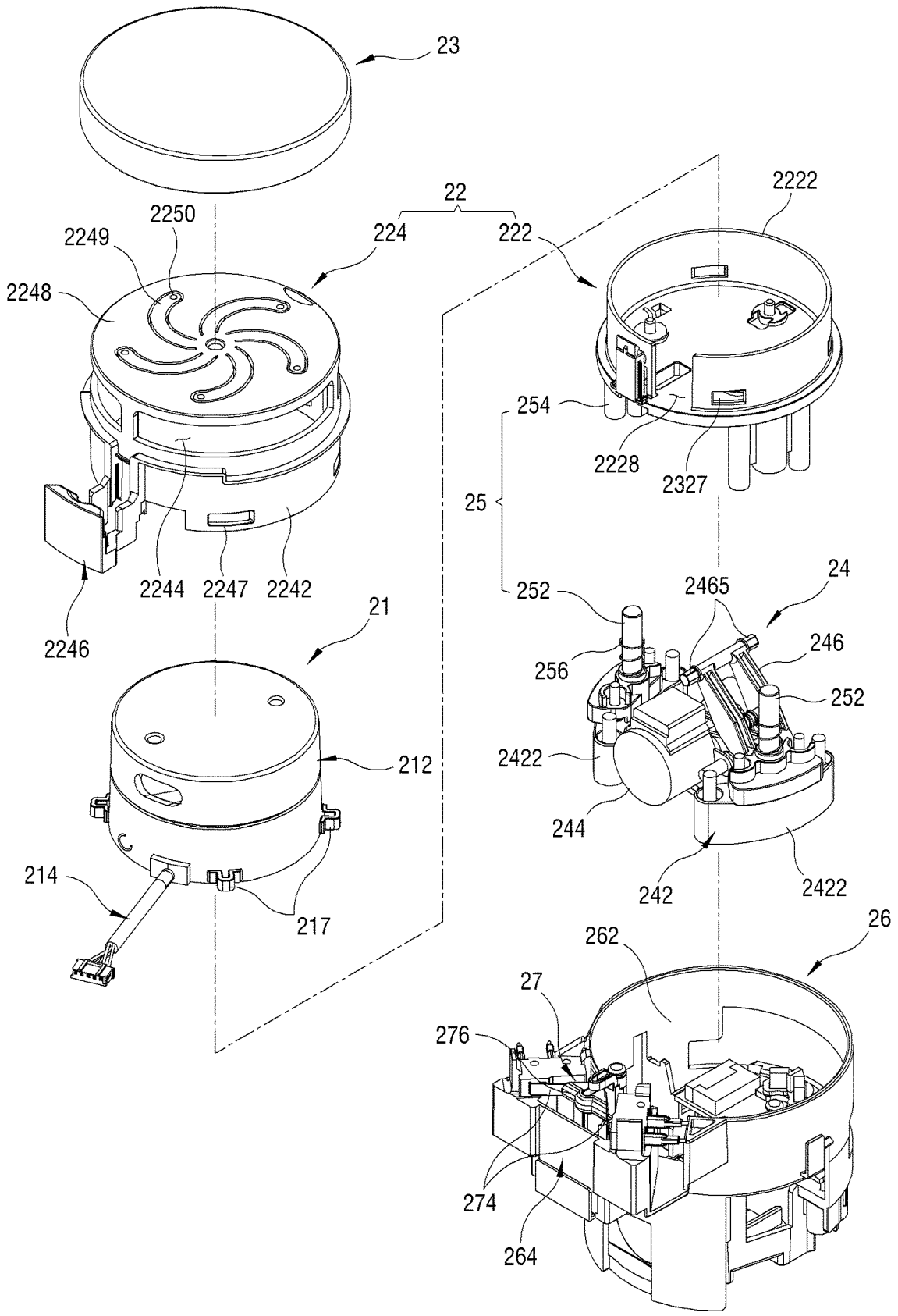
FIG. 8 is an upper exploded view of the sensor unit.
Figure 9:
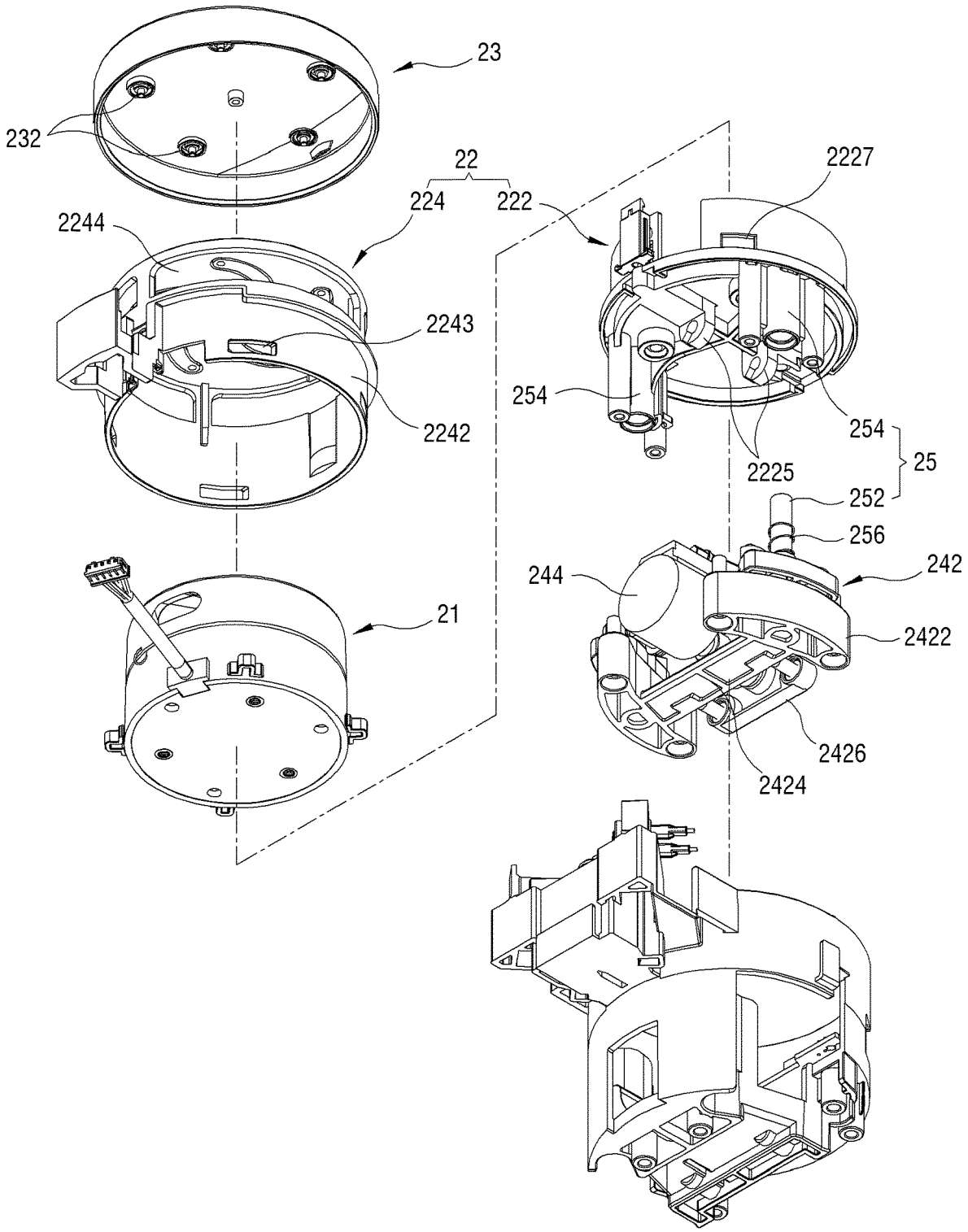
FIG. 9 is a lower exploded view of the sensor unit.
Figure 10:
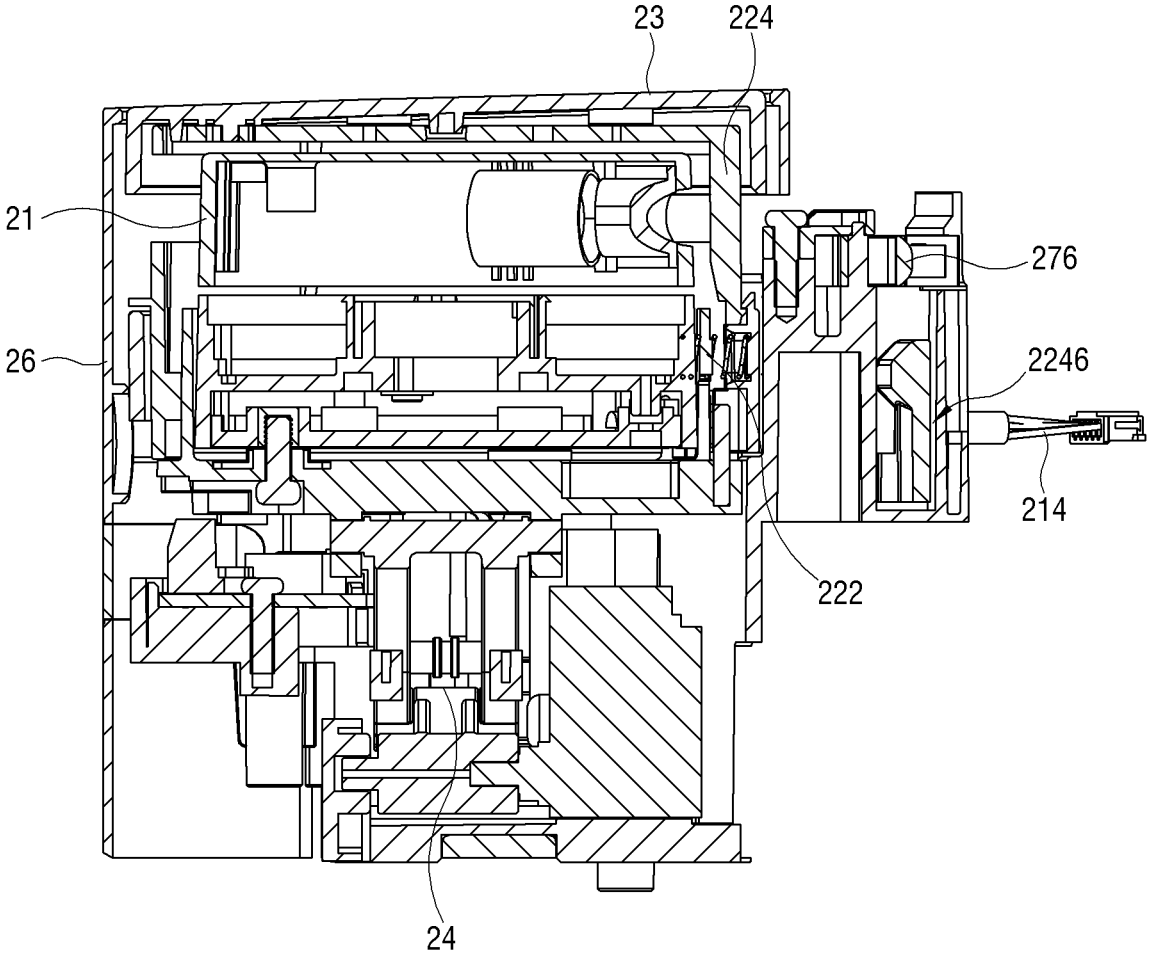
FIG. 10 is a sectional view of the sensor unit according to a A-A line of FIG. 7.

FIG. 7 is a perspective view of the sensor unit according to an embodiment. FIG. 8 is an upper exploded view of the sensor unit. FIG. 9 is a lower exploded view of the sensor unit. FIG. 10 is a sectional view of the sensor unit according to a A-A line of FIG. 7.

Referring to FIGS. 7 through 10, the sensor unit 20 includes the main sensor 21, the sensor holder 22, the holder cap 23, the sensor position changer 24, a sensor movement guide 25 and a sensor mounting unit 26.

The main sensor 21 obtains the circumstances information regarding the obstacle which represents the position of the obstacle or the distance to the obstacle by emitting light in all direction and receiving the light reflected from the obstacle. The obtained circumstances information regarding the obstacle is applied to an operation of the robot cleaner 1.

The main sensor 21 includes a case 212 in a cylindrical shape, a sensor provided in the case 212, a cable 214 connected to the sensor, drawn out of the case 212 and transmitting and receiving a signal, and holder coupling protrusions 217 provided on a surface of the case 212.

The sensor holder 22 includes a lower sensor holder 222 and an upper sensor holder 224. The lower sensor holder 222 and the upper sensor holder 224 are coupled with each other to accommodate the main sensor 21. The lower sensor holder 222 and the upper sensor holder 224 accommodating the main sensor 21 are moved by the sensor position changer 24 between the settled position and the sensing position.

Figure 13:
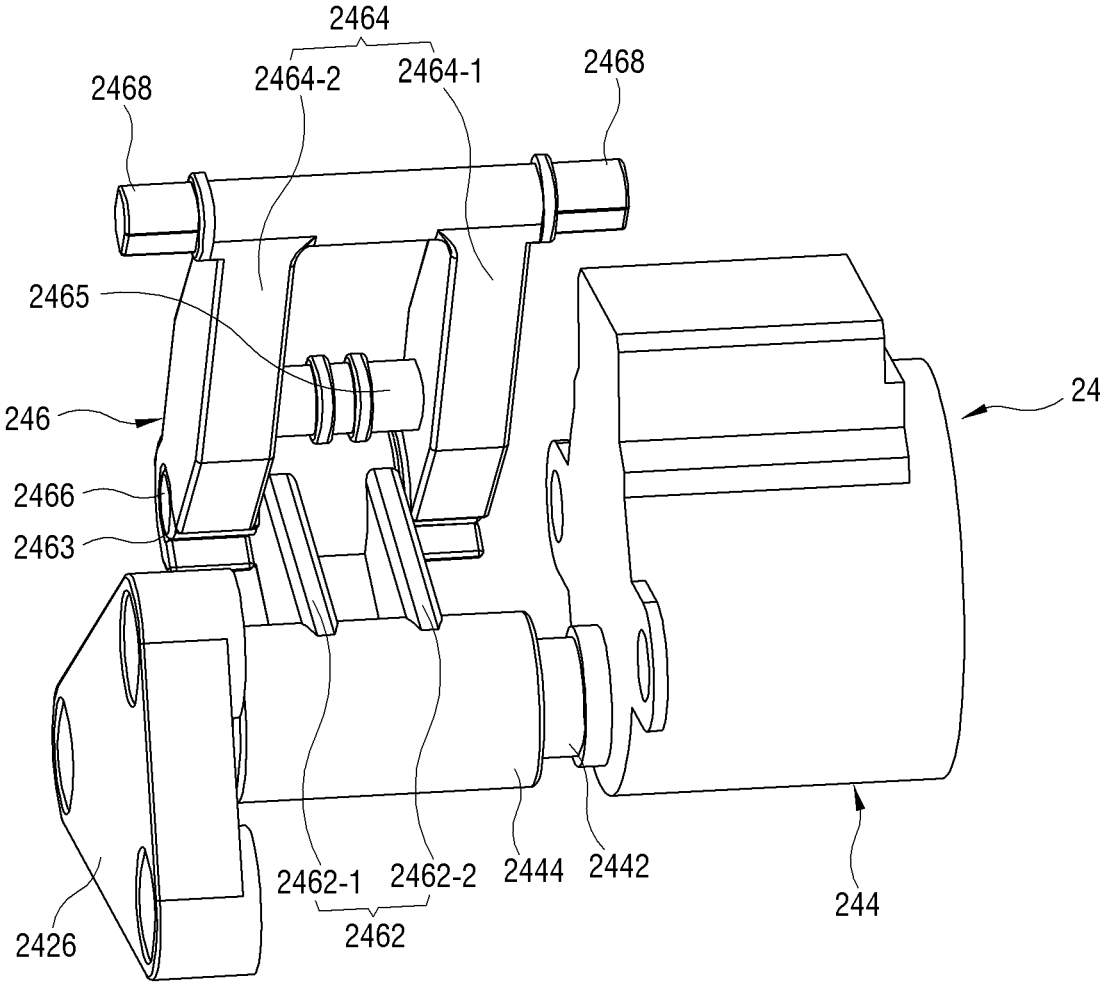
FIG. 13 is a perspective view of the sensor position changer.

The lower sensor holder 222 includes a sensor lower portion receiver 2222 having a cylindrical shape to receive a lower portion of the main sensor 21. The sensor lower portion receiver 2222 includes hinge pin coupling portions 2225 on a bottom of the lower sensor holder 222 where second hinge pins 2468 of the sensor position changer 24 shown in FIG. 13 are rotatably inserted into the hinge pin coupling portions 2225.

The sensor lower portion receiver 2222 includes lower coupling holes 2227 in FIG. 9 (2327 in FIG. 8) coupled to the holder coupling protrusions 217 of the main sensor 21 and a cable outlet portion 2228 cut to withdraw the cable 222 of the main sensor 21 out of the sensor lower portion receiver 2222.

The upper sensor holder 224 includes a sensor upper portion receiver 2242 having a cylindrical shape to receive an upper portion of the main sensor 21 and a terminal pushing portion 2246 protruding from a surface of the sensor upper portion receiver 2242, extending radially and bending upwards.

The sensor upper portion receiver 2242 includes a sensor opening 2244 provided radially through which light emitted by the main sensor 21 and light reflected from the obstacle pass, and upper coupling holes 2247 in FIG. 8 (2243 in FIG. 9) coupled to the holder coupling protrusions 217 of the main sensor 21. The holder coupling protrusions 217 of the main sensor 21 is inserted into the upper coupling holes 2247 in FIG. 8 (2243 in FIG. 9) through the lower coupling holes 2227 in FIG. 9 (2327 in FIG. 8) of the lower sensor holder 222. The sensor upper portion receiver 2242 has a diameter which is wider than that of the sensor lower portion receiver 2222 to accommodate the sensor lower portion receiver 2222. Also, an inner surface of the sensor upper portion receiver 2242 is apart from an outer surface of the sensor lower portion receiver 2222 by a gap. Accordingly, the sensor upper portion receiver 2242 has a space to move horizontally within the gap against the sensor lower portion receiver 2222 when the sensor unit 20 bumps into the obstacle while moving.

The upper sensor holder 224 includes a cap supporter 2248 in a plate shape to support the holder cap 23 over the upper sensor holder 224. The cap supporter 2248 includes, for example, five tension bars 2249 spirally extending from a center of the cap supporter 2248. One ends of the tension bars 2249 at the center are integrated and other ends of the tension bars 2249 are acted as free ends 2250. The free ends 2250 of the tension bars 2249 are joined with joint protrusions 232 provided on an inner side of the holder cap 23. The free ends 2250 of the tension bars 2249 may be joined with the joint protrusions 232 in a manner of a glue, heat fusion, etc. Alternatively, the tension bars 2249 may be manufactured separately from the cap supporter 2248 and then be coupled to the cap supporter 2248. Also, the tension bars 2249 may be provided on the holder cap 23 and the joint protrusions 232 on the cap supporter 2248.

The holder cap 23 covers an upper portion of the sensor holder 22. The sensor position changer 24 allows the sensor holder 22 to move among the settled position, the limit position and the sensing position. At the settled position, the sensor unit 20 is inside the cleaner body 10. At the limit position, the terminal pushing portion 2246 of the sensor holder 22 corresponds to the pushing switch 276 of the sensor mounting unit 26. At the sensing position, the sensor holder 22 protrudes out of the cleaner body 10.

The sensor position changer 24 includes a base 242, a motor 244 supported by the base 242, and a link unit 246 coupled to an axis of the motor 244.

The base 242 includes a pair of guide supporters 2422 provided apart from each other, a connector 2424 connecting the guide supporters 2422, and an axis supporter 2426 supporting the motor 244 to rotate.

The sensor movement guide 25 guides the main sensor 21 to stably ascend and descend. The sensor movement guide 25 includes a pair of guide columns 252 extending upwards from the guide supporters 2422. Meanwhile, the lower sensor holder 222 further includes a pair of guide pipes 254 extending downwards from a bottom of the lower sensor holder 222 to correspond to the pair of guide columns 252. The sensor movement guide 25 includes springs 256 fitting around the guide columns 252 to elastically float the sensor holder 22. Alternatively, the guide columns 252 may be provided on the bottom of the lower sensor holder 222 and the guide pipes 254 on the guide supporter 2422.

The sensor mounting unit 26 includes a sensor case 262 which is hollow inside and an auxiliary sensor mounting portion 264 in which the auxiliary sensor 27 is mounted. The sensor case 262 accommodates and supports the sensor holder 22 holding the main sensor 21 and the sensor position changer 24 coupled to the sensor holder 22. The stopper 248 shown in FIG. 14 associated with the sensor position changer 24 is provided in the sensor case 262. In the auxiliary sensor mounting portion 264, for example, there are a pair of auxiliary sensors 27 provided opposite to each other in an angle and the pushing switch 276 mounted between the pair of auxiliary sensors 27.

Figure 11:
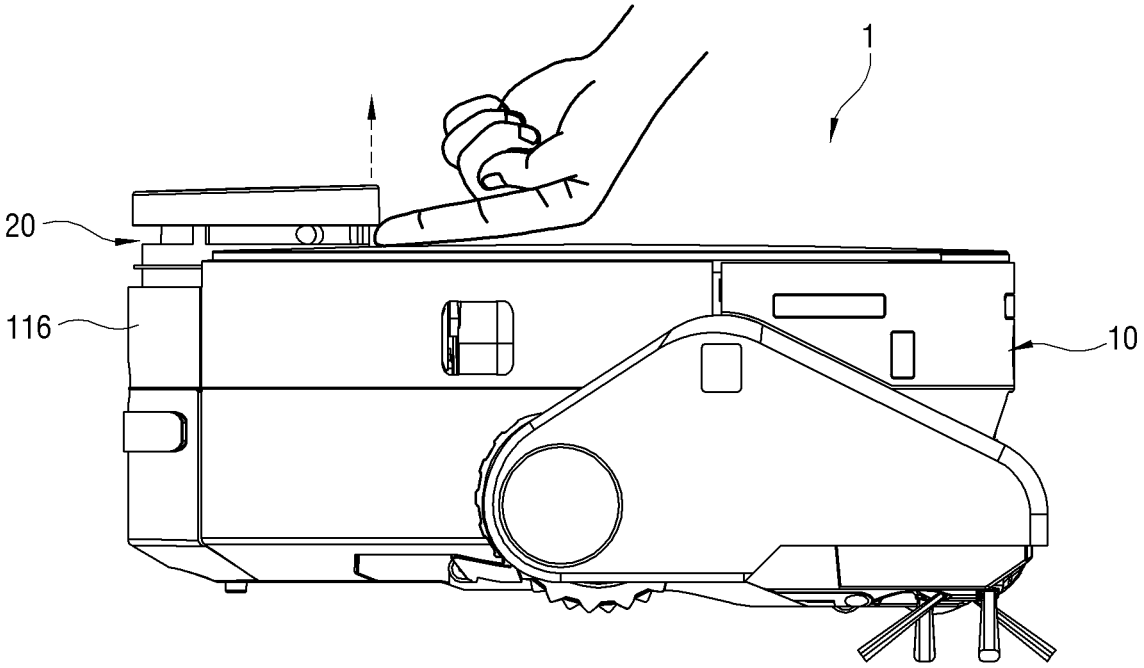
FIG. 11 illustrates the sensor holder protruding at the sensing position with a user's finger caught between the holder cap and the cleaner body.
Figure 12:
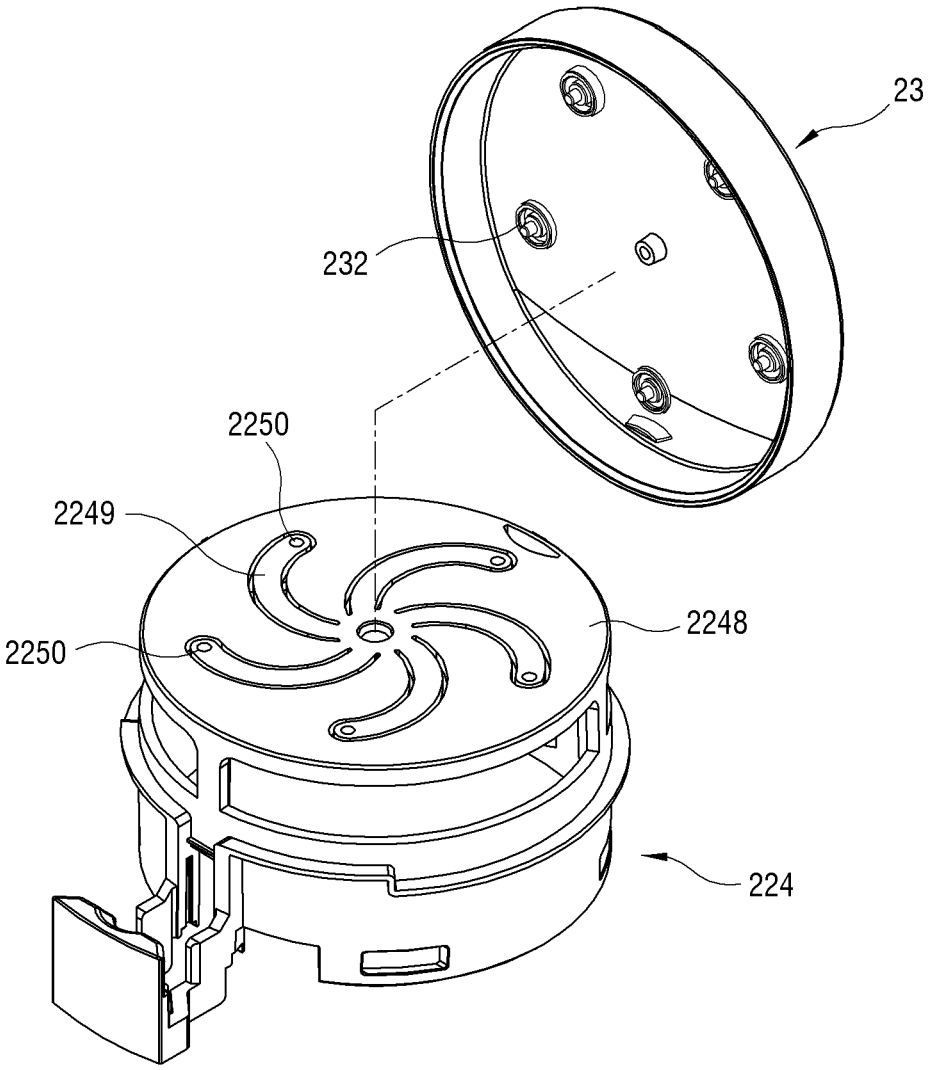
FIG. 12 illustrates a junction feature of the sensor holder and the holder cap.

FIG. 11 illustrates the sensor holder protruding at the sensing position with a user's finger caught between the holder cap and the cleaner body. FIG. 12 illustrates a junction feature of the sensor holder and the holder cap.

Referring to FIG. 11, the junction feature of the sensor holder 22 and the holder cap 23 helps minimize happening of a situation where a user's finger is caught between the holder cap 23 and the cleaner body 10 when the sensor holder 22 descends from the sensing position to the settled position.

Referring to FIG. 12, the cap supporter 2248 includes, for example, the five tension bars 2249 spirally extending from the center of the cap supporter 2248. The free ends 2250 of tension bars 2249 joined with the junction protrusion 232 of the holder cap 23 has elasticity to be raised upwards easily. Accordingly, if a user's finger is caught between the holder cap 23 and the cleaner body 10, it is possible for the finger to be easily taken out of the holder cap 23 as the free ends 2250 of tension bars 2249 is raised upwards from the cap supporter 2248.

FIG. 13 is a perspective view of the sensor position changer. Referring to FIG. 13, the sensor position changer 24 includes the motor 244 and the link unit 246 coupled to the axis of the motor 244. The motor 244 rotates clockwise or counterclockwise. The motor 244 includes a rotation axis 2442, and a rotating member 2444 provided on the rotation axis 2442 and supporting the link unit 246.

The link unit 246 includes a first link member 2462 and a second link member 2464 which are rotatably coupled with each other. The first link member 2462 includes a pair of first link bars 2462-1, 2462-2, one ends of which are fixed on a surface of the rotating member 2444 and extend radially. Accordingly, the first link member 2462 rotates together with rotation of the rotating member 2444. The other ends of the first link bars 2462-1, 2462-2 are provided with first hinge pins 2466 extending parallel with the rotation axis 2442.

The second link member 2464 includes a pair of second link bars 2464-1, 2464-2 which are apart from each other. The second link bars 2464-1, 2464-2 are coupled with a coupling bar 2465. The second link bars 2464-1, 2464-2 includes at each of one ends of the second link bars 2464-1, 2464-2 hinge pin coupling portions 2463 coupled with the first hinge pins 2466. The other ends of the second link bars 2464-1, 2464-2 are provided with the second hinge pins 2468.

That is, one end of the second link member 2464 is rotatably coupled with the first link member 2462 via the first hinge pins 2466, while the other end of the second link member 2464 are rotatably coupled with the hinge pin coupling portion 2225 of the sensor holder 22 shown in FIG. 9 via the second hinge pins 2468. The second link member 2464 rotates together with the first link member 2462. An angle between the first link member 2462 and the second link member 2464 becomes larger or smaller while the first link member 2462 and the second link member 2464 are rotating. That is, a distance between the rotation axis 2442 of the motor 244 and the other end of the second link member 2464 becomes larger or smaller according to the rotation of the first link member 2462 and the second link member 2464. Accordingly, the sensor holder 22 coupled with the second link member 2464 ascends or descends according to the rotation of the first link member 2462 and the second link member 2464.

Figure 14:
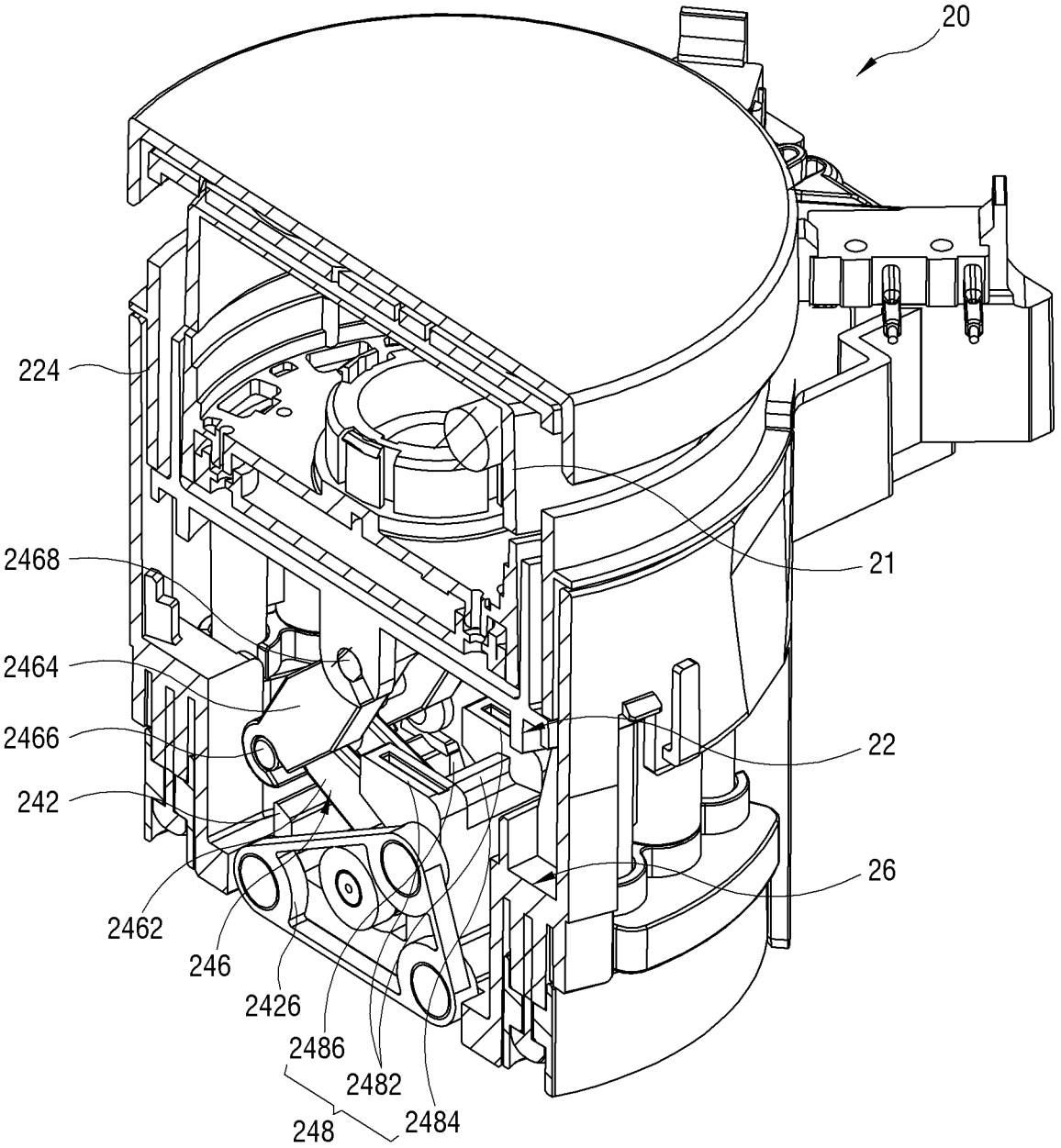
FIG. 14 illustrates the sensor holder which is at the settled position.
Figure 15:
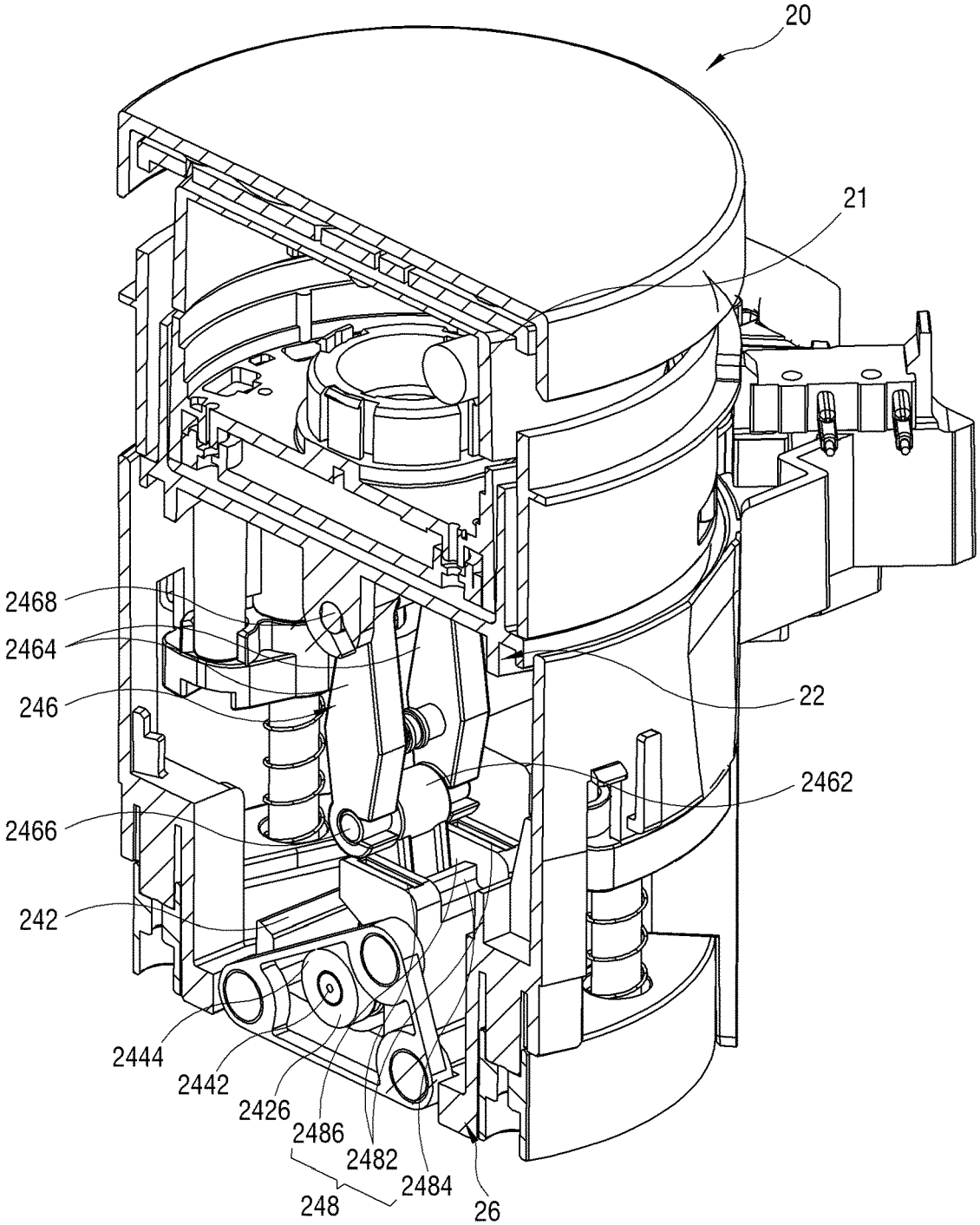
FIG. 15 illustrates the sensor holder which is at the sensing position.

FIG. 14 illustrates the sensor holder which is at the settled position. FIG. 15 illustrates the sensor holder which is at the sensing position. Referring to FIG. 15, the first link member 2462 and the second link member 2464 become erected by moving from the settled position to the sensing position according to the rotation of the motor 244 in a first direction. In contrast, referring to FIG. 14, the first link member 2462 and the second link member 2464 become folded by moving from the sensing position to the settled position according to the rotation of the motor 244 in a second direction opposite the first direction.

The stopper 248 restricts the sensor holder 22 holding the main sensor 21 at the sensing position from moving downwards to the settled position due to an external force caused by, for example, the obstacle. The stopper 248 includes a pair of link member supporters 2482 provided at an end of a rotation path of the link unit 246. The link member supporters 2482 support the second link member 2464 upwards on lower portions of the second link member 2464 which is erected at the sensing position. Edges of the link member supporters 2482 are apart slightly from the lower portions of the second link member 2464 which is in a state moving close to the sensing position so that the edges of the link member supporters 2482 may not interrupt the rotation of the second link member 2464 due to a contact between the edges of the link member supporters 2482 and the lower portion of the second link member 2464.

The link member supporters 2482 includes flat portions provided on tops of the link member supporters 2482 and extending perpendicularly to a direction in which the sensor holder 22 moves upwards or downwards. The one ends, that is, the lower portions of the second link member 2464 which is erected are positioned on the flat portions of the link member supporters 2482. Accordingly, the second link member 2464 is restricted from moving downwards as blocked by the flat portions of the link member supporters 2482. Therefore, even though an external force applies on the sensor holder 22 holding the main sensor 21 to be pushed, it is possible to restrict the sensor holder 22 from forcedly moving downwards. Meanwhile, the sensor holder 22 is allowed to move downwards according to the rotation of the link unit 246 in a normal operation.

The stopper 248 includes a link member receiver 2486 accommodating the first link member 2462 of the link unit 246 reaching the sensing position. The link member receiver 2486 has a space between the pair of the link member supporters 2482. The stopper 248 further includes a wall 2484 restricting the first link member 2462 from overly rotating at the sensing position. The stopper 248 may be integrated in a single body with the base 242 and/or the sensor mounting unit 26, or be separated from the base 242 and/or the sensor mounting unit 26 and then coupled to the base 242 and/or the sensor mounting unit 26.

Figure 16:
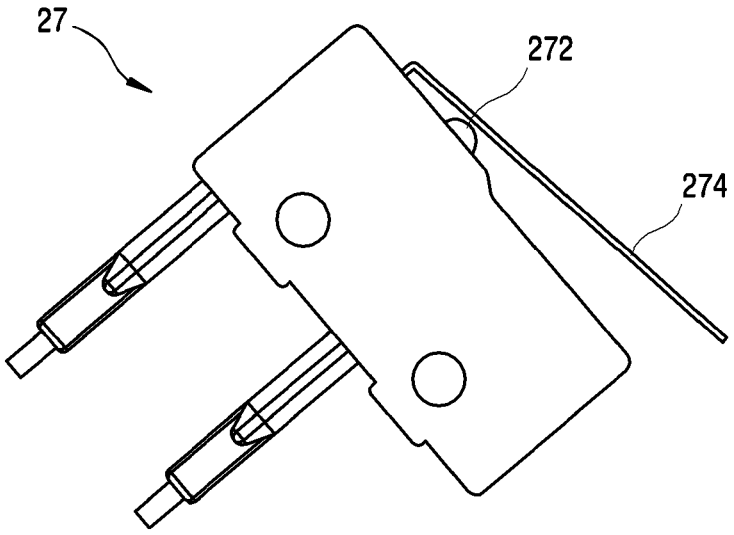
FIG. 16 illustrates the auxiliary sensor.
Figure 17:
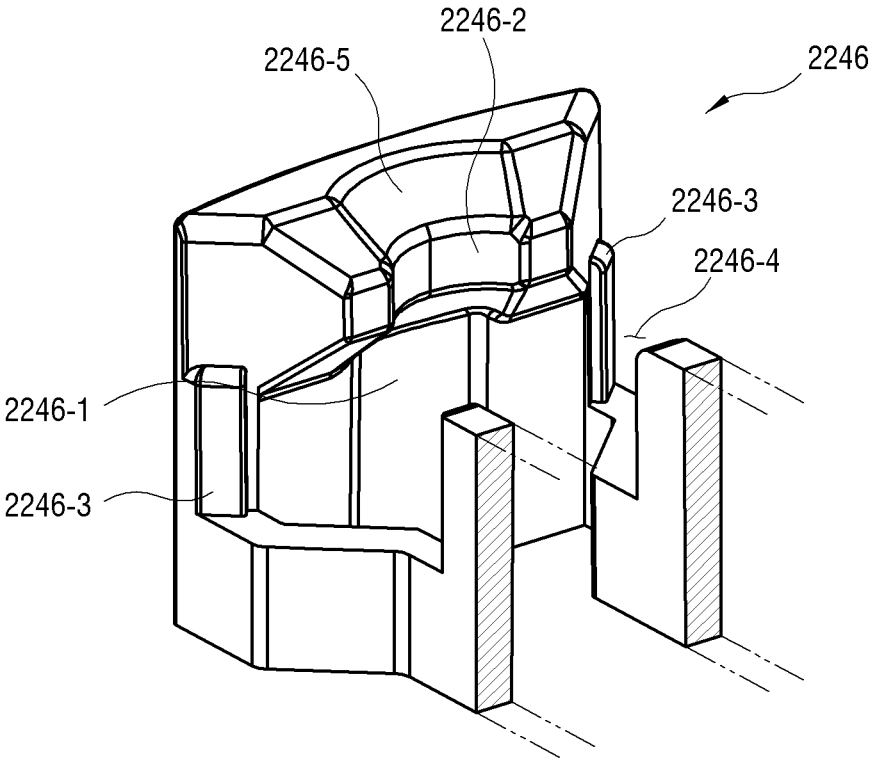
FIG. 17 illustrates a perspective view of the terminal pushing portion.
Figure 18:
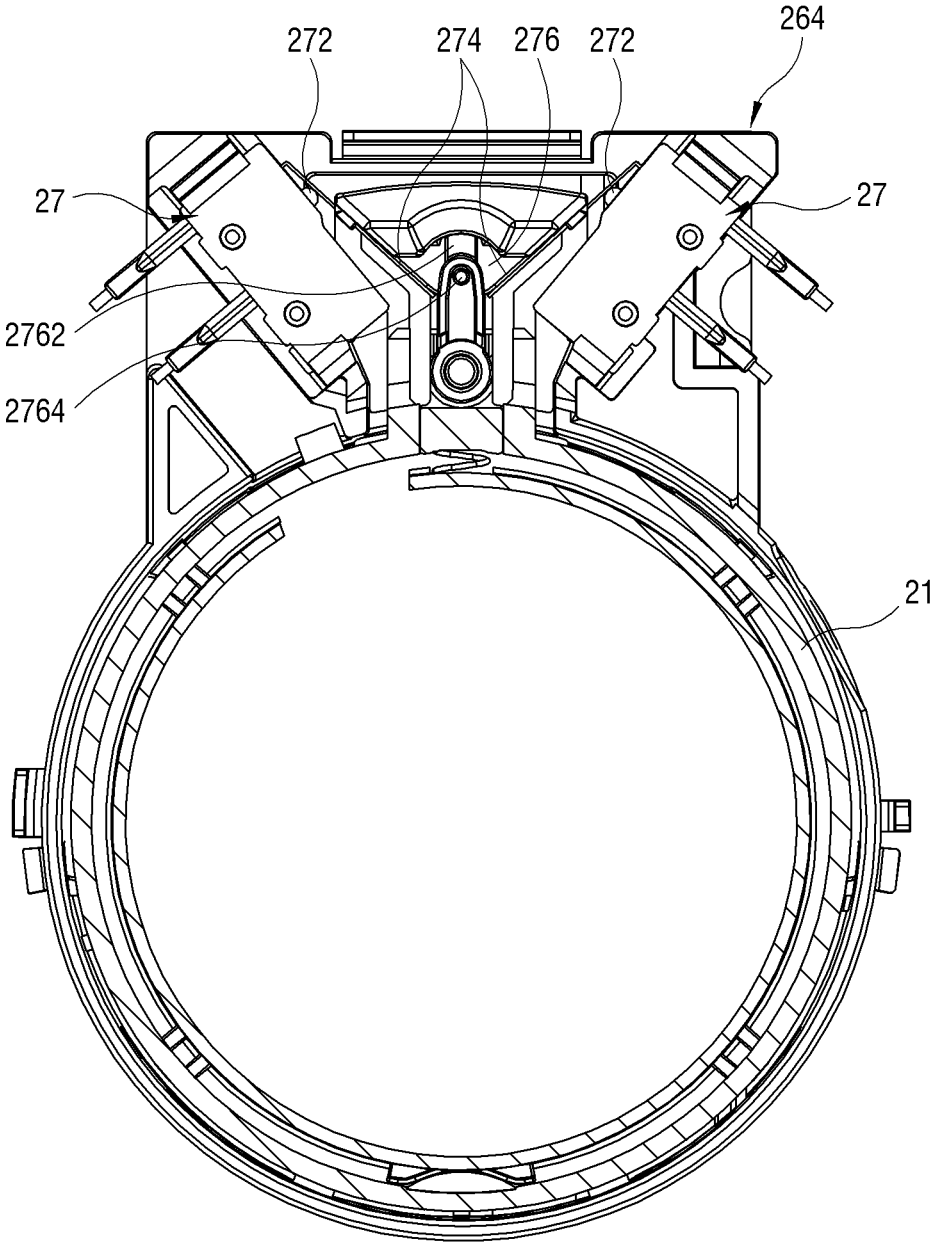
FIG. 18 is a plane view illustrating arrangement of the auxiliary sensors.
Figure 19:
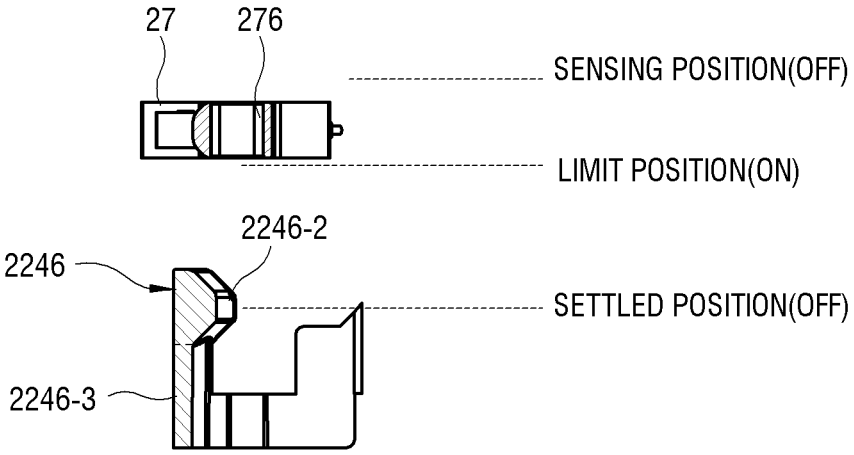
FIG. 19 is a sectional view illustrating the auxiliary sensor and the terminal pushing portion with the sensor holder being at the settled position.
Figure 20:
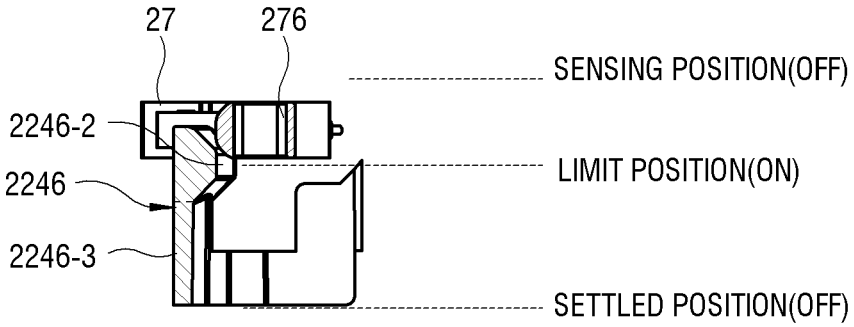
FIG. 20 is a sectional view illustrating the auxiliary sensor and the terminal pushing portion with the sensor holder being at the limit position.
Figure 21:
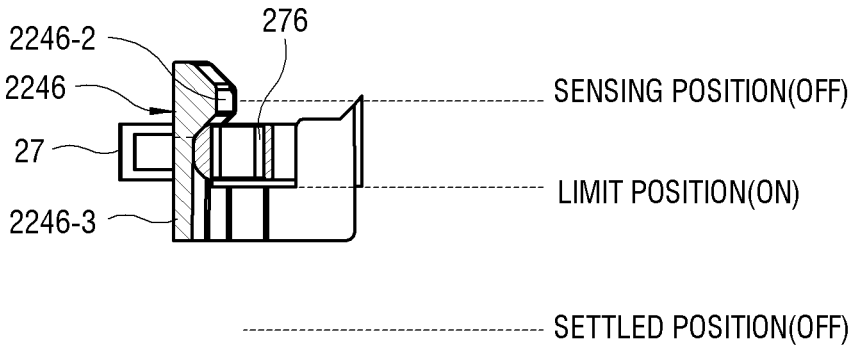
FIG. 21 is a sectional view illustrating the auxiliary sensor and the terminal pushing portion with the sensor holder being at the sensing position.
Figure 22:
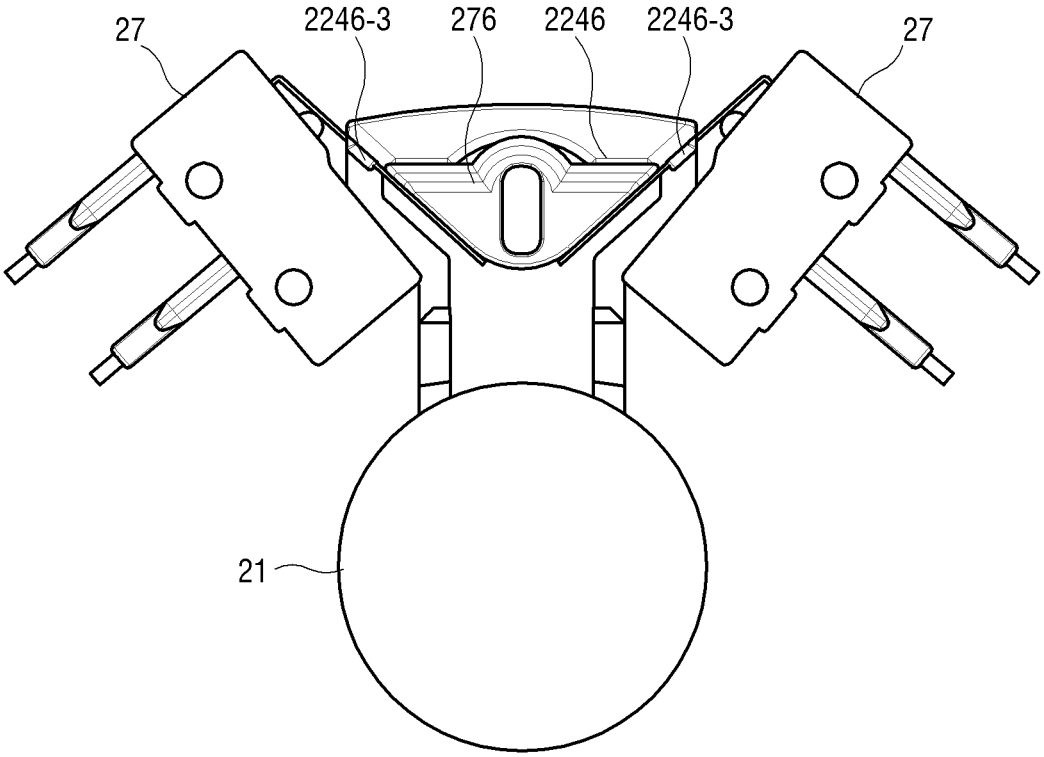
FIG. 22 is a plane view illustrating the auxiliary sensors and the terminal pushing portion with the sensor holder being at the sensing position in a normal operation.
Figure 23:
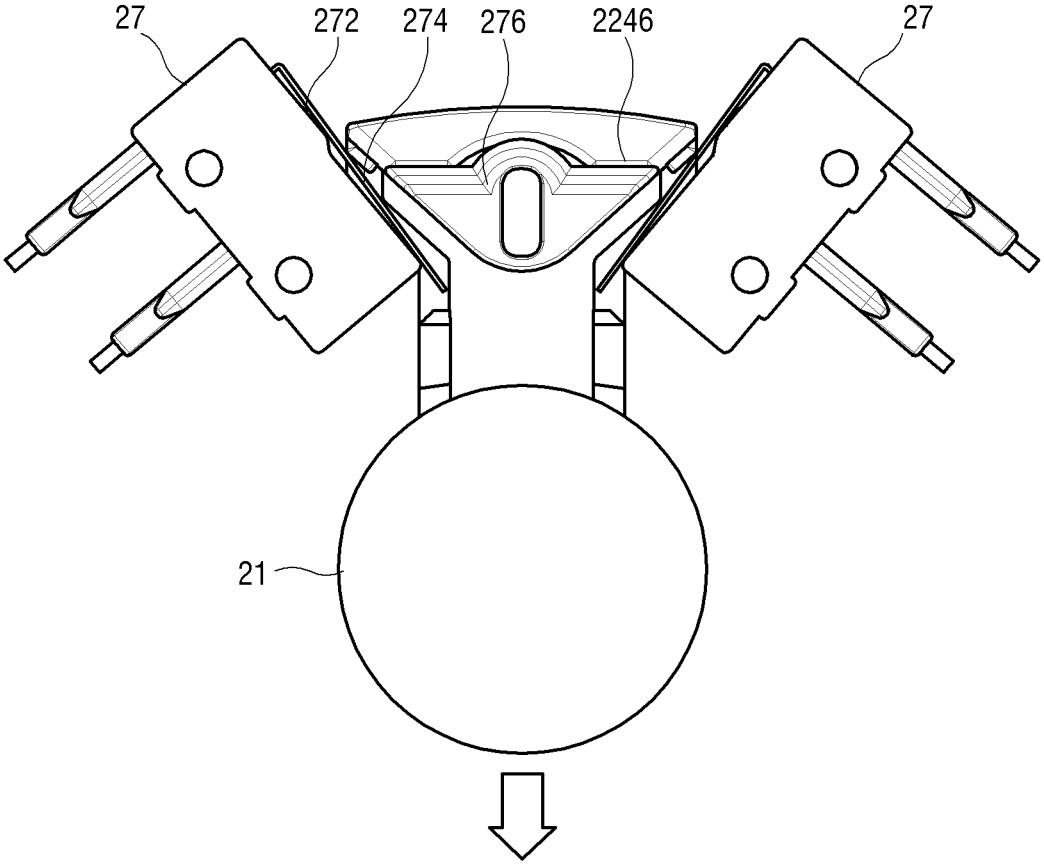
FIG. 23 is a plane view illustrating the auxiliary sensors and the terminal pushing portion with the sensor holder being at the sensing position in a situation bumping into an obstacle in a front direction.
Figure 24:
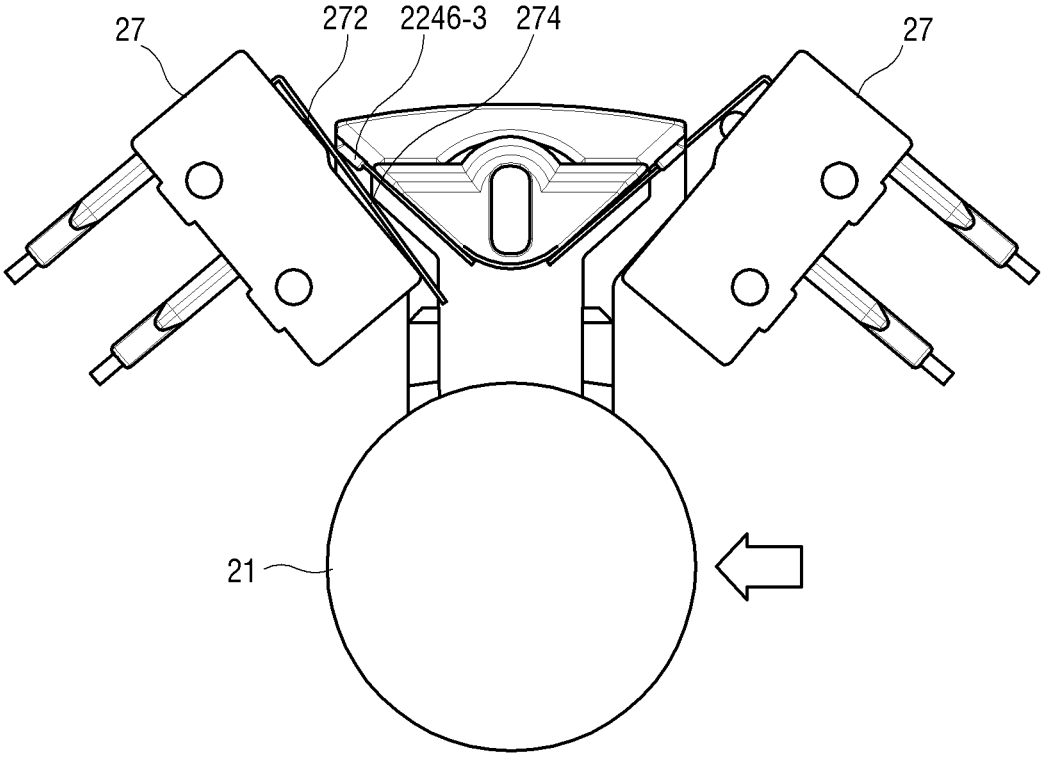
FIG. 24 is a plane view illustrating the auxiliary sensors and the terminal pushing portion with the sensor holder being at the sensing position in another situation bumping into an obstacle in a right direction.
Figure 25:
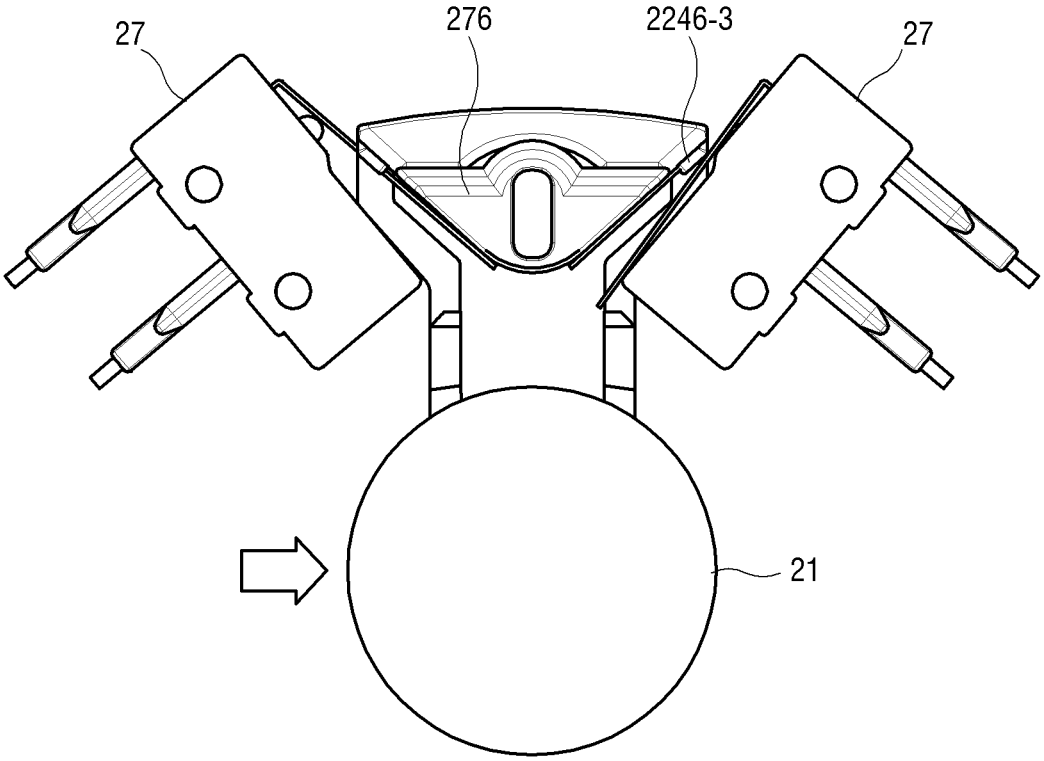
FIG. 25 is a plane view illustrating the auxiliary sensors and the terminal pushing portion with the sensor holder being at the sensing position in further another situation bumping into an obstacle in a left direction.

FIG. 16 illustrates the auxiliary sensor. FIG. 17 illustrates a perspective view of the terminal pushing portion. FIG. 18 is a plane view illustrating arrangement of the auxiliary sensors. FIG. 19 is a sectional view illustrating the auxiliary sensor and the terminal pushing portion with the sensor holder being at the settled position. FIG. 20 is a sectional view illustrating the auxiliary sensor and the terminal pushing portion with the sensor holder being at the limit position. FIG. 21 is a sectional view illustrating the auxiliary sensor and the terminal pushing portion with the sensor holder being at the sensing position. FIG. 22 is a plane view illustrating the auxiliary sensors and the terminal pushing portion with the sensor holder being at the sensing position in a normal operation. FIG. 23 is a plane view illustrating the auxiliary sensors and the terminal pushing portion with the sensor holder being at the sensing position in a situation bumping into an obstacle in a front direction. FIG. 24 is a plane view illustrating the auxiliary sensors and the terminal pushing portion with the sensor holder being at the sensing position in another situation bumping into an obstacle in a right direction. FIG. 25 is a plane view illustrating the auxiliary sensors and the terminal pushing portion with the sensor holder being at the sensing position in further another situation bumping into an obstacle in a left direction.

Referring to FIG. 16, the auxiliary sensor 27 has, for example, a hexahedral shape and includes on a side of the auxiliary sensor 27 a first terminal 272 and a second terminal 274. The first terminal 272 protrudes, for example, in a hemisphere shape from a surface of the auxiliary sensor 27. The second terminal 274 has, for example, a plate shape with elasticity and is provided over the first terminal 272 in a state of not contacting the first terminal 272. The auxiliary sensor 27 becomes in an on-state as the second terminal 274 is pressed by an external force to contact the first terminal 272, while the auxiliary sensor 27 becomes in an off-state as the second terminal 274 is released by the external force to be away from the first terminal 272.

Referring to FIG. 17, the terminal pushing portion 2246 includes an extension portion 2246-1 extending from a side of the sensor upper portion receiver 2242 shown in FIG. 8 and extending upwards, a front pusher 2246-2 protruding from an inner surface of the extension portion 2246-1 towards the side of the sensor upper portion receiver 2242, and a pair of side pushers 2246-3 protruding from both sides of the extension portion 2246-1. The terminal pushing portion 2246 further includes a pushing switch accommodating portion 2246-4 for accommodating the pushing switch 276 shown in FIG. 18 between the extension portion 2246-1 and the side of the sensor upper portion receiver 2242.

The front pusher 2246-2 includes a pushing switch guide 2246-5 provided on a protruding side of the front pusher 2246-2 and having an inwardly curved shape which corresponds to a side of the pushing switch 276 facing the front pusher 2246-2. The pushing switch guide 2246-5 guides the pushing switch 276 to allow the front pusher 2246-2 to push the pushing switch 276 when the terminal pushing portion 2246 reaches the limit position.

The front pusher 2246-2 pushes the second terminal 274 of the auxiliary sensor 27 by pushing the pushing switch 276 when the terminal pushing portion 2246 of the sensor holder 22 is moved upwards or downwards by the sensor position changer 24. Also, the front pusher 2246-2 pushes the second terminal 274 of the auxiliary sensor 27 by pushing the pushing switch 276 when the terminal pushing portion 2246 at the sensing position is horizontally moved by bumping into the obstacle.

The side pusher 2246-3 turns the auxiliary sensor 27 on by pushing the second terminal 274 when the terminal pushing portion 2246 at the sensing position is moved, for example, in a left or right direction by bumping into the obstacle.

Referring to FIG. 18, the pushing switch 276 is provided between the pair of the auxiliary sensors 27 opposite to each other in an angle in the auxiliary sensor mounting portion 264. The second terminal 274 is provided between the pushing switch 276 and a body of the auxiliary sensor 27.

The pushing switch 276 has a triangular shape of which two sides face the second terminals 274 of the pair of the auxiliary sensors 27, respectively. The pushing switch 276 has a lengthwise hole 2762. A pin 2764 is provided within the lengthwise hole 2762 to be movable in a lengthwise direction. An end of the pin 2764 is fixed to the auxiliary sensor mounting portion 264. The pushing switch 276 is allowed to move in the lengthwise direction within a range of the lengthwise hole 2762 as the pin 2764 is movable within the lengthwise hole 2762 while the terminal pushing portion 2246 moves upwards or downwards pushing the pushing switch 276 in the lengthwise direction.

Referring to FIG. 19, when the terminal pushing portion 2246 of the sensor holder 22 is at the settled position, the terminal pushing portion 2246 is apart from the pushing switch 276 at a different height, and the front pusher 2246-2 does not push the pushing switch 276 in the lengthwise direction of the lengthwise hole 2762. Accordingly, the pair of the auxiliary sensors 27 are all off because the second terminals 274 do not contact the first terminals 272.

Referring to FIG. 20, when the terminal pushing portion 2246 of the sensor holder 22 is at the limit position by moving upwards, the terminal pushing portion 2246 contacts the pushing switch 276 at a similar height, and the front pusher 2246-2 pushes the pushing switch 276 in the lengthwise direction of the lengthwise hole 2762. Accordingly, the pair of the auxiliary sensors 27 are all on because the second terminals 274 contact the first terminals 272.

Referring to FIG. 21, when the terminal pushing portion 2246 of the sensor holder 22 is at the sensing position by moving upwards farther from the limit position, the terminal pushing portion 2246 is apart from the pushing switch 276 at another different height. That is, the pushing switch 276 is away from the front pusher 2246-2 and restores to an initial position shown in FIG. 19. In this state, the front pusher 2246-2 does not push the pushing switch 276 in the lengthwise direction of the lengthwise hole 2762. Accordingly, the pair of the auxiliary sensors 27 are all off because the second terminals 274 do not contact the first terminals 272.

Referring to FIG. 22, when the terminal pushing portion 2246 of the sensor holder 22 is at the sensing position in a normal operation, the front pusher 2246-2 does not only push the pushing switch 276 but also the side pushers 2246-3 provided on both sides do not push the second terminals 274 of the auxiliary sensors 27. Accordingly, the main sensor 21 identifies that the sensor unit 20 does not bump into the obstacle because all of the second terminals 274 do not contact the first terminals 272 with the auxiliary sensors 27 being in an off-state.

Referring to FIG. 23, when the terminal pushing portion 2246 of the sensor holder 22 is at the sensing position with the sensor unit 20 happening to bump into the obstacle in a front direction, the terminal pushing portion 2246 moves backwards and pushes the pushing switch 276. Accordingly, the main sensor 21 identifies that there is the obstacle in the front direction because all of the second terminals 274 contact the first terminals 272 with the auxiliary sensors 27 being in an on-state.

Referring to FIG. 24, when the terminal pushing portion 2246 of the sensor holder 22 is at the sensing position with the sensor unit 20 bumping into the obstacle in a right direction, the terminal pushing portion 2246 moves to the left and one of the side pushers 2246-3 pushes the second terminal 274 of the auxiliary sensor 27 provided on the left. Accordingly, the main sensor 21 identifies that there is the obstacle in the right direction because the second terminal 274 provided on the left contact the first terminal 272 with the auxiliary sensor 27 being in the on-state.

On the other hand, referring to FIG. 24, when the terminal pushing portion 2246 of the sensor holder 22 is at the sensing position with the sensor unit 20 bumping into the obstacle in a left direction, the terminal pushing portion 2246 moves to the right and the other of the side pushers 2246-3 pushes the second terminal 274 of the auxiliary sensor 27 provided on the right. Accordingly, the main sensor 21 identifies that there is the obstacle in the left direction because the second terminal 274 provided on the right contact the first terminal 272 with the auxiliary sensor 27 being in the on-state.

Figure 26:
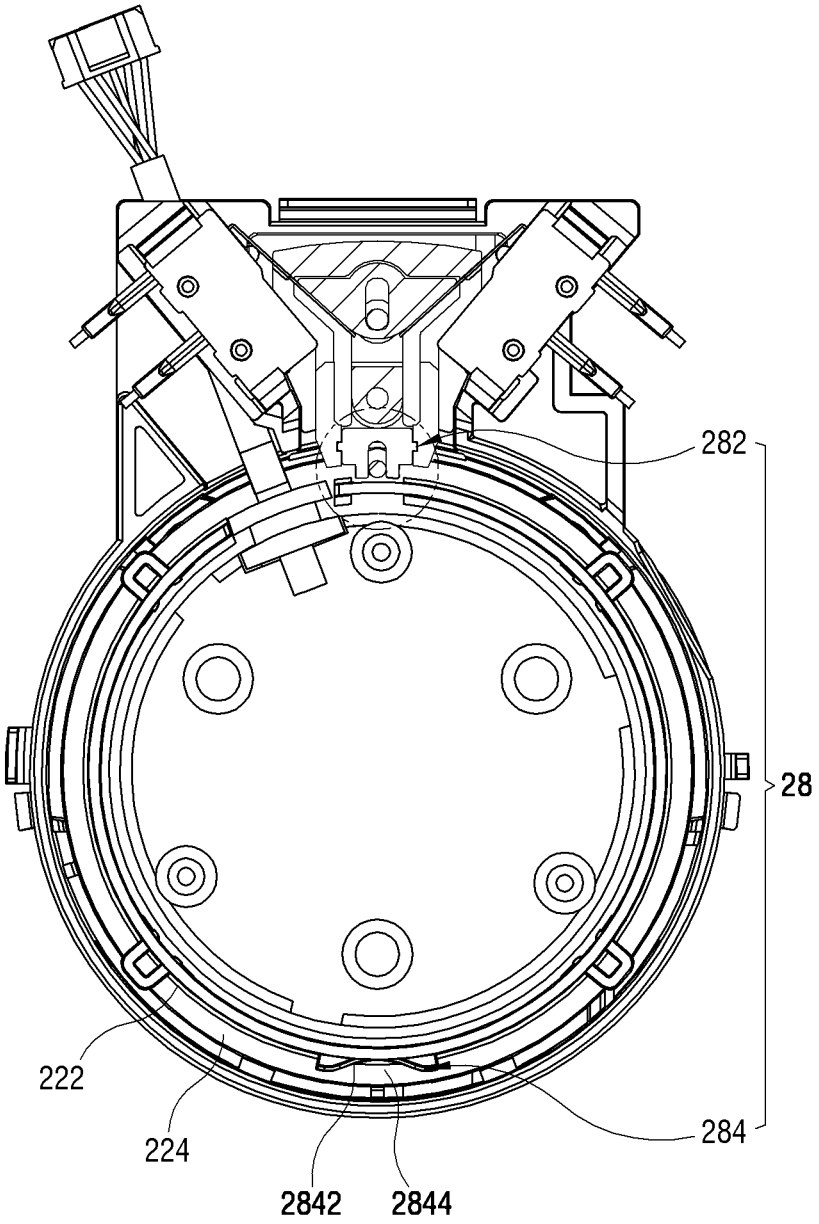
FIG. 26 illustrates a position restoration guide provided in the sensor unit.
Figure 27:
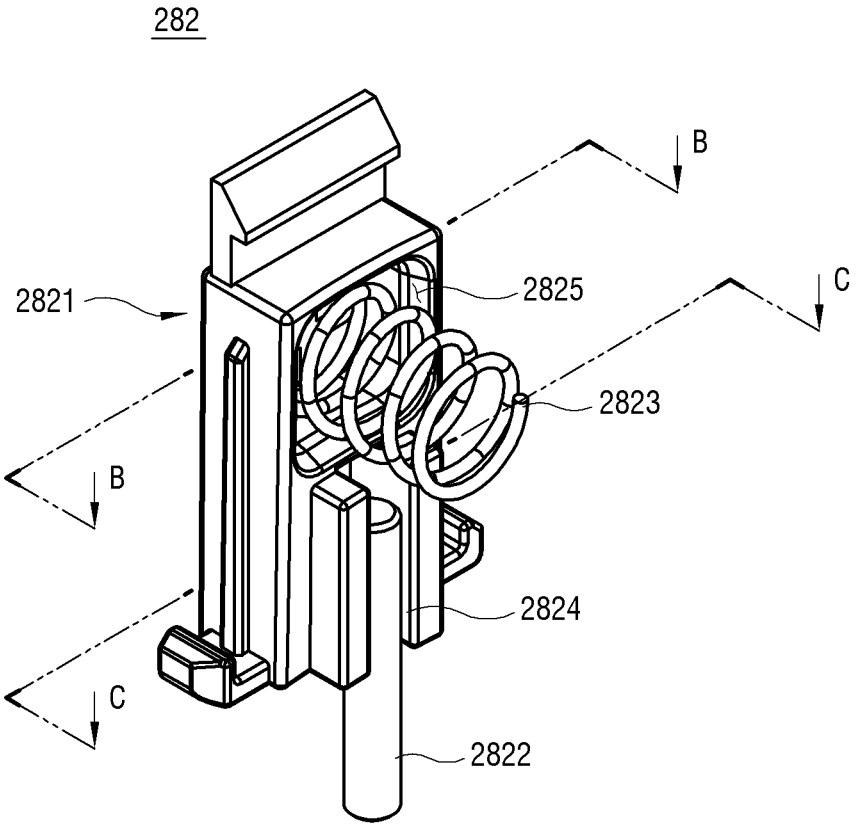
FIG. 27 is a perspective view of a first guide.
Figure 28:
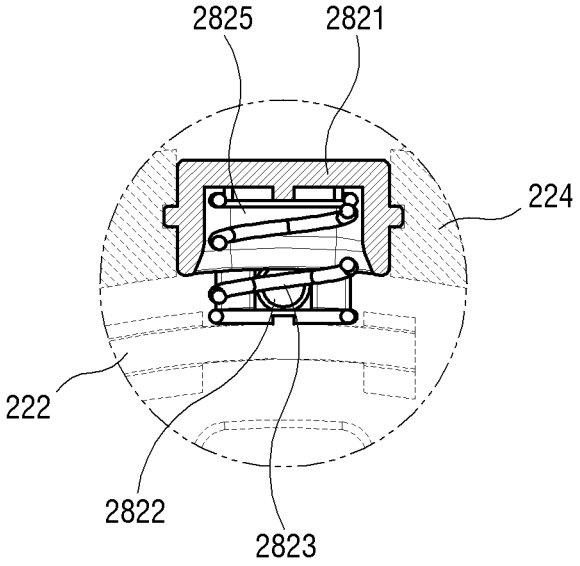
FIG. 28 is a sectional view of the first guide according to a B-B line shown in FIG. 27.
Figure 29:
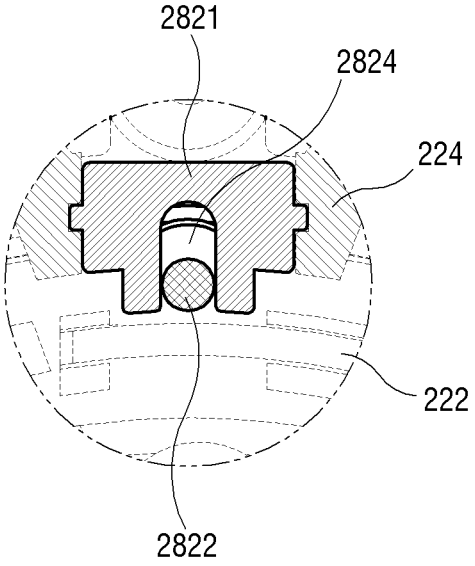
FIG. 29 is a sectional view of the first guide 282 according to a C-C line shown in FIG. 27.
Figure 30:
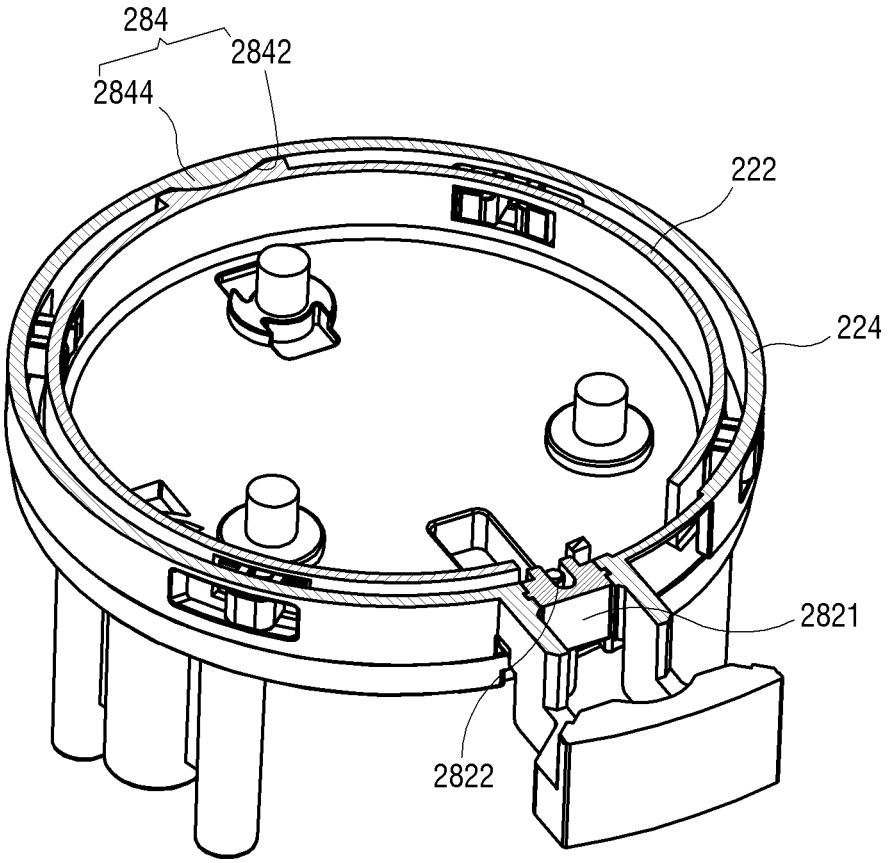
FIG. 30 is a perspectively sectional view of the upper sensor holder and the lower sensor holder illustrating the first guide and a second guide.

FIG. 26 illustrates a position restoration guide provided in the sensor unit. FIG. 27 is a perspective view of a first guide. FIG. 28 is a sectional view of the first guide according to a B-B line shown in FIG. 27. FIG. 29 is a sectional view of the first guide 282 according to a C-C line shown in FIG. 27. FIG. 30 is a perspectively sectional view of the upper sensor holder and the lower sensor holder illustrating the first guide and a second guide.

The position restoration guide 28 allows the upper sensor holder 224 to move in every direction against bumping into the obstacle and to restore to an initial position. Referring to FIG. 26, the position restoration guide 28 includes the first guide 282 and the second guide 284. The first guide 282 is provided between the lower sensor holder 222 and the upper sensor holder 224. The second guide 284 is provided opposite the first guide 282 between the lower sensor holder 222 and the upper sensor holder 224.

Referring to FIG. 27, the first guide 282 includes a guide groove 2824 extending perpendicularly to a direction in which the robot cleaner 1 moves, a guide member 2821 having a spring receiver 2825, a guide pin 2822 inserted in the guide groove 2824, and a spring 2823 accommodated in the spring receiver 2825.

Referring to FIG. 28, the spring 2823 maintains a gap between the lower sensor holder 222 and the upper sensor holder 224. The spring receiver 2825 is provided at a position of the guide member 2821 above the guide groove 2824. Referring to FIG. 29, the guide groove 2824 has a width corresponding to a thickness of the guide pin 2822 and a depth within which the guide pin 2822 is movable. That is, the guide pin 2822 guides the upper sensor holder 224 to move along a depth direction of the guide groove 2824 or pivot with an axis of the guide pin 2822.

Referring to FIG. 30, the second guide 284 includes a convex portion 2842 provided on an outer surface of the lower sensor holder 222 and a concave portion 2844 provided on an inner surface of the upper sensor holder 224 having a shape that corresponds to the convex portion 2842. The convex portion 2842 and the concave portion 2844 are engaged with each other. When the upper sensor holder 224 moves or pivots as the sensor unit 20 bumps into the obstacle, the upper sensor holder 224 is able to easily restore to the initial position due to elasticity of the spring 2823 and engagement between the convex portion 2842 and the concave portion 2844.

Figure 31:
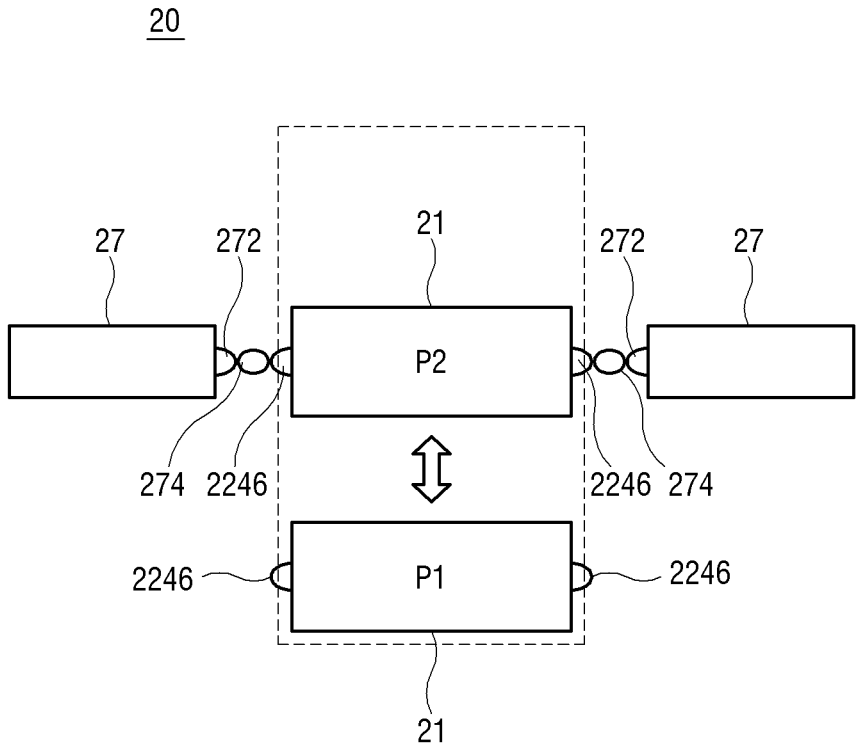
FIG. 31 is a diagram illustrating an operation of the auxiliary sensors with the main sensor ascending or descending to the limit position.
Figure 32:
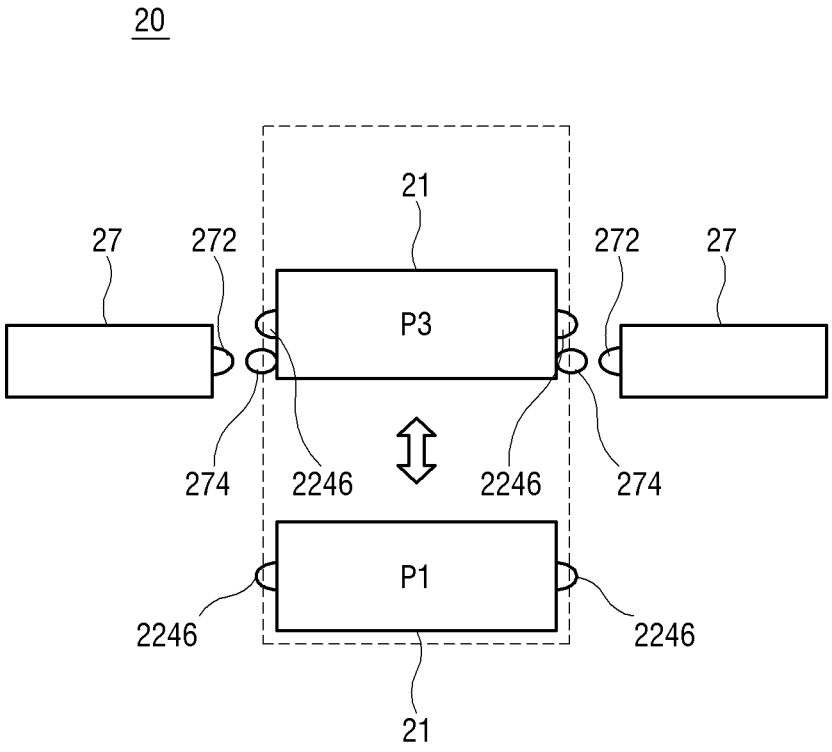
FIG. 32 is a diagram illustrating an operation of the auxiliary sensors with the main sensor ascending from the limit position to the sensing position.
Figure 33:
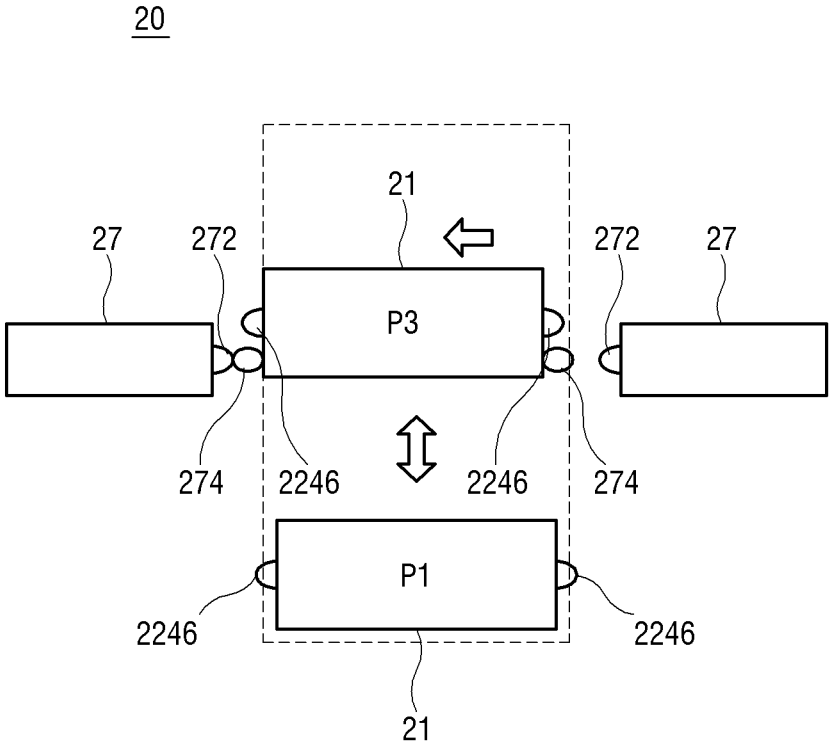
FIG. 33 is a diagram illustrating an operation of the auxiliary sensors with the main sensor at the sensing position moving horizontally.

FIG. 31 is a diagram illustrating an operation of the auxiliary sensors with the main sensor ascending or descending to the limit position. FIG. 32 is a diagram illustrating an operation of the auxiliary sensors with the main sensor ascending from the limit position to the sensing position. FIG. 33 is a diagram illustrating an operation of the auxiliary sensors with the main sensor at the sensing position moving horizontally.

The auxiliary sensors 27 become in the on-state or the off-state according to whether the first terminals 272 and the second terminals 274 contact with each other. Referring to FIGS. 31 and 32, the main sensor 21 ascends from the settled position P1 to the limit position P2 or descends from the sensing position P3 to the limit position P2. Accordingly, the terminal pushing portion 2246 pushes the second terminals 274 towards the first terminals 272, and the auxiliary sensors 27 become in the on-state because the first terminals 272 and the second terminals 274 contact with each other. In this state, the auxiliary sensors 27 identify whether the main sensor 21 reaches the sensing position P3 or is away from the sensing position P3.

Referring to FIG. 32, the main sensor 21 ascends from the limit position P2 farther to the sensing position P3. Accordingly, the second terminals 274 restore to the initial position, the auxiliary sensors 27 become in the off-state because the first terminals 272 and the second terminals 274 are apart from each other. In this state, the auxiliary sensors 27 are in a standby state to sense whether the sensor unit 20 bumps into the obstacle.

Referring to FIG. 33, the main sensor 21 at the sensing position P3 moves horizontally with the sensor unit 20 bumping into the obstacle. Accordingly, one of the auxiliary sensors 27 becomes in the on-state because one of the first terminals 272 and one of the second terminals 274 contact with each other. In this state, the auxiliary sensor 27 in the on-state shown on the left in FIG. 33 senses that the sensor unit 20 bumps into the obstacle and identifies that the obstacle exists at a position on the right in FIG. 33. In a similar manner, if the auxiliary sensor 27 on the right in FIG. 33 would be in the on-state, the auxiliary sensor 27 might identify that the obstacle exists at a position on the left in FIG. 33.

When the main sensor 21 is at the settled position P1, the two auxiliary sensors 27 are all in the off-state. When the main sensor 21 is at the limit position P2, the two auxiliary sensors 27 are all in the on-state. When the main sensor 21 is at the sensing position P3 without bumping into the obstacle, the two auxiliary sensors 27 are all in the off-state. On the other hand, when the main sensor 21 is at the sensing position P3 bumping into the obstacle, the main sensor 21 moves horizontally and one of the two auxiliary sensors 27 is in the on-state, of which the situation is applied to the operation of the robot cleaner 1.

Meanwhile, referring back to FIGS. 31 and 32, when the main sensor 21 is at the sensing position P3, the main sensor 21 may be moved from the sensing position P3 to the limit position P2 without the controller 40 controlling the sensor position changer 24. For example, when the sensor unit 20 at the sensing position P3 bumps into the obstacle, the main sensor 21 may be forcedly moved downwards to the limit position P2 by an external force caused by the obstacle. In this state, the auxiliary sensors 27 turns from the off-state into the on-state. Then, the controller 40 may control the sensor position changer 24 to move the sensor holder 22 upwards so that the main sensor 21 is restored to the sensing position P3. Optionally, the controller 40 may also perform an alert operation, for example, notifying a user of bumping into the obstacle.

Figure 34:
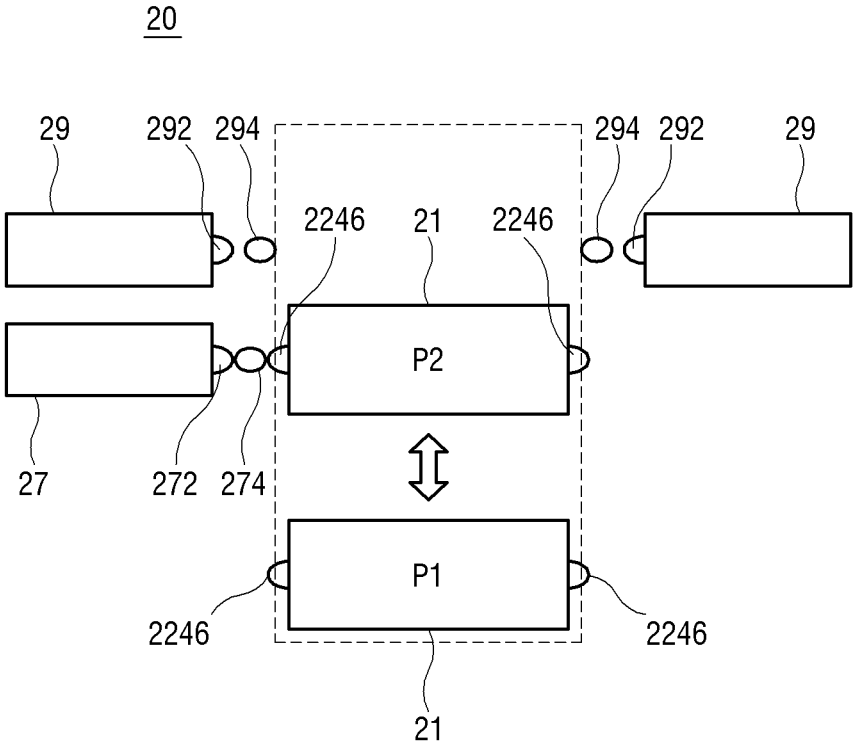
FIG. 34 is a diagram illustrating another example of operations of a first auxiliary sensor and second auxiliary sensors with the main sensor ascending or descending to the limit position.
Figure 35:
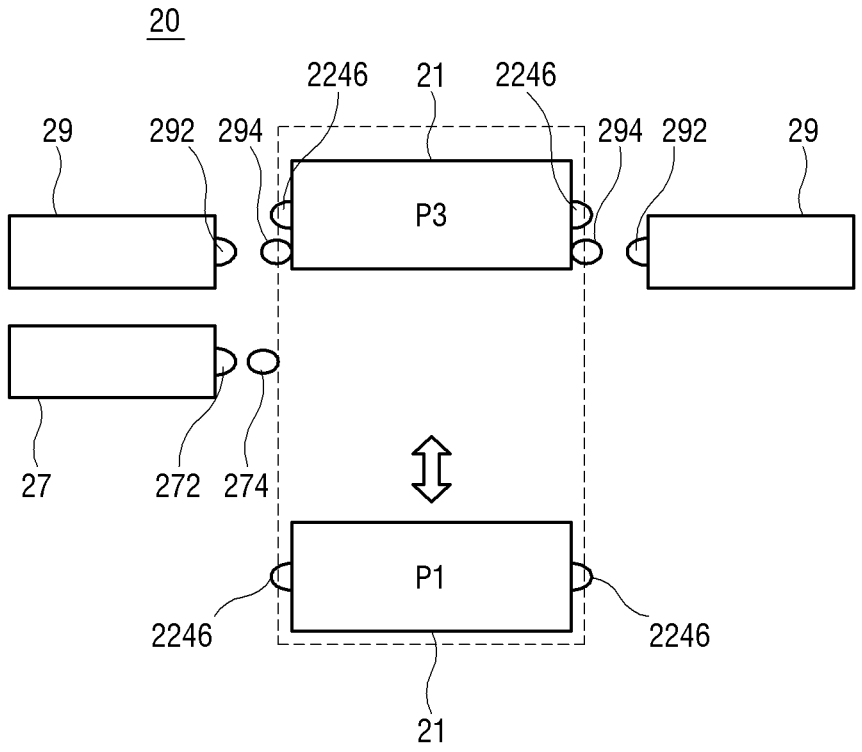
FIG. 35 is a diagram illustrating another example of operations of the first auxiliary sensor and the second auxiliary sensors with the main sensor ascending from the limit position to the sensing position.
Figure 36:
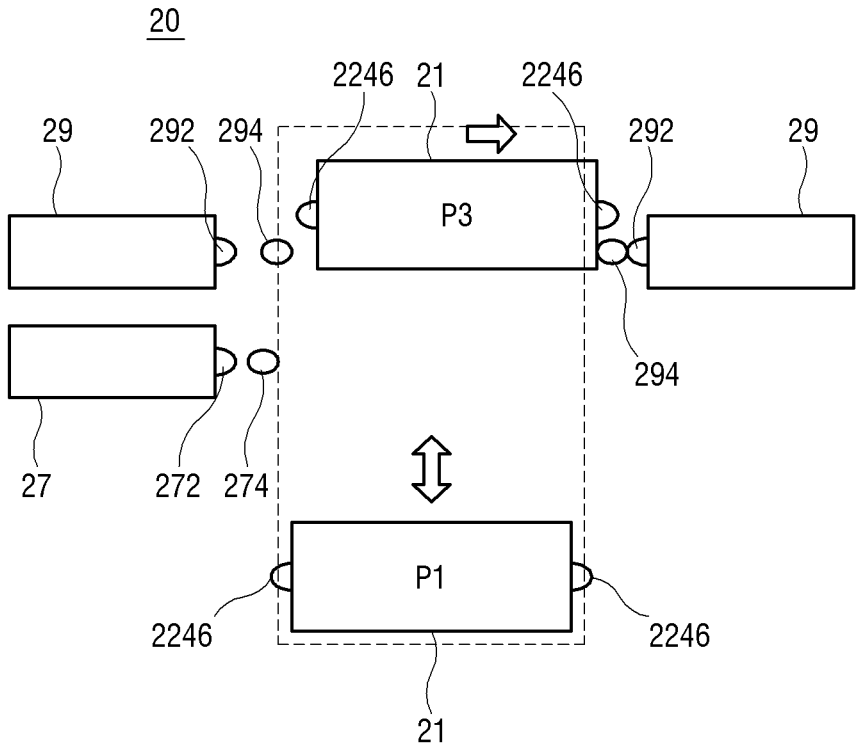
FIG. 36 is a diagram illustrating another example of operations of the first auxiliary sensor and the second auxiliary sensors with the main sensor at the sensing position moving horizontally.

FIG. 34 is a diagram illustrating another example of operations of a first auxiliary sensor and second auxiliary sensors with the main sensor ascending or descending to the limit position. FIG. 35 is a diagram illustrating another example of operations of the first auxiliary sensor and the second auxiliary sensors with the main sensor ascending from the limit position to the sensing position. FIG. 36 is a diagram illustrating another example of operations of the first auxiliary sensor and the second auxiliary sensors with the main sensor at the sensing position moving horizontally.

The sensor unit 20 of this embodiment includes a single first auxiliary sensor 27 and a pair of second auxiliary sensors 29. The first auxiliary sensor 27 and the second auxiliary sensors 29 are provided at different height from each other. The first auxiliary sensor 27 is provided below the second auxiliary sensors 29. The first auxiliary sensor 27 becomes in the on-state or the off-state according to whether the first terminal 272 and the second terminal 274 contact with each other. The second auxiliary sensors 29 become in the on-state or the off-state according to whether third terminals 292 and fourth terminals 294 contact with each other.

Referring to FIGS. 34 and 35, the main sensor 21 ascends from the settled position P1 to the limit position P2 or descends from the sensing position P3 to the limit position P2. Accordingly, the first auxiliary sensor 27 becomes in the on-state because the first terminal 272 and the second terminal 274 contact with each other. In this state, the first auxiliary sensor 27 identifies whether the main sensor 21 reaches the sensing position P3 or is away from the sensing position P3.

Referring to FIG. 35, the main sensor 21 ascends from the limit position P2 farther to the sensing position P3. Accordingly, the first auxiliary sensor 27 becomes in the off-state because the first terminal 272 and the second terminal 274 are apart from each other. In this state, the third terminals 292 and the fourth terminals 294 are apart from each other and the second auxiliary sensors 29 are in the standby state to sense whether the sensor unit 20 bumps into the obstacle.

Referring to FIG. 36, the main sensor 21 at the sensing position P3 moves horizontally with the sensor unit 20 bumping into the obstacle. Accordingly, one of the second auxiliary sensors 29 becomes in the on-state because one of the third terminals 292 and one of the fourth terminals 294 contact with each other. In this state, the second auxiliary sensor 27 in the on-state shown on the right in FIG. 36 senses that the sensor unit 20 bumps into the obstacle and identifies that the obstacle exists at a position on the left in FIG. 36.

When the main sensor 21 is at the settled position P1, the first auxiliary sensor 27 and the two second auxiliary sensors 29 are all in the off-state. When the main sensor 21 is at the limit position P2, the first auxiliary sensor 27 is in the on-state and the two second auxiliary sensors 29 are in the off-state. When the main sensor 21 is at the sensing position P3 without bumping into the obstacle, the first auxiliary sensor 27 and the two second auxiliary sensors 29 are all in the off-state. On the other hand, when the main sensor 21 is at the sensing position P3 bumping into the obstacle, the main sensor 21 moves horizontally and one of the two second auxiliary sensors 29 is in the on-state, of which the situation is applied to the operation of the robot cleaner 1.

Meanwhile, similarly to the embodiment illustrated in FIGS. 31 through 33, when the sensor unit 20 at the sensing position P3 bumps into the obstacle without the controller 40 controlling the sensor position changer 24, the main sensor 21 may be forcedly moved downwards to the limit position P2. In this state, the first auxiliary sensor 27 turns from the off-state into the on-state. Then, the controller 40 may control the sensor position changer 24 to move the sensor holder 22 upwards so that the main sensor 21 is restored to the sensing position P3. Alternatively, before the first auxiliary sensor 27 turns into the on-state, the two second auxiliary sensors 29 may turn all from the off-state into the on-state without the controller 40 controlling the sensor position changer 24. In this state, the controller 40 may first perform an alert operation, for example, notifying a user of bumping into the obstacle. And then, if the first auxiliary sensor 27 turns into the on-state, the controller 40 may control the sensor position changer 24 to move the sensor holder 22 upwards.

Figure 37:
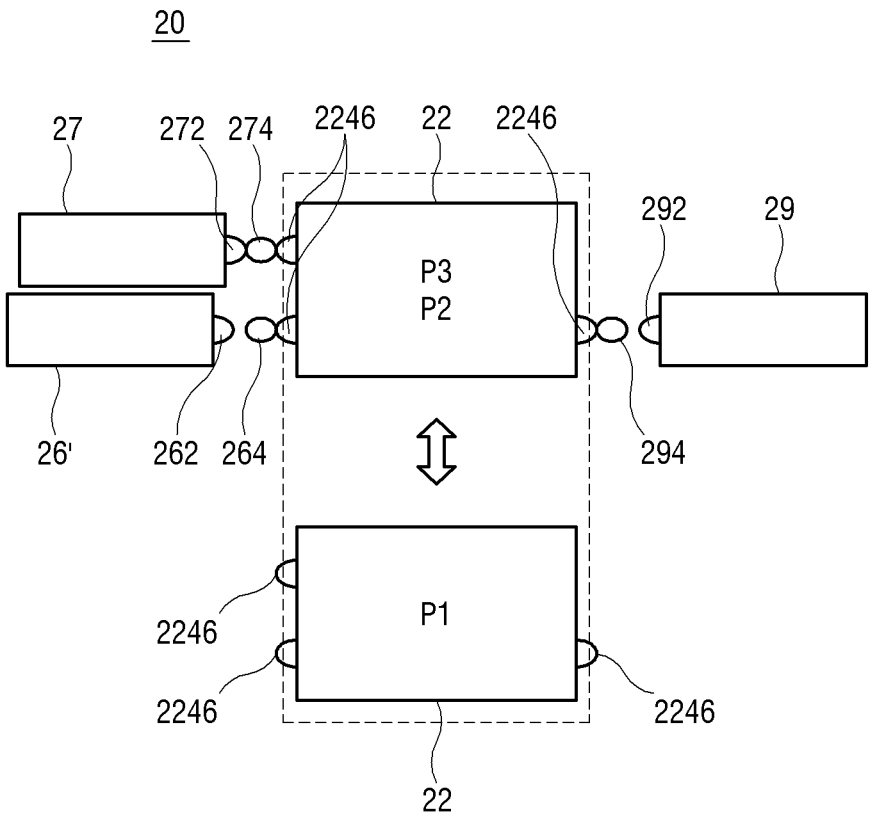
FIG. 37 is a diagram illustrating further another example of operations of a first auxiliary sensor and second auxiliary sensors with the main sensor ascending to the limit position and the sensing position.
Figure 38:
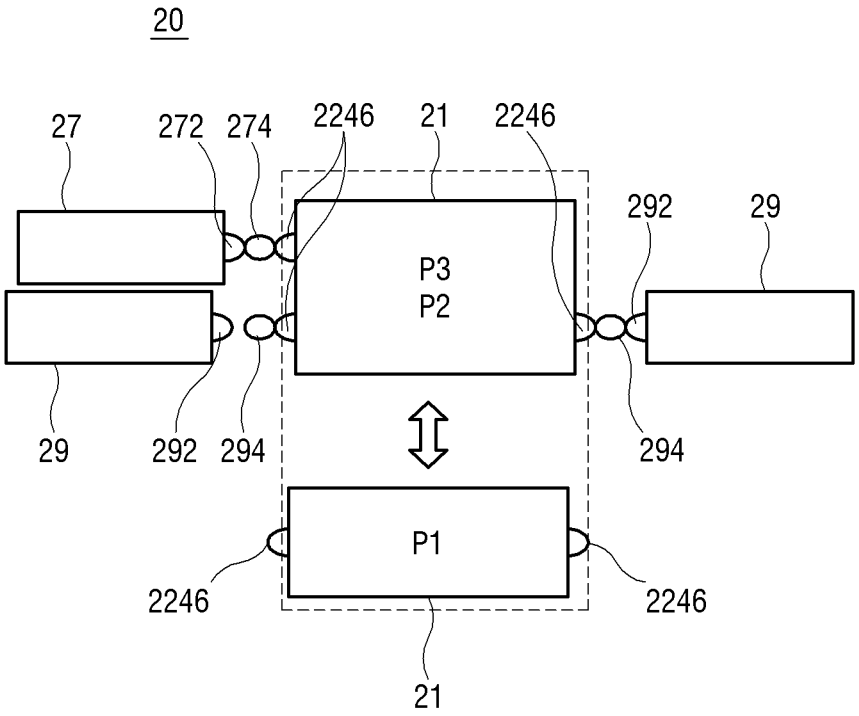
FIG. 38 is a diagram illustrating further another example of operations of the first auxiliary sensor and the second auxiliary sensors with the main sensor at the sensing position moving horizontally.

FIG. 37 is a diagram illustrating further another example of operations of a first auxiliary sensor and second auxiliary sensors with the main sensor ascending to the limit position and the sensing position. FIG. 38 is a diagram illustrating further another example of operations of the first auxiliary sensor and the second auxiliary sensors with the main sensor at the sensing position moving horizontally.

The sensor unit 20 of this embodiment includes a single first auxiliary sensor 27 and a pair of second auxiliary sensors 29. The first auxiliary sensor 27 and the second auxiliary sensors 29 are provided at different height from each other. In this embodiment, the first auxiliary sensor 27 is provided above the second auxiliary sensors 29. Also, a pair of terminal pushing portions 2246 are provided at different heights corresponding to the first auxiliary sensor 27 and the second auxiliary sensors 29, respectively.

The first auxiliary sensor 27 becomes in the on-state or the off-state according to whether the first terminal 272 and the second terminal 274 contact with each other. The second auxiliary sensors 29 become in the on-state or the off-state according to whether third terminals 292 and fourth terminals 294 contact with each other.

Referring to FIG. 37, the main sensor 21 ascends from the settled position P1 to the limit position P2 and the sensing position P3. Accordingly, the first auxiliary sensor 27 becomes in the on-state because the first terminal 272 and the second terminal 274 contact with each other, whereas the second auxiliary sensors 29 are in the off-state because the third terminals 292 and the fourth terminals 294 are apart from each other. Then, when the main sensor 21 descends, the first auxiliary sensor 27 becomes in the off-state. That is, the first auxiliary sensor 27 in the on-state identifies that the main sensor 21 reaches the sensing position P3, and in the off-state identifies that the main sensor 21 is away from the sensing position P3. When the main sensor 21 is at the limit position P2 and the sensing position P3, the second auxiliary sensors 29 are in the off-state and the standby state to sense whether the sensor unit 20 bumps into the obstacle.

Referring to FIG. 38, the main sensor 21 at the sensing position P3 moves horizontally with the sensor unit 20 bumping into the obstacle. Accordingly, one of the second auxiliary sensors 29 becomes in the on-state because one of the third terminals 292 and one of the fourth terminals 294 contact with each other. In this state, the second auxiliary sensor 27 in the on-state shown on the right in FIG. 38 senses that the sensor unit 20 bumps into the obstacle and identifies that the obstacle exists at a position on the left in FIG. 38.

When the main sensor 21 is at the settled position P1, the first auxiliary sensor 27 and the two second auxiliary sensors 29 are all in the off-state. When the main sensor 21 is at the limit position P2 and the sensing position P3 without bumping into the obstacle, the first auxiliary sensor 27 is in the on-state and the two second auxiliary sensors 29 are in the off-state. When the main sensor 21 is at the sensing position P3 bumping into the obstacle, the main sensor 21 moves horizontally and one of the two second auxiliary sensors 29 is in the on-state, of which the situation is applied to the operation of the robot cleaner 1.

Meanwhile, similarly to the embodiments illustrated in FIGS. 31 through 36, when the sensor unit 20 at the sensing position P3 bumps into the obstacle without the controller 40 controlling the sensor position changer 24, the main sensor 21 may be forcedly moved downwards and away from the sensing position P3. In this state, the first auxiliary sensor 27 turns from the on-state into the off-state. Then, the controller 40 may control the sensor position changer 24 to move the sensor holder 22 upwards so that the main sensor 21 is restored to the sensing position P3. Optionally, the controller 40 may also perform an alert operation, for example, notifying a user of bumping into the obstacle.

Here, the auxiliary sensor 27 may be of a non-contact type because the auxiliary sensor 27 continues being in the on-state at the limit position P2, which affects a life span of the auxiliary sensor 27 or hinders the movement of the main sensor 21.

Figure 39:
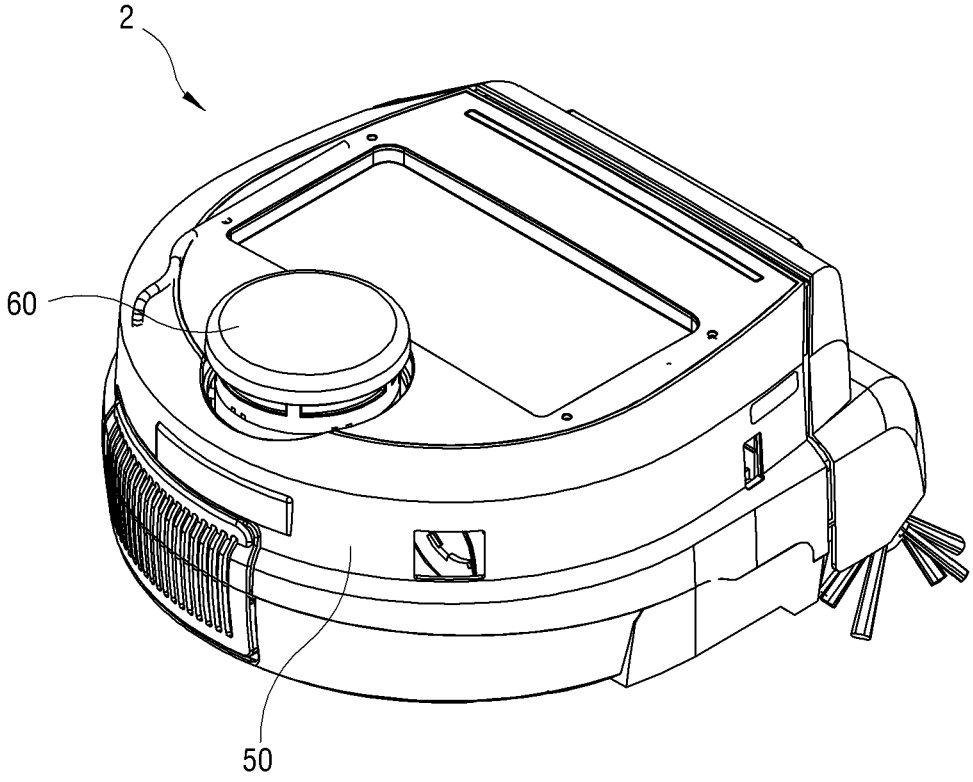
FIG. 39 is a perspective view of another example of the robot cleaner.
Figure 40:
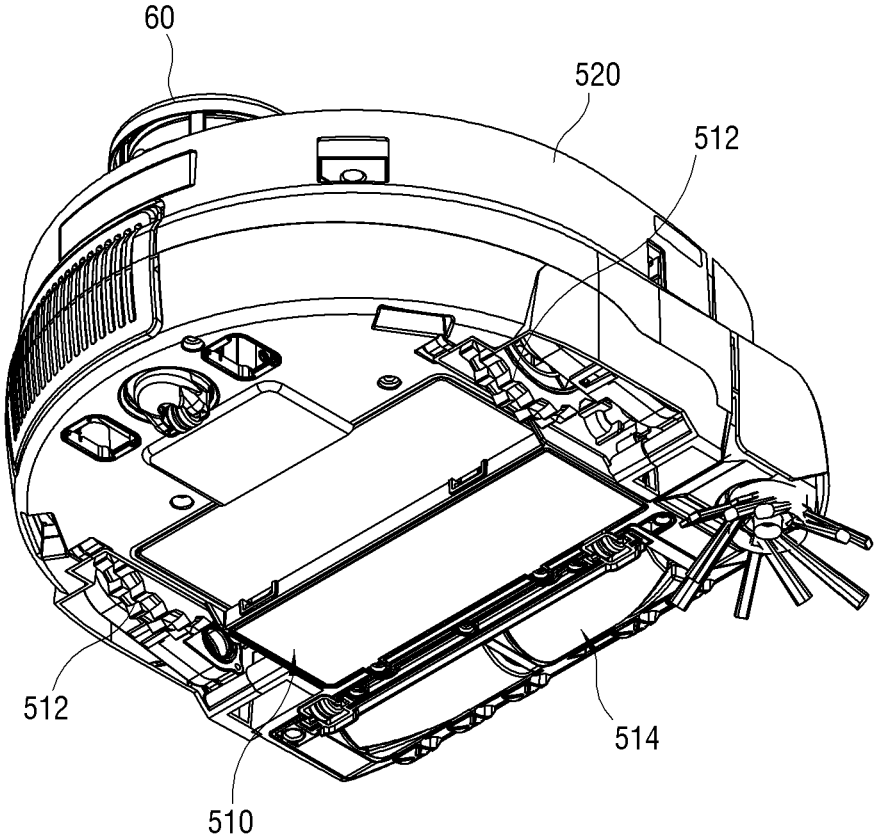
FIG. 40 is a perspective view illustrating a bottom of the robot cleaner shown in FIG. 39.
Figure 41:
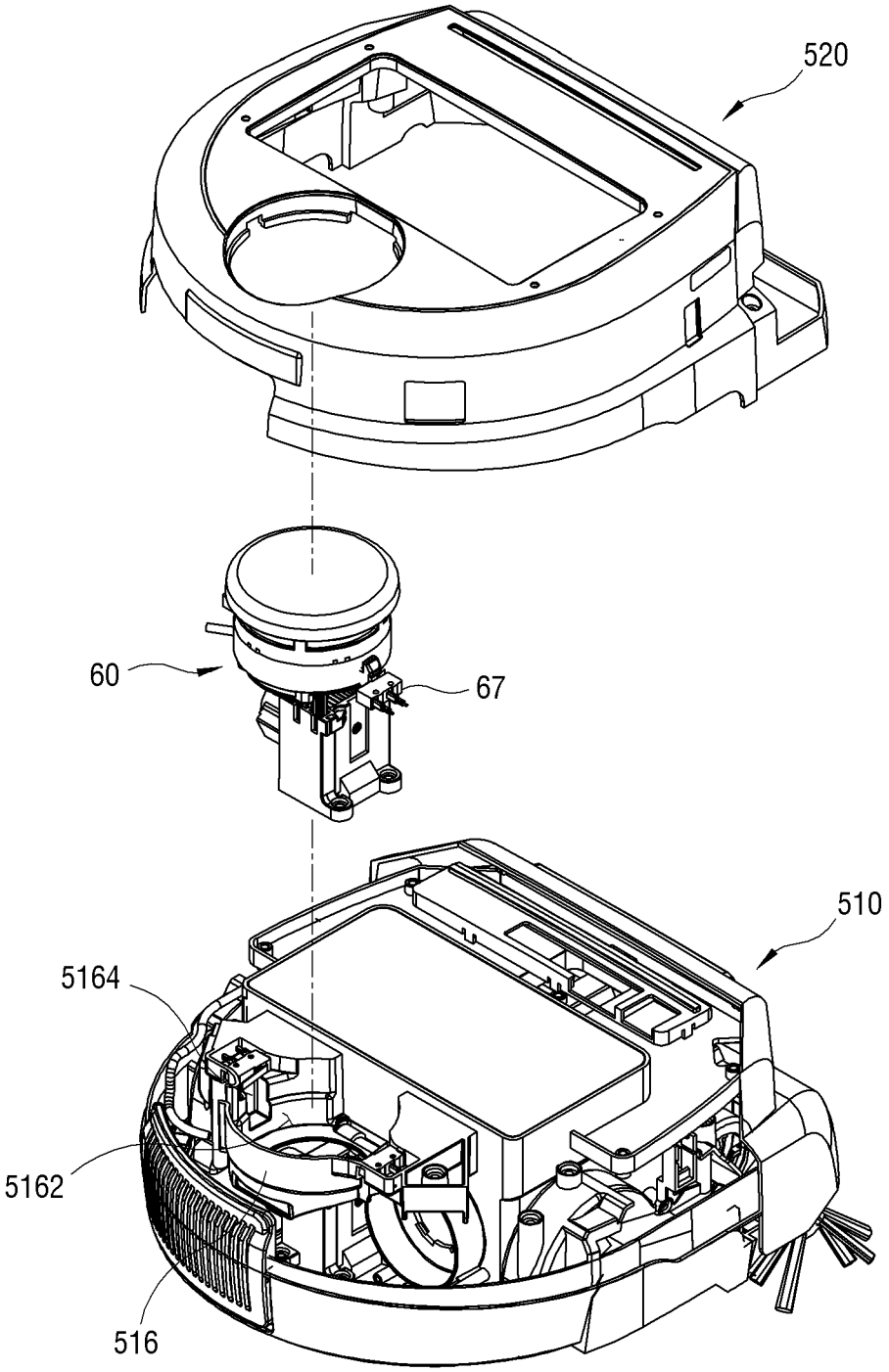
FIG. 41 is an exploded view of the robot cleaner shown in FIG. 39.

FIG. 39 is a perspective view of another example of the robot cleaner. FIG. 40 is a perspective view illustrating a bottom of the robot cleaner shown in FIG. 39. FIG. 41 is an exploded view of the robot cleaner shown in FIG. 39.

Referring to FIGS. 39 through 41, the robot cleaner 2 includes a cleaner body 50 which moves in an area and cleans the area, and a sensor unit 60.

The cleaner body 50 includes a dust suction body 510 which generates suction power and suctions dust in the area, and an upper cover 520 which covers an upper portion of the dust suction body 510.

The dust suction body 510 includes wheels 512 to move in the area, a dust collector 514 to collect the dust from the area, and a sensor housing 516 to accommodate the sensor unit 60. The dust suction body 510 may further include a motor which generates the suction power to suction the dust in the area.

The wheels 512 include a pair of wheels with a plurality of sawtooth in order not to slip on the area. The wheels 512 may further include at least one auxiliary wheel for stable movement of the cleaner body 50.

The dust collector 514 picks up by the suction power the dust in the area into the cleaner body 50. The dust collector 514 may include a filter to filter the suctioned dust.

The sensor housing 516 includes a sensor mounting unit 5162 accommodating the sensor unit 60 and an auxiliary sensor mounting portion 5164 in which auxiliary sensors 67 is mounted.

The sensor unit 60 is mounted in the sensor housing 516. The sensor unit 60 senses the position of the obstacle or the distance to the obstacle, and whether the position of the sensor unit 60 changes.

Figure 42:
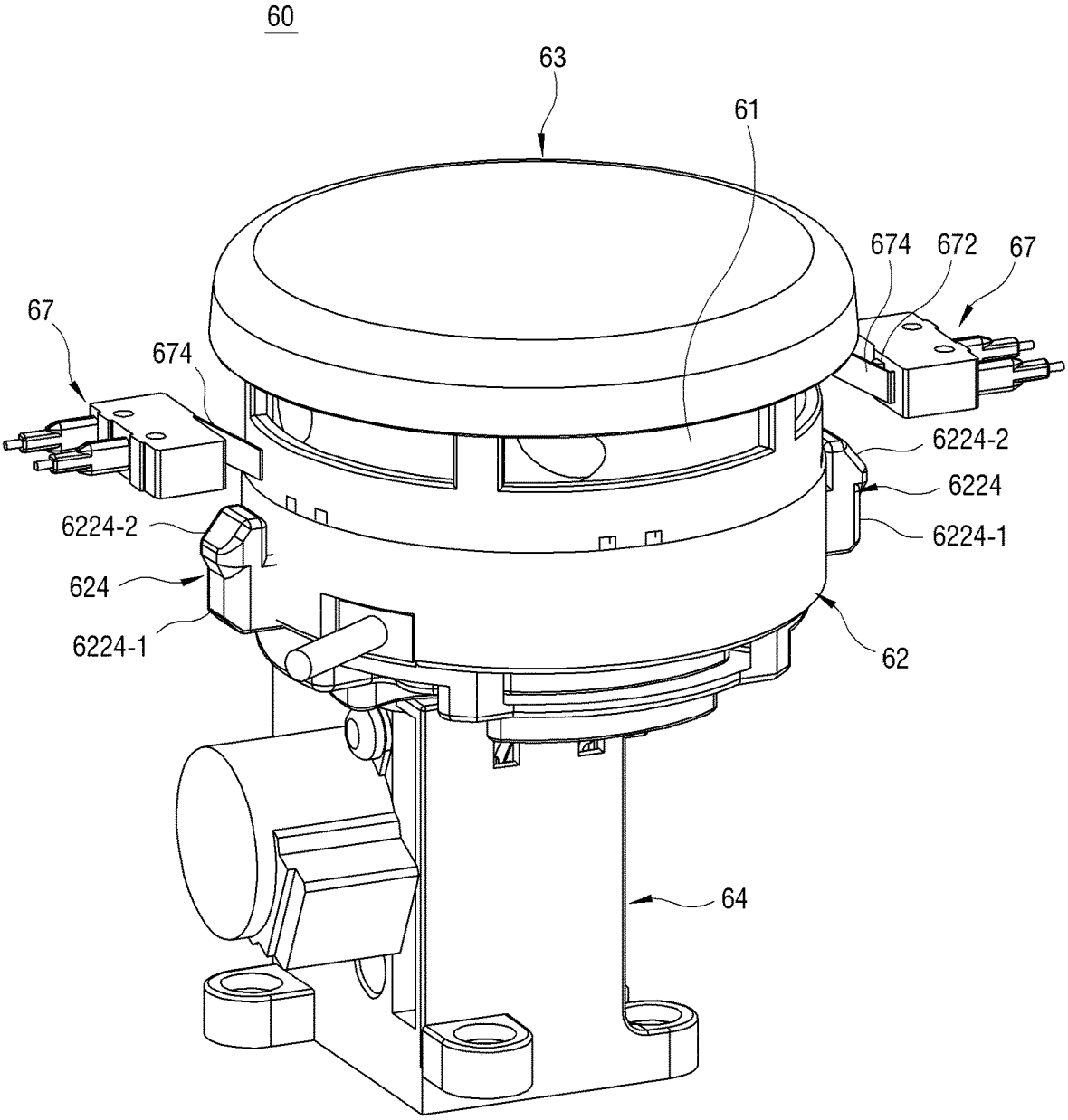
FIG. 42 is a perspective view of the sensor unit.
Figure 43:
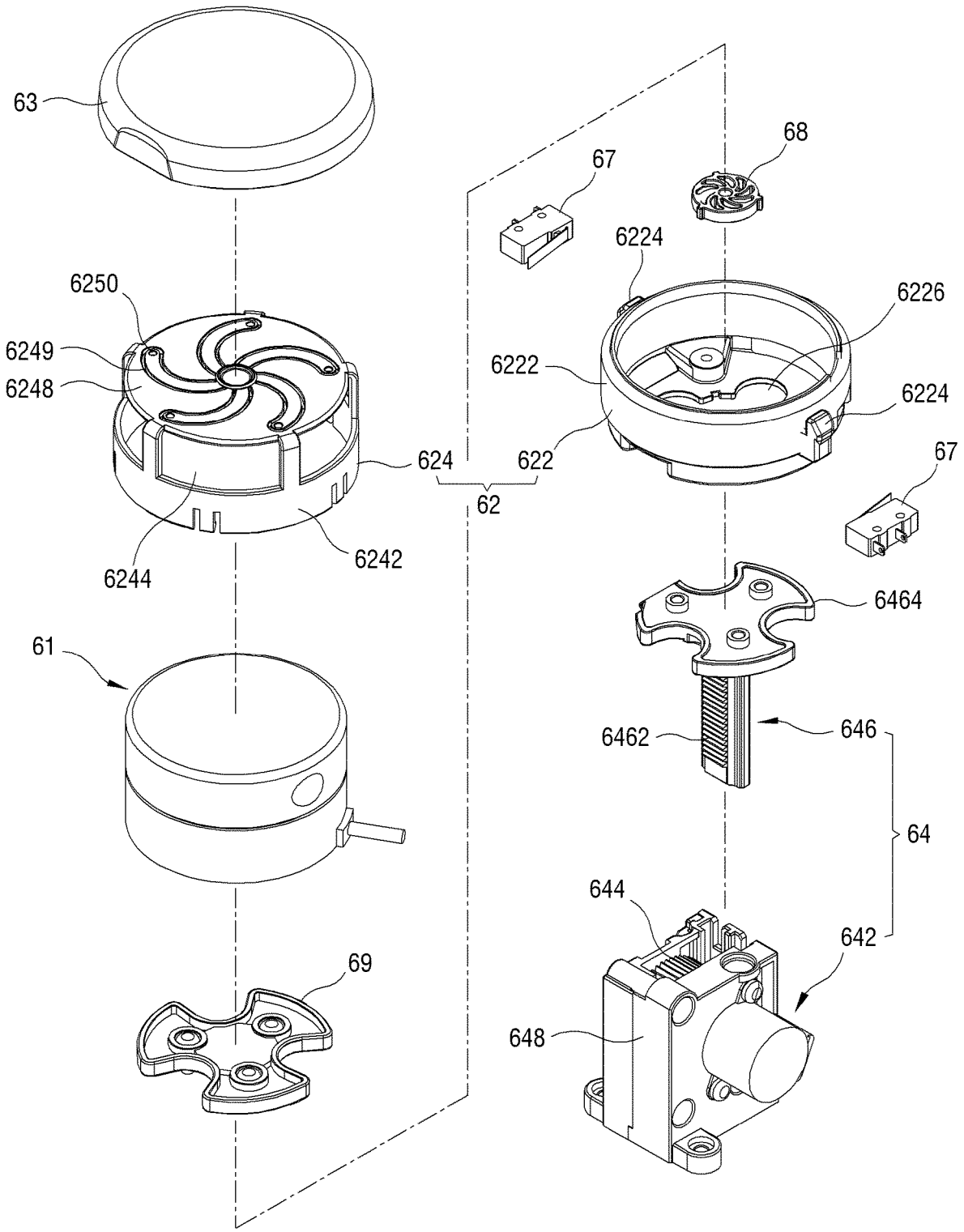
FIG. 43 is an upper exploded view of the sensor unit.
Figure 44:
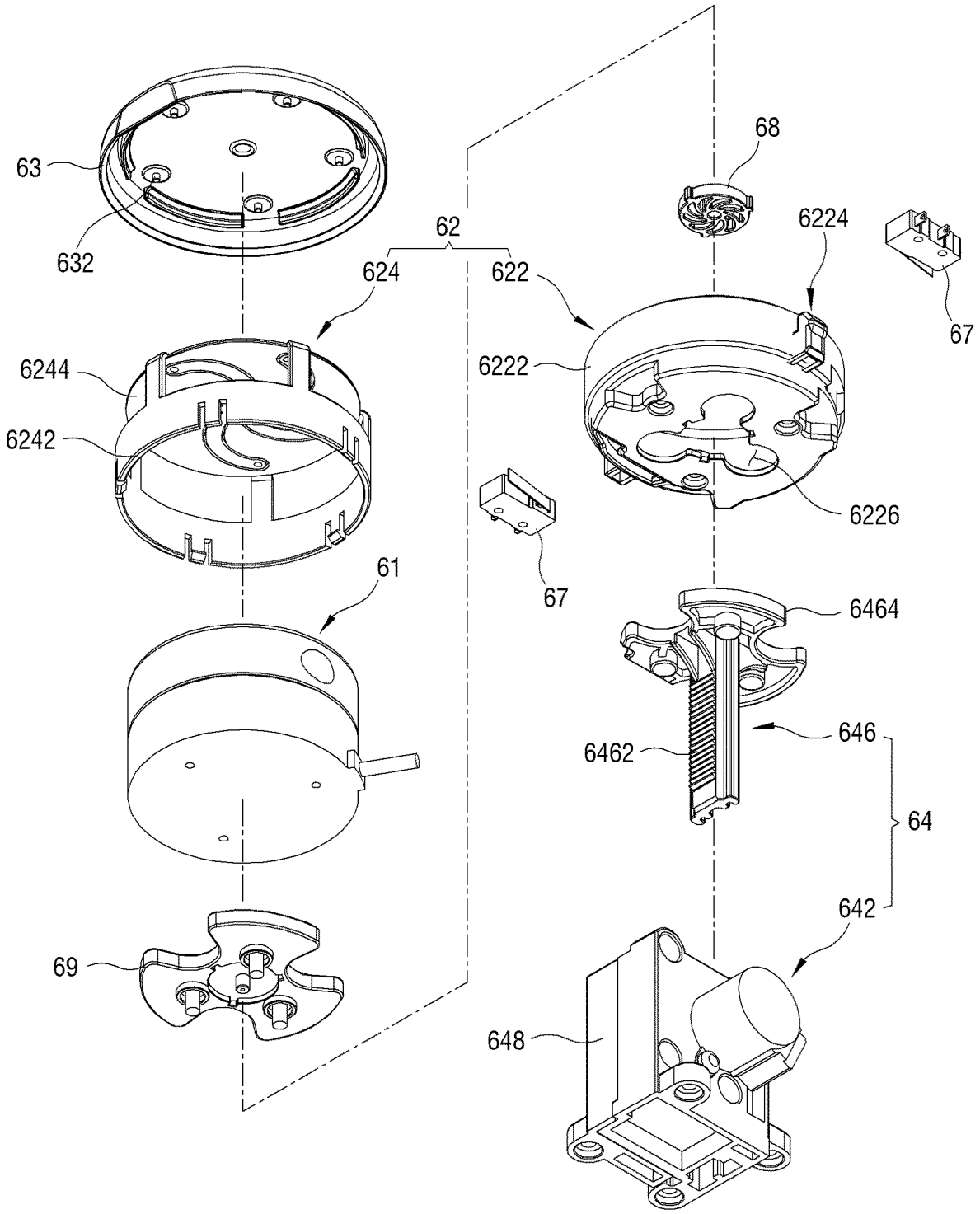
FIG. 44 is a lower exploded view of the sensor unit.

FIG. 42 is a perspective view of the sensor unit. FIG. 43 is an upper exploded view of the sensor unit. FIG. 44 is a lower exploded view of the sensor unit.

Referring to FIGS. 42 through 43, the sensor unit 60 includes a main sensor 61, a sensor holder 62, a holder cap 63, a sensor position changer 64, the auxiliary sensors 67, a position restoration member 68, and a coupling member 69.

The main sensor 61 has a cylindrical shape and obtains the circumstances information regarding the obstacle which represents the position of the obstacle or the distance to the obstacle by emitting light and receiving the light reflected from the obstacle. The obtained circumstances information regarding the obstacle is applied to an operation of the robot cleaner 2.

The sensor holder 62 includes a lower sensor holder 622 and an upper sensor holder 624. The lower sensor holder 622 and the upper sensor holder 624 are coupled with each other to accommodate the main sensor 61. The lower sensor holder 622 and the upper sensor holder 624 accommodating the main sensor 61 are moved by the sensor position changer 64 between the settled position and the sensing position.

The lower sensor holder 622 accommodates a sensor lower portion receiver 6222 having a cylindrical shape to receive a lower portion of the main sensor 61.

The sensor lower portion receiver 6222 includes a pair of terminal pushing portions 6224 opposite to each other on outer sides of the sensor lower portion receiver 6222 and a restoration member receiver 6226 having an opening of a clover shape on a bottom of the sensor lower portion receiver 6222. The terminal pushing portions 6224 protrude from the outer sides of the sensor lower portion receiver 6222, extend upwards, and protrude outwards at ends of the terminal pushing portions 6224.

The upper sensor holder 624 includes a sensor upper portion receiver 6242 having a cylindrical shape to receive an upper portion of the main sensor 61.

The sensor upper portion receiver 6242 includes a sensor opening 6244 provided radially through which light emitted by the main sensor 61 and light reflected from the obstacle pass, and a cap supporter 6248 in a plate shape to support the holder cap 63 over the upper sensor holder 624.

The cap supporter 6248 includes, for example, five tension bars 6249 spirally extending from a center of the cap supporter 6248. The tension bars 6249 may be manufactured by cutting a top of the cap supporter 6248 in a depth direction. One ends of the tension bars 6249 at a center of the top of the cap supporter 6248 are integrated and other ends of the tension bars 6249 are acted as free ends 6250. The free ends 6250 of the tension bars 6249 are joined with joint protrusions 632 provided on an inner side of the holder cap 63.

The holder cap 63 covers an upper portion of the sensor holder 62. The holder cap 63 includes the joint protrusions 632 provided on the inner side of the holder cap 63. The free ends 6250 of the tension bars 6249 may be joined with the joint protrusions 632 in a manner of a glue, heat fusion, etc.

The sensor position changer 64 allows the sensor holder 62 to move among the settled position, the limit position and the sensing position. The sensor position changer 64 includes a motor 642, a pinion 644 coupled with an axis of the motor 642, a rack 646 geared with the pinion 644, and a rack pinion mounting unit 648.

The motor 642 rotates clockwise or counterclockwise.

The pinion 644 is coupled with the axis of the motor 642 and includes a circular gear with a plurality of tooth around a side of the circular gear.

The rack 646 includes a linear gear 6462 having a plurality of tooth geared with the circular gear of the pinion 644. The rack 646 also includes a rack flange 6464 with a clover shape to support the sensor holder 62.

As the pinion 644 rotates clockwise or counterclockwise according to the rotation of the motor 642 with the rack 646 reciprocally moving upwards or downwards, the main sensor 61 is allowed to move reciprocally between the settled position and the sensing position.

A pair of the auxiliary sensors 67 are provided on a path along which the pair of terminal pushing portions 6224 move. The auxiliary sensors 67 are mounted in the auxiliary sensor mounting portion 5164 shown in FIG. 41. The auxiliary sensors 67 have a similar configuration of the auxiliary sensors 27 illustrated in FIG. 17 and include first terminals 672 and second terminals 674. The auxiliary sensors 67 become in the on-state when the main sensor 61 is at the limit position while moved upwards or downwards by the sensor position changer 64. The auxiliary sensors 67 in the on-state sense the position of the obstacle when the sensor unit 60 bumps into the obstacle.

The position restoration member 68 is provided within the opening of the restoration member receiver 6226 of the lower sensor holder 622. Also, the position restoration member 68 is provided between the rack flange 6464 of the sensor position changer 64 and the coupling member 69. The position restoration member 68 has elasticity to allow the lower sensor holder 622 to move horizontally when bumping into the obstacle and then to restore an initial position.

The coupling member 69 has a clover shape fixing to the rack flange 6464 with the restoration member receiver 6226 being interposed therebetween and the position restoration member 68 being provided therein. Accordingly, the lower sensor holder 622 ascends or descends together with the rack 646.

Figure 45:
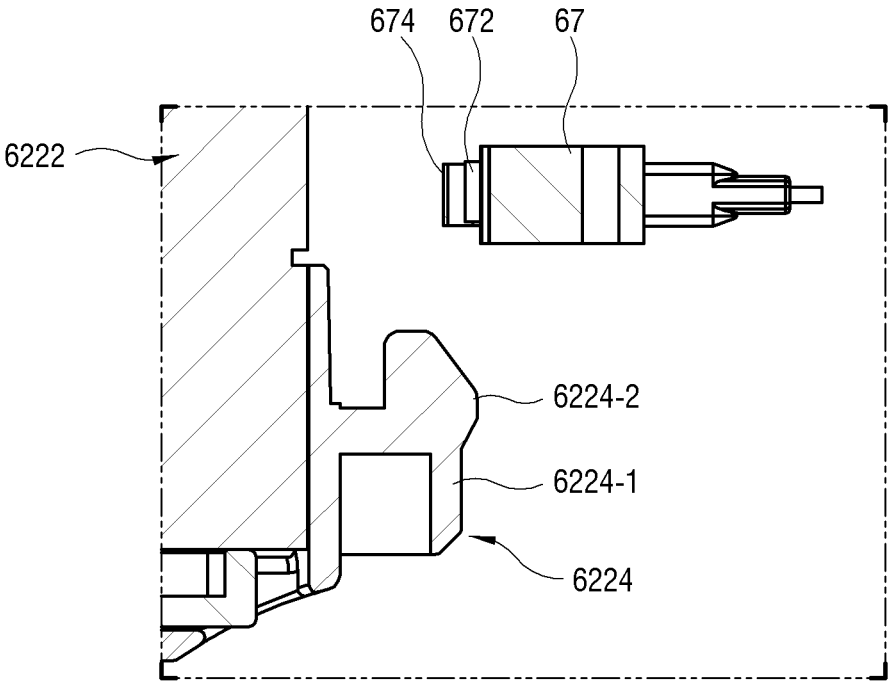
FIG. 45 is a sectional view illustrating the terminal pushing portion and the auxiliary sensor.

FIG. 45 is a sectional view illustrating the terminal pushing portion and the auxiliary sensor. Referring to FIG. 45, the terminal pushing portion 6224 includes an extension portion 6224-1 protruding from the outer side of the sensor lower portion receiver 6222 and extending upwards, and a pushing protrusion 6224-2 protruding outwards at an end of the extension portion 6224-1. The pushing protrusion 6224-2 pushes the second terminal 674 of the auxiliary sensor 67 to contact the first terminal 672 when the terminal pushing portion 6224 ascends or descends to the limit position. Also, the extension portion 6224-1 pushes the second terminal 674 of the auxiliary sensor 67 to contact the first terminal 672 when the terminal pushing portion 6224 is at the sensing position horizontally bumping into the obstacle.

Figure 46:
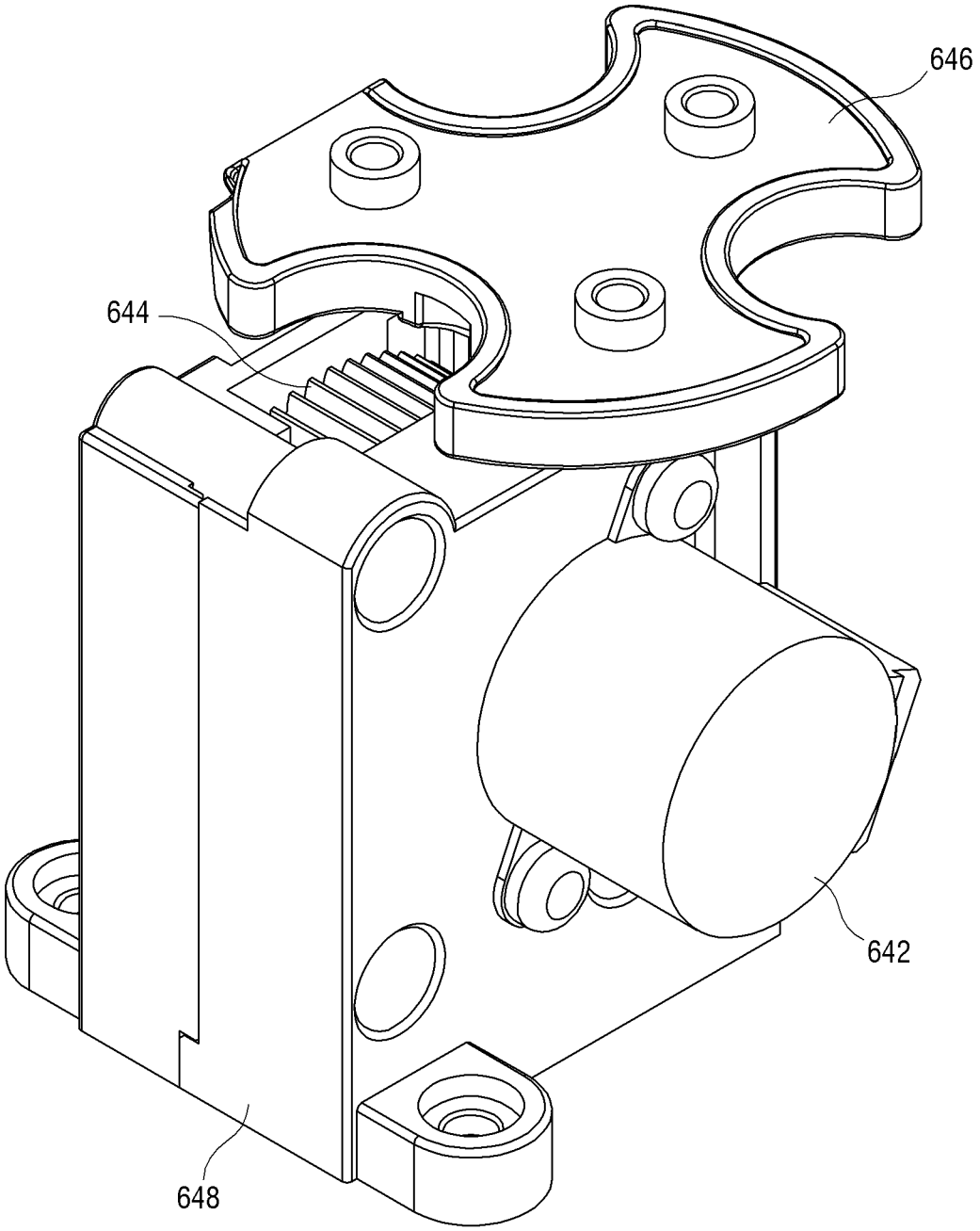
FIG. 46 is a perspective view of the sensor position changer.
Figure 47:
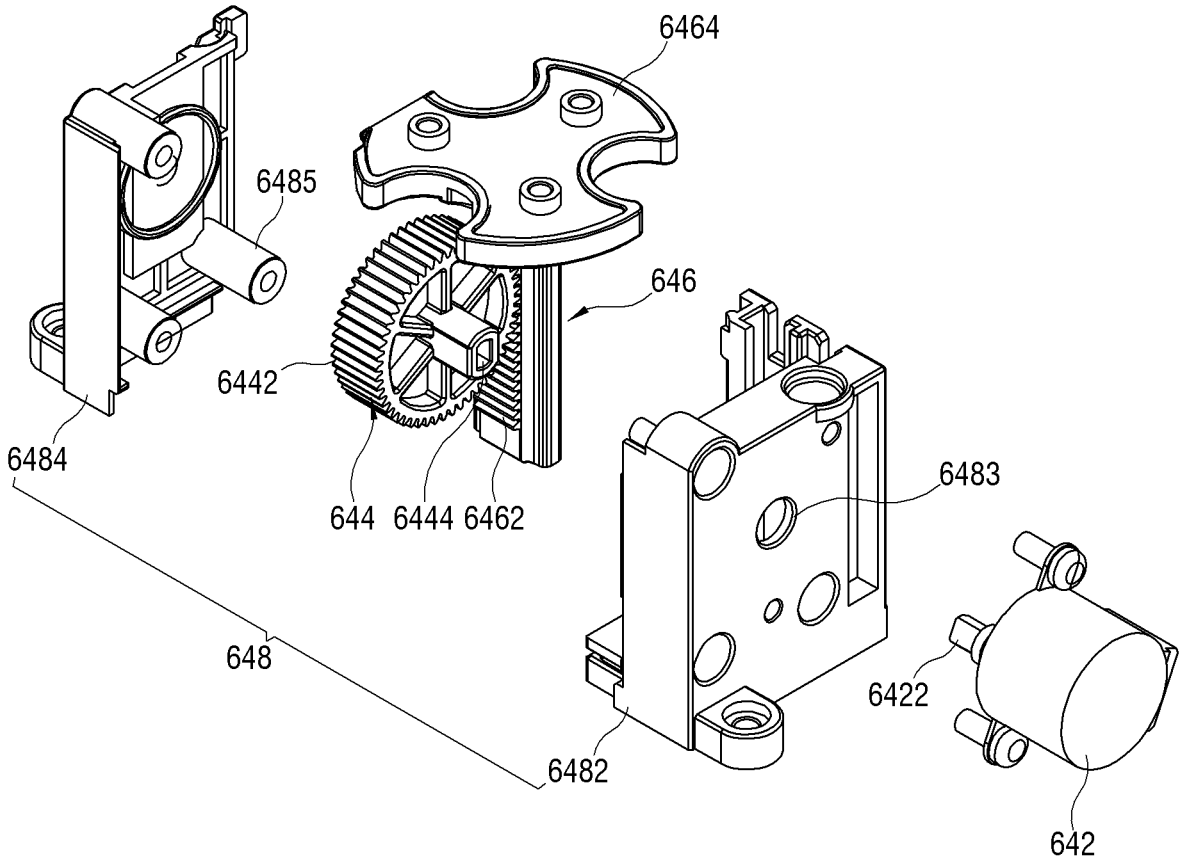
FIG. 47 is an exploded view of the sensor position changer.

FIG. 46 is a perspective view of the sensor position changer. FIG. 47 is an exploded view of the sensor position changer. Referring to FIGS. 46 and 47, the motor 642 includes a rotation axis 6422. The pinion 644 includes a circular gear 6442 with a plurality of tooth around a side of the circular gear 6442, and a first axis coupling portion 6444 fixing to the rotation axis 6422 of the motor 642 at a center of the pinion 644.

The rack pinion mounting unit 648 accommodates the motor 642, the rack 646 and the pinion 644. The rack pinion mounting unit 648 includes a first case 6482 supporting the motor 642, and a second case 6484 coupled with the first case 6482 proving a space to accommodate the rack 646 and the pinion 644. The first case 6482 includes a hole 6483 through which the rotation axis 6422 of the motor 642 passes. The second case 6484 includes a second axis coupling portion 6485 supporting an axis of the pinion 644 rotatable.

Figure 48:
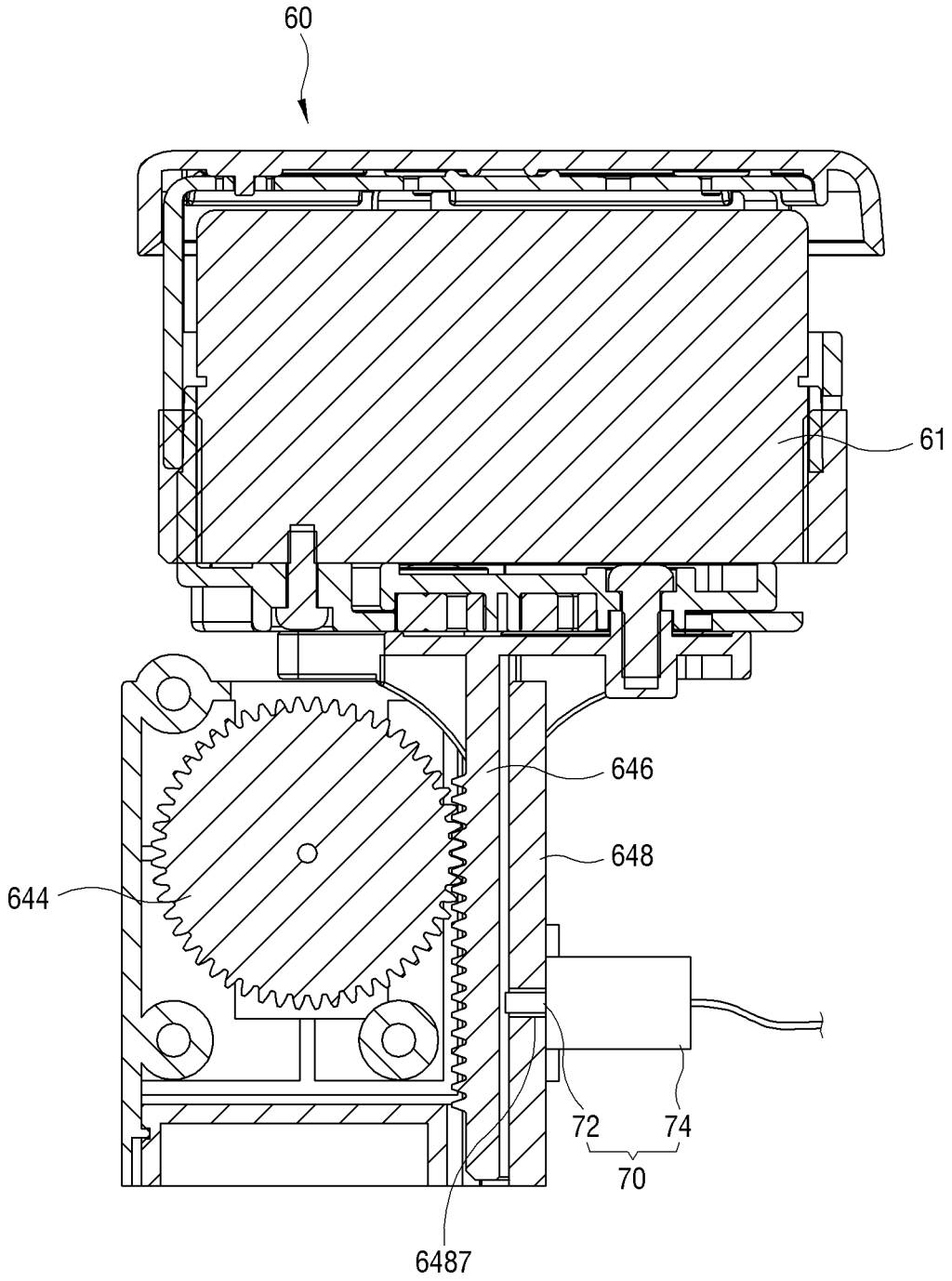
FIG. 48 is a sectional view of the sensor position changer and the main sensor at the settled position.
Figure 49:
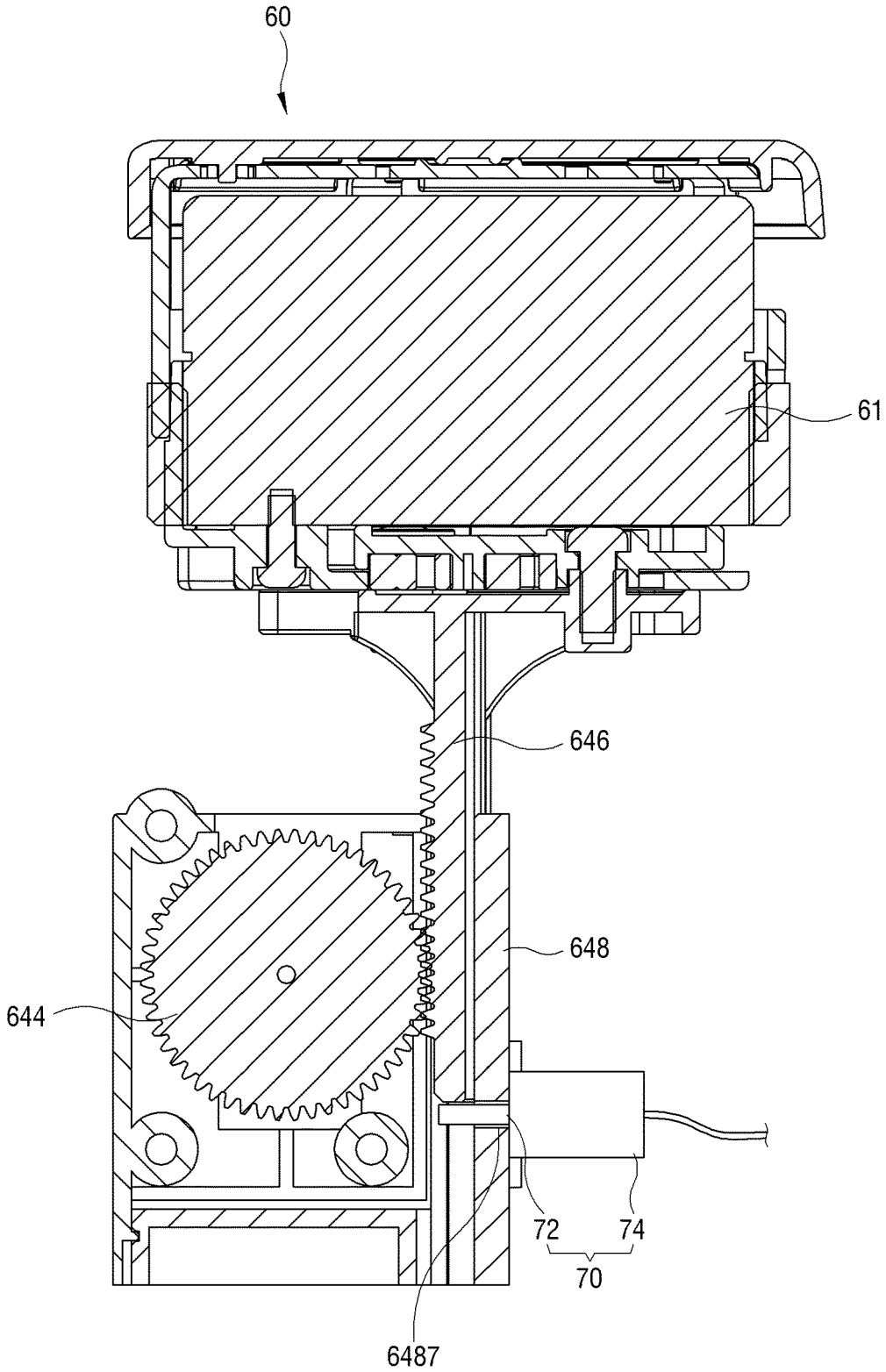
FIG. 49 is a sectional view of the sensor position changer and the main sensor moving upwards from the settled position to the sensing position.

FIG. 48 is a sectional view of the sensor position changer and the main sensor at the settled position. FIG. 49 is a sectional view of the sensor position changer and the main sensor moving upwards from the settled position to the sensing position. Referring to FIGS. 48 and 49, the sensor unit 60 further includes a stopper 70 to restrict the main sensor 61 at the sensing position from moving downwards by an external force. The stopper 70 includes a locking member 72 and a driver 74 allows the locking member to move between a lock state and a unlock state. The stopper 70 may be, for example, a solenoid valve. The rack pinion mounting unit 648 includes a hole 6487 through which the locking member 72 passes.

Referring to FIG. 48, at the settled position, because the locking member 72 is in the unlock state and does not protrude through the hole 6487, the rack 646 is not prevented from moving. On the other hand, referring to FIG. 49, at the sensing position, the locking member 72 is in the lock state protruding through the hole 6487 and supporting upwards on a lower end of the rack 646. Accordingly, the main sensor 61 is restricted from moving downwards due to an external force. Optionally, the controller 40 may control the stopper 70 to operate in the unlock state with the locking member 72 restoring and the pinion 644 and the rack 646 to allow the main sensor 61 to move downwards to the settled position. The stopper 70 may be in the lock state when the main sensor 61 is at the sensing position, for example, during cleaning, and be in the unlock state before the main sensor 61 moves to the settled position, for example, when the cleaning ends to be in the standby state for charging in the charging station.

Figure 50:
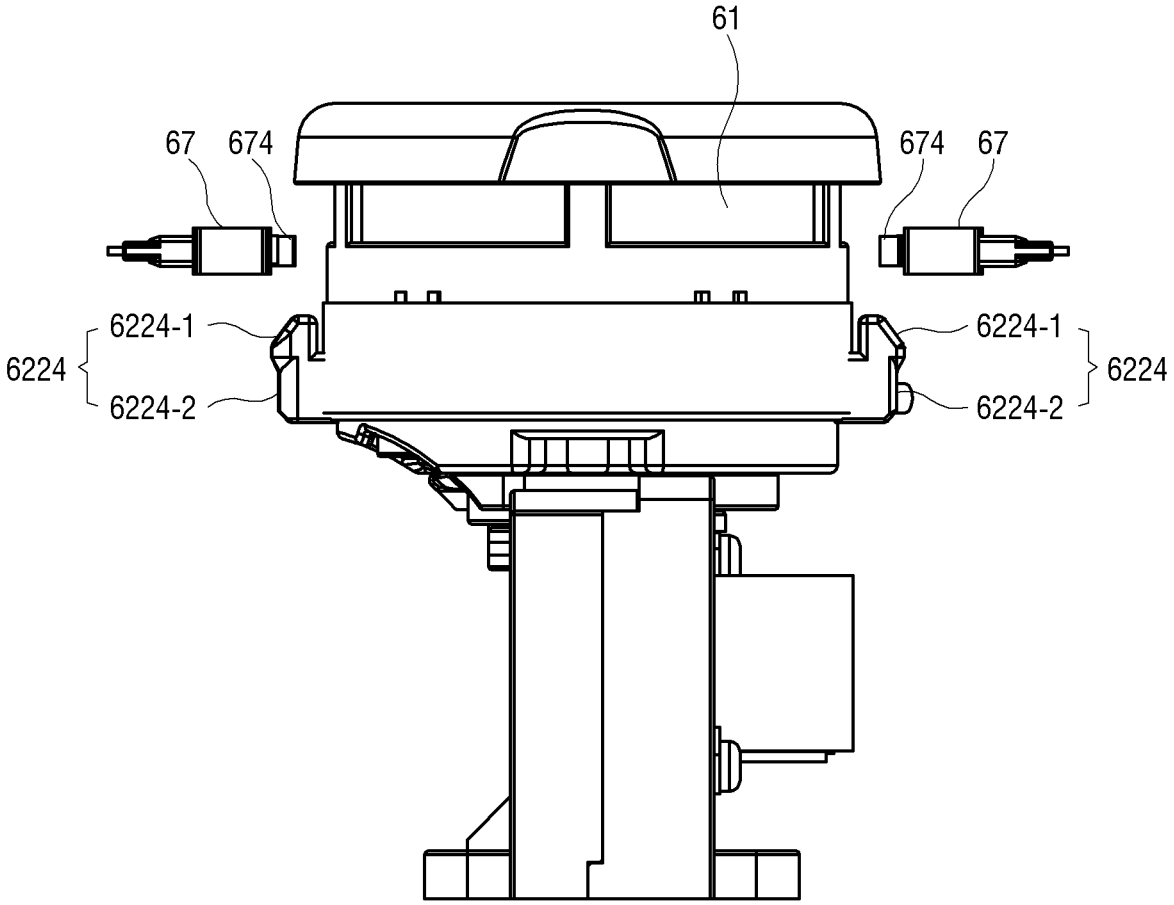
FIG. 50 is a side view of the terminal pushing portions and the auxiliary sensors with the main sensor being at the settled position.
Figure 51:
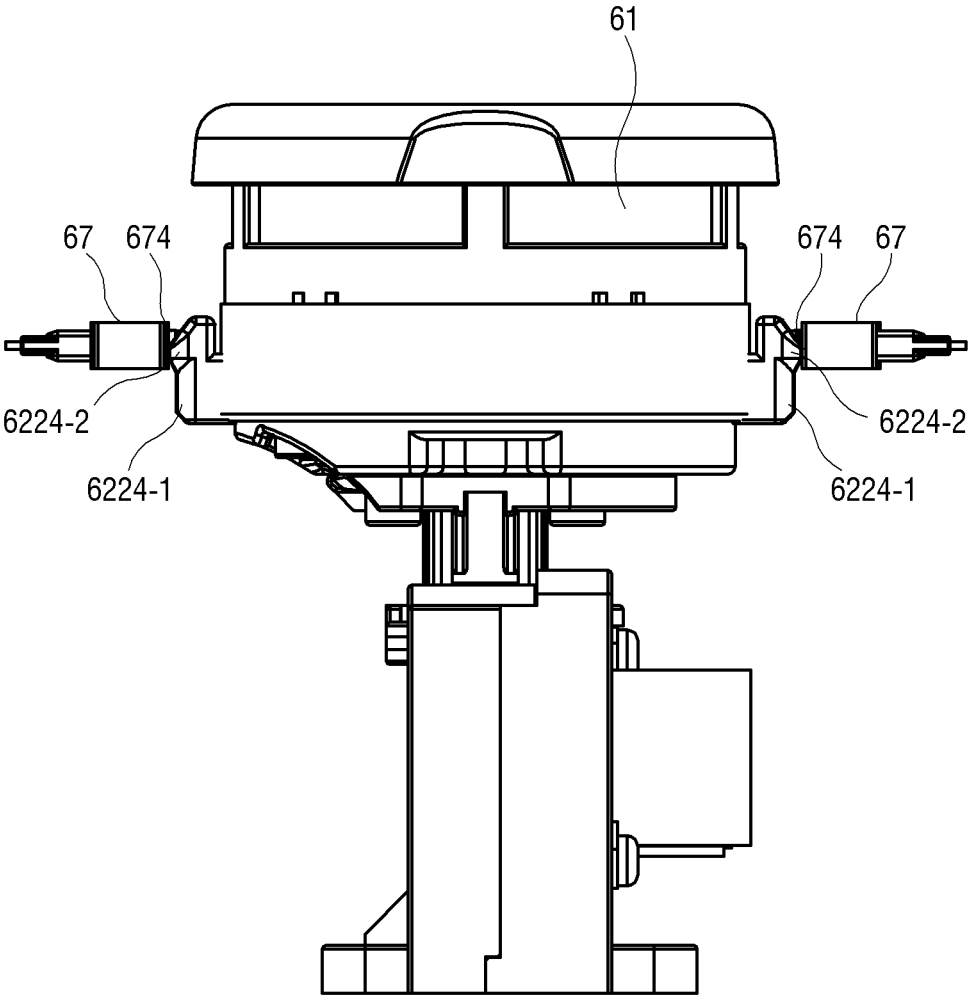
FIG. 51 is a side view of the terminal pushing portions and the auxiliary sensors with the main sensor being at the limit position.
Figure 52:
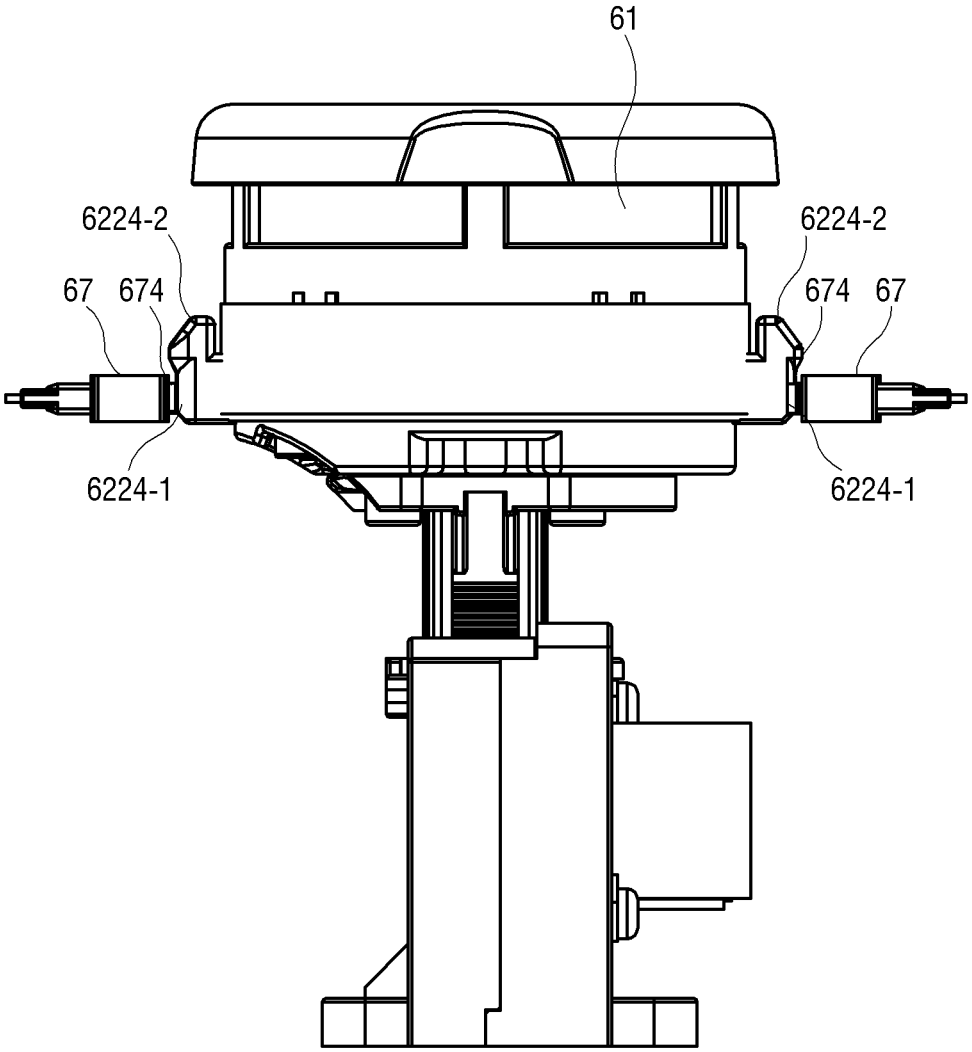
FIG. 52 is a side view of the terminal pushing portions and the auxiliary sensors with the main sensor being at the sensing position.

FIG. 50 is a side view of the terminal pushing portions and the auxiliary sensors with the main sensor being at the settled position. FIG. 51 is a side view of the terminal pushing portions and the auxiliary sensors with the main sensor being at the limit position. FIG. 52 is a side view of the terminal pushing portions and the auxiliary sensors with the main sensor being at the sensing position.

Referring to FIG. 50, when the main sensor 61 is at the settled position, the pair of auxiliary sensors 67 are all in the off-state apart from the terminal pushing portions 6224 at different heights.

Referring to FIG. 51, when the main sensor 61 is at the limit position moving upwards, the pair of auxiliary sensors 67 are all in the on-state with the second terminals 674 being pushed by the pushing protrusions 6224-2 of the terminal pushing portions 6224. In this state, the pair of auxiliary sensors 67 identify whether the main sensor 61 reaches the sensing position or is away from the sensing position.

Referring to FIG. 52, when the main sensor 61 is at the sensing position moving farther upwards, the pair of auxiliary sensors 67 are all in the off-state with the second terminals 674 not being pushed by the pushing protrusions 6224-2 of the terminal pushing portions 6224. In this state, the pair of auxiliary sensors 67 are in the standby state to sense whether the sensor unit 60 bumps into the obstacle.

Figure 53:
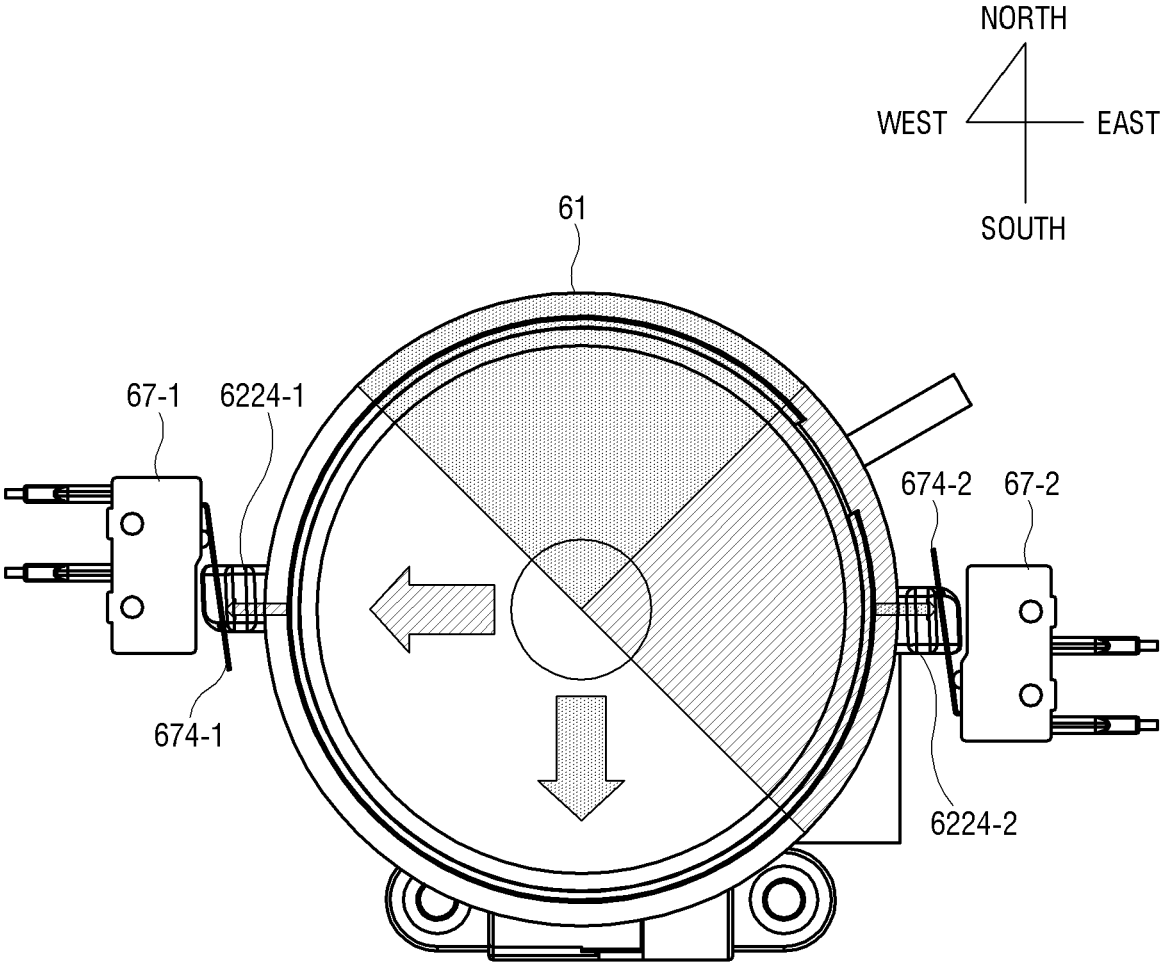
FIG. 53 is a plane view of the auxiliary sensors and the main sensor bumping into an obstacle in a direction.
Figure 54:
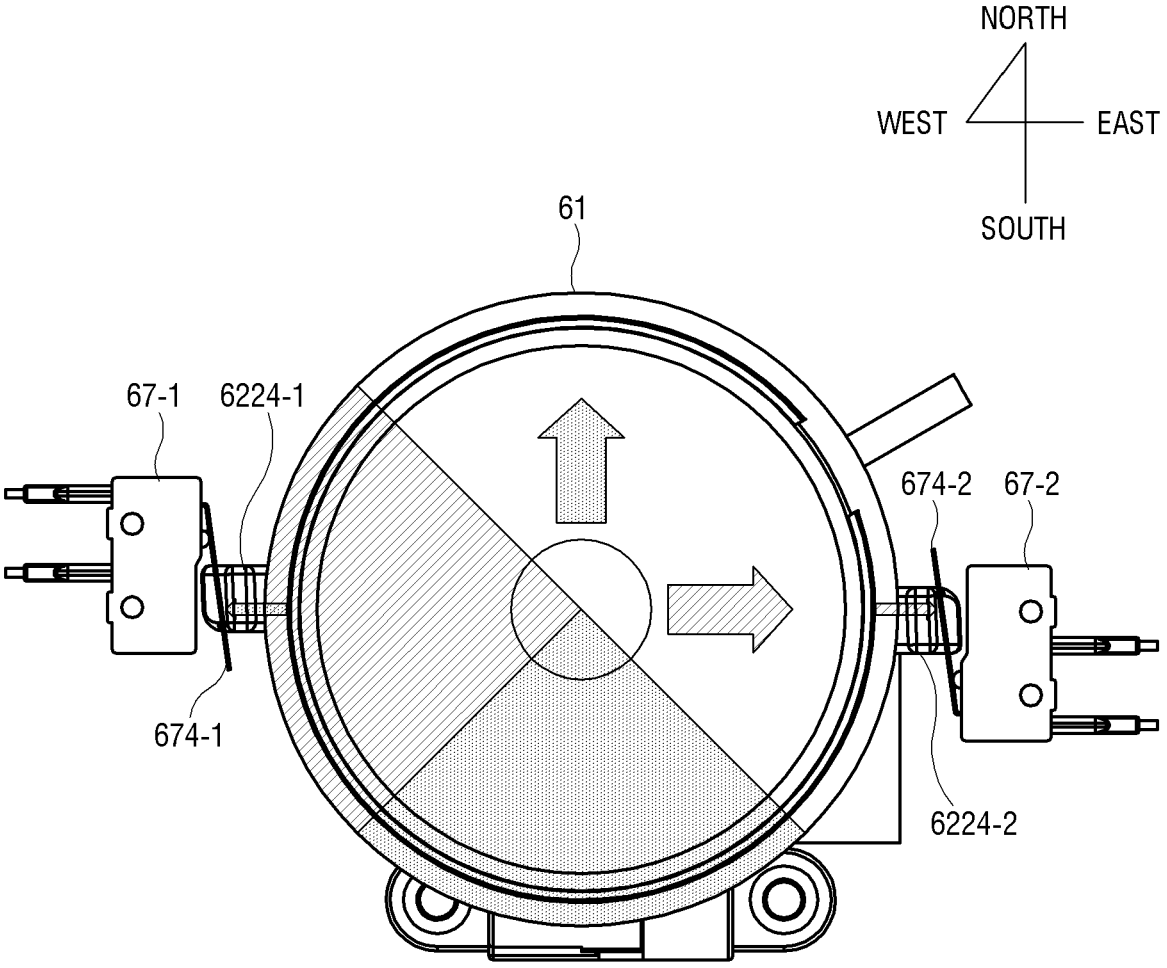
FIG. 54 is a plane view of the auxiliary sensors and the main sensor bumping into an obstacle in an opposite direction.

FIG. 53 is a plane view of the auxiliary sensors and the main sensor bumping into an obstacle in a direction. FIG. 54 is a plane view of the auxiliary sensors and the main sensor bumping into an obstacle in an opposite direction. Referring to FIG. 53, for example, when the sensor unit 60 bumps into the obstacle in a range of 180 degrees from south-east to north-west in a counterclockwise direction, the main sensor 61 moves in an opposite direction shown as arrows. Accordingly, a first auxiliary sensor 67-1 becomes in the on-state because a first extension portion 6224-1 pushes the second terminal 674-1 of the first extension portion 6224-1. In this way, the first auxiliary sensor 67-1 identifies circumstances of the obstacle as positioned in the range of 180 degrees from south-east to north-west in the counterclockwise direction.

Referring to FIG. 54, for example, when the sensor unit 60 bumps into the obstacle in a range of 180 degrees from south-east to north-west in a clockwise direction, the main sensor 61 moves in another opposite direction shown as arrows. Accordingly, a second auxiliary sensor 67-2 becomes in the on-state because a second extension portion 6224-2 pushes the second terminal 674-1 of the second extension portion 6224-2. In this way, the second auxiliary sensor 67-2 identifies circumstances of the obstacle as positioned in the range of 180 degrees from south-east to north-west in the clockwise direction. Therefore, the first auxiliary sensor 67-1 and the second auxiliary sensor 67-2 can identify circumstances of the obstacle in a range of 360 degrees around the main sensor 61.

Figure 55:
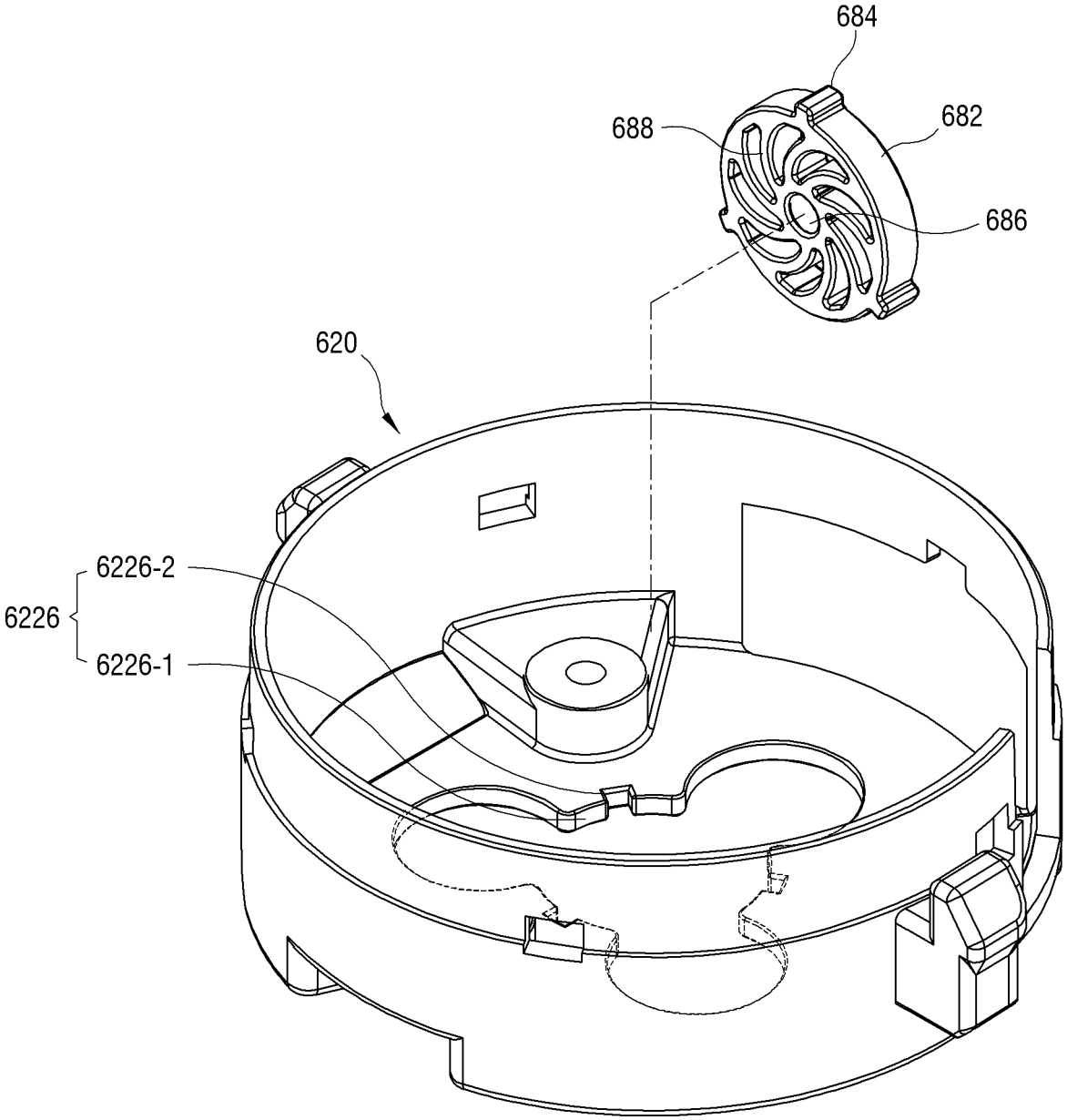
FIG. 55 illustrates the position restoration member and the restoration member receiver of the lower sensor holder.

FIG. 55 illustrates the position restoration member and the restoration member receiver of the lower sensor holder 620. Referring to FIG. 55, the position restoration member 68 includes a ring 682, supporting protrusions 684 provided around a side of the ring 682, a hole portion 686 (680 in FIG. 57) provided at a center of the position restoration member 68, and a plurality of elastic portions 688 connected between the ring 682 and the hole portion 686. The elastic portions 688 have a spiral shape for effective deformation. The restoration member receiver 6226 of the lower sensor holder 622 includes a positioning portion 6226-1 having a circular shaped opening into which the position restoration member 68 is inserted. Inner sides of the positioning portion 6226-1 contact the side of ring 682 positioning the position restoration member 68. The restoration member receiver 6226 further includes grooves 6226-2 provide on the inner sides of the positioning portion 6226-1 engaged with the supporting protrusions 684 of the position restoration member 68 inserted in the positioning portion 6226-1.

Figure 56:
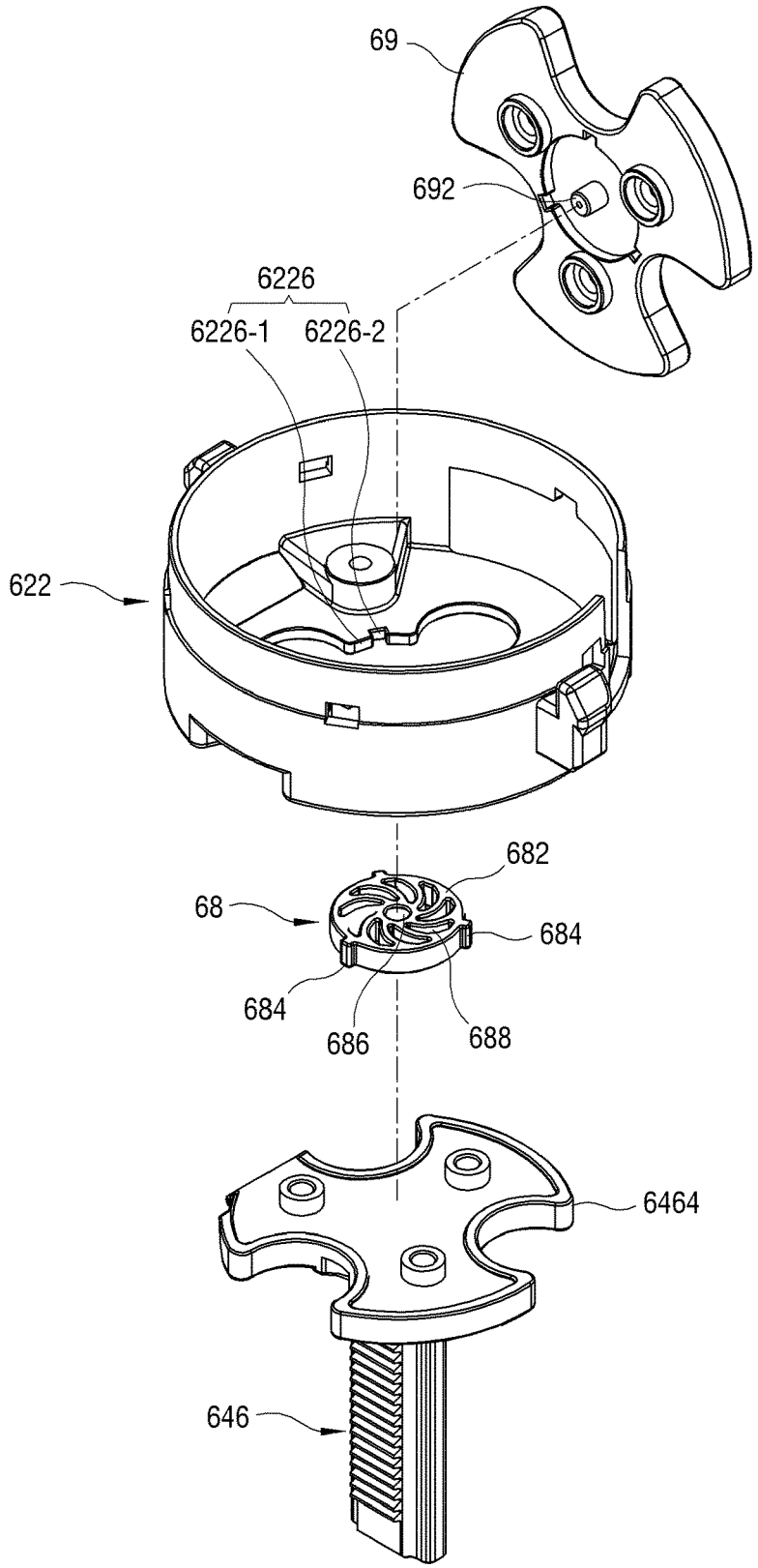
FIG. 56 is an exploded view illustrating the sensor holder and the sensor position changer.
Figure 57:
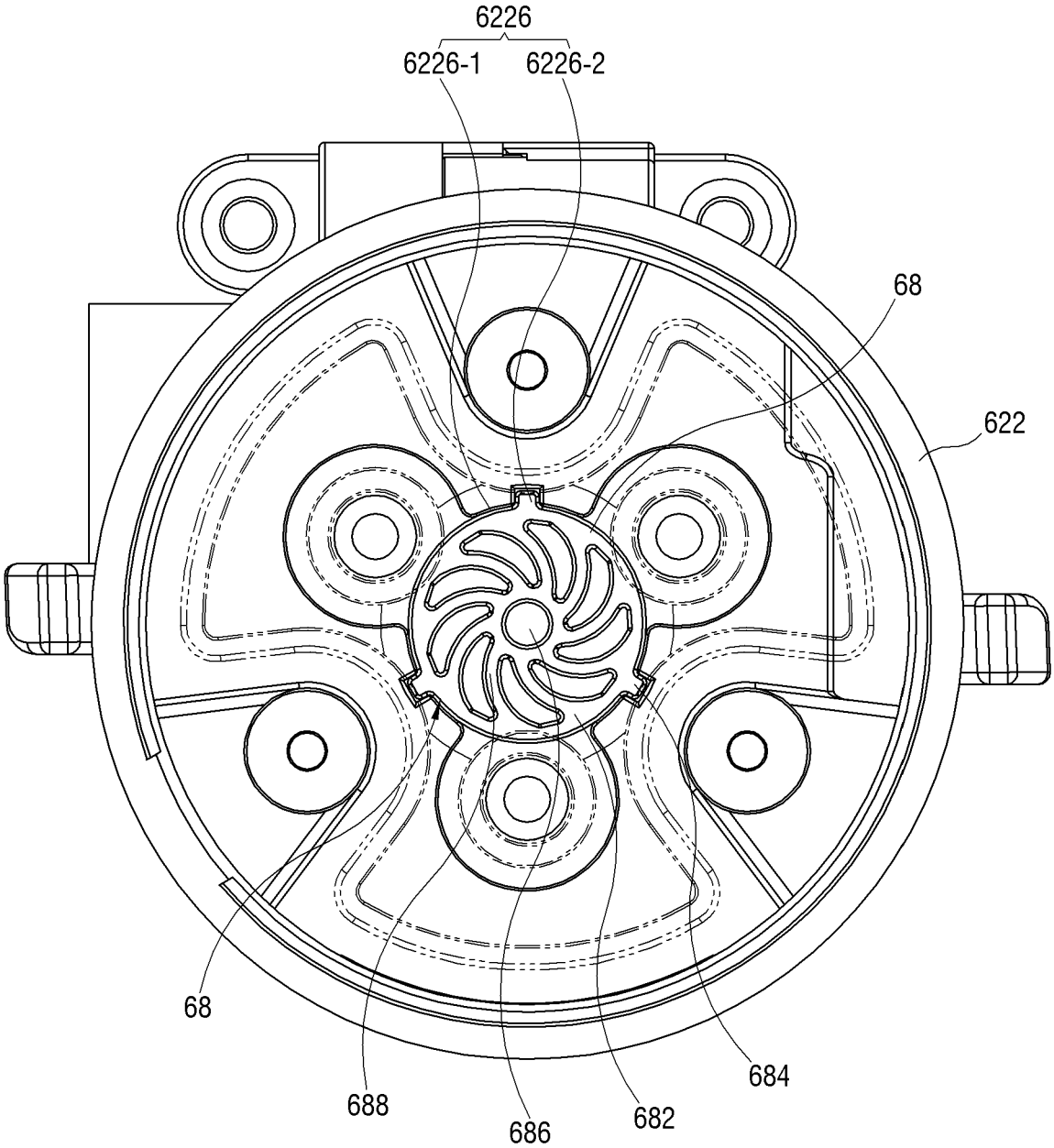
FIG. 57 illustrates the position restoration member before bumping into an obstacle.
Figure 58:
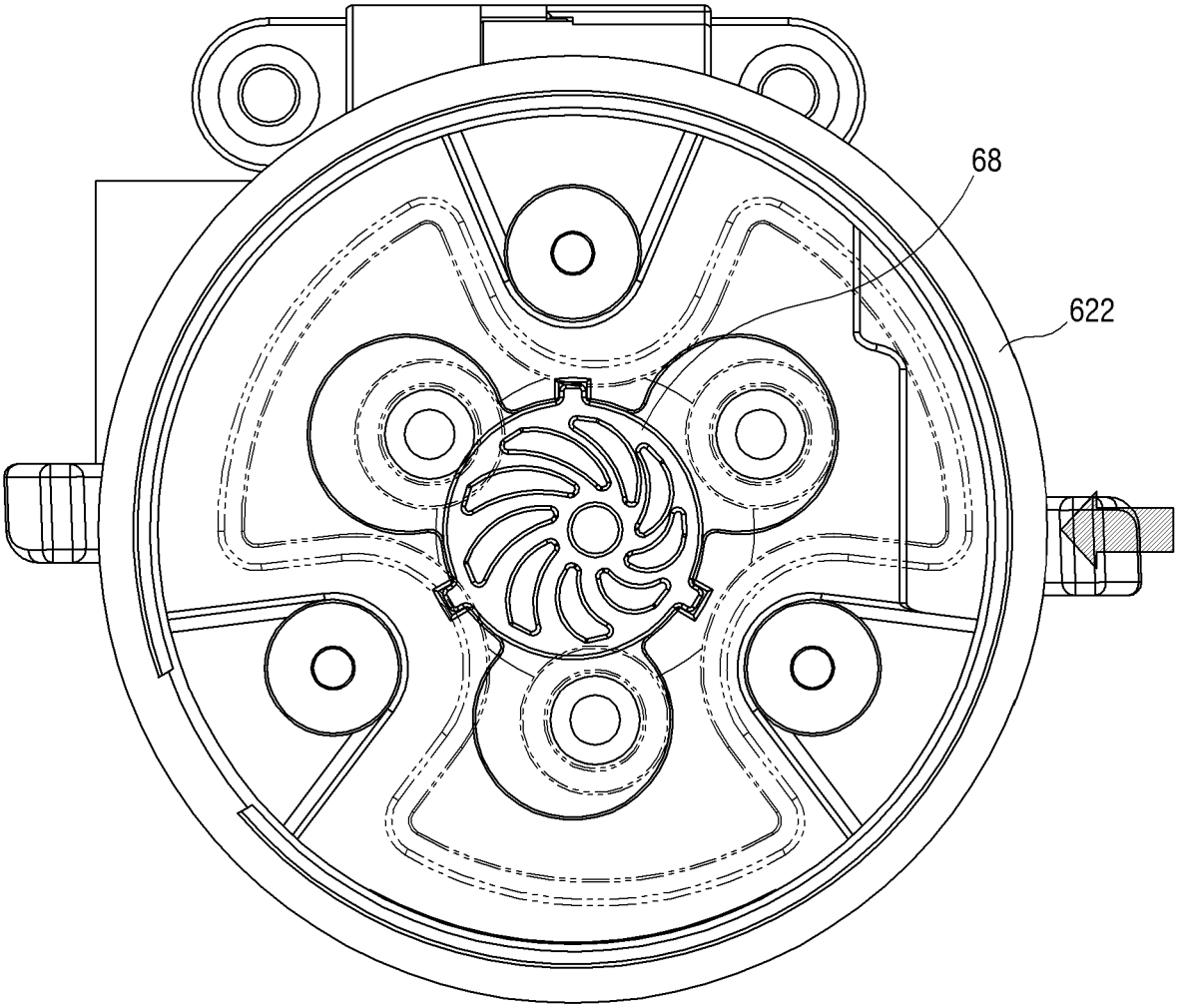
FIG. 58 illustrates the position restoration member while bumping into an obstacle.

FIG. 56 is an exploded view illustrating the sensor holder and the sensor position changer. FIG. 57 illustrates the position restoration member before bumping into an obstacle. FIG. 58 illustrates the position restoration member while bumping into an obstacle.

Referring to FIG. 56, the coupling member 69 includes a column 692 passing through the hole portion 688 of the position restoration member 68 with the rack flange 6464 of the rack 646 coupled with the coupling member 69. Accordingly, the coupling member 69 and the rack 646 have a common axis with the hole portion 688 of the position restoration member 68. The lower sensor holder 622 is able to move in all horizontal direction due to the elasticity of the position restoration member 68 relatively to the common axis of the hole portion 688 of the position restoration member 68, the coupling member 69 and the rack 646. Also, the lower sensor holder 622 is able to restore to an initial position.

Referring to FIG. 57, the lower sensor holder 622 is in a state of being at the initial position when not bumping into the obstacle. At this time, the position restoration member 68 maintains an initial form.

Referring to FIG. 58, the lower sensor holder 622 is in another state of moving horizontally in a direction shown as an arrow when bumping into the obstacle. At this time, the position restoration member 68 is deformed from the initial form. When the state bumping into the obstacle is over, the position restoration member 68 restores the initial form.

According to the disclosure, it is possible for the robot cleaner to maintain a connectivity of data collected by a sensor and prevent loss of the data by restricting a sensor unit from moving downwards by an external force due to an obstacle.

Also, it is possible for the robot cleaner to identify whether a main sensor reaches a sensing position or is away from a sensing position.

Also, it is possible for the robot cleaner to sense that a sensor unit bumps into an obstacle and clearly identify circumstances of the obstacle.

Also, it is possible for the robot cleaner to allow a sensor unit to restore from being moved by an obstacle.

Also, it is possible for the robot cleaner to prevent a user's finger from being caught by a holder cap when a sensor unit bumps into an obstacle.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A robot cleaner comprising:

a cleaner body configured to move in an area and clean the area; and a sensor assembly provided in the cleaner body, the sensor assembly including:

a main sensor configured to sense an obstacle in the area, the main sensor being moveable between a sensing position where the main sensor protrudes out of the cleaner body and a settled position where the main sensor is inside the cleaner body;

a sensor position changer configured to allow the main sensor to move between the sensing position and the settled position; and a stopper configured to restrict the sensor position changer from allowing the main sensor at the sensing position to move towards the settled position, wherein the stopper comprises at least one member positioned in or configured to be movable into a position blocking at least one of a further movement or a location movement of a portion of the sensor position changer to maintain the main sensor in the sensing position while the main sensor is sensing the area.

2. The robot cleaner according to claim 1, wherein the sensor position changer comprises:

a motor; and a link assembly including:

a first link member configured to rotate with a rotation axis of the motor; and a second link member, a first end of the second link member hinged to the first link member and a second end of the second link member hinged to the main sensor.

3. The robot cleaner according to claim 2, wherein the stopper further comprises a link member receiver configured to receive the first link member while the main sensor is at the sensing position and to restrict the first link member from overly rotating.

4. The robot cleaner according to claim 2, wherein the stopper further comprises a link member supporter having a flat portion which extends perpendicularly along a direction in which the main sensor moves, the flat portion of the link member supporter supporting the first end of the second link member.

5. The robot cleaner according to claim 1, wherein the sensor position changer comprises:

a motor;

a pinion coupled with a rotation axis of the motor; and a rack coupled with the main sensor and geared with the pinion.

6. The robot cleaner according to claim 5, wherein the stopper further comprises:

a locking member; and a driver configured to allow the locking member to move between a lock state and an unlock state, the locking member in the lock state restricting the rack from moving with the main sensor while the main sensor is at the sensing position.

7. The robot cleaner according to claim 1, wherein the sensor assembly further comprises:

a sensor holder having a space to accommodate the main sensor, the sensor holder comprising:

a lower sensor holder holding the main sensor and supported by the sensor position changer; and an upper sensor holder coupled to the lower sensor holder to be movable in a direction where the cleaner body moves within a gap between the lower sensor holder and the upper sensor holder.

8. The robot cleaner according to claim 7, wherein the sensor assembly further comprises a position restoration guide configured to guide the upper sensor holder to move along a direction where the cleaner body moves and to restore the upper sensor holder to an initial position.

9. The robot cleaner according to claim 8, wherein the position restoration guide comprises:

a spring provided between the lower sensor holder and the upper sensor holder;

a first guide provided with one of the lower sensor holder and the upper sensor holder; and a second guide provided opposite the first guide.

10. The robot cleaner according to claim 9, wherein the first guide comprises:

a guide member having a guide groove that extends perpendicularly along a direction in which the cleaner body moves; and a guide pin supported by one of the lower sensor holder and the upper sensor holder, the guide pin being inserted in the guide groove of the guide member, and the second guide comprises:

a convex portion which protrudes from a surface of the upper sensor holder; and a concave portion provided on a surface of the lower sensor holder, a shape of the concave portion corresponding to the convex portion.

11. The robot cleaner according to claim 7, wherein the sensor assembly further comprises:

a base supporting a motor; and a sensor movement guide provided between the base and the sensor holder, the sensor movement guide being configured to guide a movement of the main sensor.

12. The robot cleaner according to claim 7, wherein the sensor assembly further comprises:

a holder cap configured to cover an upper portion of the sensor holder; and a cap supporter having a tension bar that is provided on the upper portion of the sensor holder, the tension bar supporting the holder cap and elastically restore a position of the holder cap.

13. The robot cleaner according to claim 1, wherein the sensor assembly further comprises:

a sensor holder having a space to accommodate the main sensor, the sensor holder being supported by the sensor position changer to be movable in every direction where the cleaner body moves.

14. The robot cleaner according to claim 13, wherein the sensor assembly further comprises a position restoration member configured to restore the sensor holder which is moved by an obstacle to an initial position.

15. The robot cleaner according to claim 14, wherein the position restoration member comprises:

a ring; and a plurality of elastic portions which extend from an inner side of the ring inwards in a spiral form.

16. The robot cleaner according to claim 1, wherein the sensor assembly further comprises an auxiliary sensor that is provided at a position between the settled position and the sensing position of the main sensor and senses whether the main sensor reaches the sensing position or is away from the sensing position.

17. The robot cleaner according to claim 16, wherein the auxiliary sensor further senses whether the main sensor while at the sensing position bumps into the obstacle.

18. The robot cleaner according to claim 17, wherein the auxiliary sensor is off while the main sensor is at the settled position, the auxiliary sensor is on while the main sensor is at a limit position, and the auxiliary sensor is off while the main sensor is at the sensing position.

19. The robot cleaner according to claim 16, wherein the auxiliary sensor is among a pair of auxiliary sensors provided at a limit position opposite to each other in an angle, each of the pair of auxiliary sensors including a first terminal and a second terminal, and the sensor assembly further comprises a pushing switch provided between the pair of auxiliary sensors, the pushing switch being configured to push the second terminal to contact the first terminal.

20. A robot cleaner comprising:

a cleaner body configured to move in an area and clean the area; and a sensor assembly provided in the cleaner body, the sensor assembly comprising:

a main sensor configured to be moveable between a sensing position where the main sensor protrudes out of the cleaner body and a settled position where the main sensor is inside the cleaner body;

a sensor position changer configured to allow the main sensor to move between the sensing position and the settled position; and an auxiliary sensor provided at a position near the sensing position of the main sensor, the auxiliary sensor being configured to sense whetherthe main sensor passes by the position of the auxiliary sensor and reaches the sensing position, a stopper configured to restrict the sensor position changer from allowing the main sensor at the sensing position to move towards the settled position, wherein the stopper comprises at least one member positioned in or configured to be movable into a position blocking at least one of a further movement ora location movement of a portion of the sensor position changer to maintain the main sensor in the sensing position while the main sensor is sensing the area.

* * * * *